US009629473B2

(12) United States Patent
Rawls-Meehan et al.

(10) Patent No.: US 9,629,473 B2
(45) **Date of Patent: *Apr. 25, 2017**

(54) LEG ASSEMBLY

(71) Applicant: ASCION, LLC, Bloomfield Hills, MI (US)

(72) Inventors: Martin B. Rawls-Meehan, Franklin, MI (US); Andrew Z. Gong, Waterford, MI (US); Kyle Allen Nagelkirk, Waterford, MI (US); Leandro Vera, Birmingham, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/004,441

(22) Filed: Jan. 22, 2016

(65) Prior Publication Data

US 2016/0242558 A1 Aug. 25, 2016

Related U.S. Application Data

(63) Continuation-in-part of application No. 14/754,214, filed on Jun. 29, 2015, now Pat. No. 9,451,833, which (Continued)

(51) Int. Cl.

*A47C 19/02* (2006.01)
*A61G 7/05* (2006.01)

(Continued)

(52) U.S. Cl.

CPC ..... *A47C 19/045* (2013.01); *A47C 19/024* (2013.01); *A47C 20/041* (2013.01); *A47C 20/08* (2013.01); *A47C 21/026* (2013.01); *A61G 7/012* (2013.01); *A61G 7/015* (2013.01); *A61G 7/018* (2013.01); *A61G 7/05769* (2013.01);

(Continued)

(58) Field of Classification Search

CPC .... A61G 7/015; A61G 7/018; A61G 13/0036; A61G 13/08; A61G 7/05; A47C 19/005; A47C 19/02; A47C 19/021; A47C 19/024; A47C 19/045; A47C 19/04; A47B 91/02;

(Continued)

(56) References Cited

U.S. PATENT DOCUMENTS 67,391 A 7/1867 Wilcox
399,254 A 3/1889 Foster (Continued)

*Primary Examiner* — Robert G Santos
(74) *Attorney, Agent, or Firm* — Dinsmore & Shohl LLP

(57) ABSTRACT

A leg assembly includes a first leg member and second leg member each having side-to-side width that is greater at the top end than the bottom end and a tapered outer surface. The second leg member has top-to-bottom length different than the top-to-bottom length of the first leg member. The leg members are adapted to connect individually or in combination to a support system such that at least three leg heights are selectably provided. The side-to-side width of the top end of the second leg member is approximately equal to the side-to-side width of the bottom end of the first leg member such that when the top end of the second leg members is connected to the bottom end of the first leg member, the combined leg members have a generally continuously tapered outer surface.

18 Claims, 71 Drawing Sheets

Related U.S. Application Data is a continuation of application No. 13/830,796, filed on Mar. 14, 2013, now Pat. No. 9,173,794, which is a continuation-in-part of application No. 13/750,934, filed on Jan. 25, 2013, now Pat. No. 9,173,793, which is a continuation-in-part of application No. 12/702,405, filed on Feb. 9, 2010, now abandoned.

(60) Provisional application No. 61/648,985, filed on May 18, 2012, provisional application No. 61/170,187, filed on Apr. 17, 2009, provisional application No. 61/150,910, filed on Feb. 9, 2009.

(51) Int. Cl.

| | |
|---|---|
| ***A47B 91/02*** | (2006.01) |
| ***A47C 19/04*** | (2006.01) |
| ***A47C 20/04*** | (2006.01) |
| ***A47C 20/08*** | (2006.01) |
| ***A47C 21/02*** | (2006.01) |
| ***A61G 7/015*** | (2006.01) |
| ***A61G 7/018*** | (2006.01) |
| ***A61G 7/057*** | (2006.01) |
| ***A61H 23/02*** | (2006.01) |
| ***A61G 7/075*** | (2006.01) |
| ***A61G 7/012*** | (2006.01) |

(52) U.S. Cl.

CPC ..... *A61G 7/0755* (2013.01); *A61H 23/02* (2013.01); *A61G 2203/12* (2013.01); *A61G 2203/34* (2013.01); *A61H 2201/0138* (2013.01); *A61H 2201/0142* (2013.01); *A61H 2201/0149* (2013.01); *A61H 2201/5002* (2013.01); *A61H 2201/5097* (2013.01); *A61H 2203/0443* (2013.01)

(58) Field of Classification Search

CPC ... A47B 91/022; A47B 91/024; A47B 91/026; A47B 91/028; A47B 91/16

USPC ..... 5/310, 285, 279.1, 200.1, 201, 202, 114, 5/509.1, 658, 660; 248/188.2, 188.4, 248/188.8

See application file for complete search history.

(56) References Cited

U.S. PATENT DOCUMENTS 537,182 A 4/1895 Brown
1,030,658 A * 6/1912 Gregory ..... A47B 91/024 248/188.2
1,259,650 A 3/1918 McIntyre
1,371,098 A 3/1921 Jones
1,981,627 A 11/1934 Merriman
2,147,538 A 2/1939 Maguire
2,278,894 A 4/1942 Paulson
2,366,867 A 1/1945 Nichthauser
2,456,481 A 12/1948 Gammell
2,527,603 A * 10/1950 Wallance ..... A47B 91/00 16/42 T
2,572,081 A * 10/1951 Wallance ..... A47B 47/03 220/668
2,623,656 A 12/1952 Rottau
2,644,961 A 7/1953 Hillenbrand et al.
2,645,375 A 7/1953 Johannes
2,738,246 A * 3/1956 Hogan, Jr. ..... A47B 13/021 248/188.8
2,787,162 A 4/1957 Crane
2,807,387 A 9/1957 Pasquale
2,826,470 A * 3/1958 Denton ..... A47B 13/021 248/188.8
2,841,457 A * 7/1958 Hauser ..... A47B 41/00 312/280
2,842,417 A * 7/1958 Scanlon ..... A47B 91/00 248/188.8
2,868,602 A * 1/1959 Drezner ..... F16B 12/48 248/188.8
2,893,164 A 7/1959 Manatt
2,933,850 A 4/1960 Manatt
3,061,843 A 11/1962 Singer et al.
3,079,120 A * 2/1963 Schwartz ..... A47B 13/021 108/156
3,113,567 A 12/1963 Russell
3,134,264 A 5/1964 Miller
3,145,020 A 8/1964 Calla
3,154,197 A 10/1964 Tweed
3,182,856 A 5/1965 Goltz
3,232,253 A * 2/1966 Winters ..... A47B 91/022 108/156
3,252,170 A 5/1966 Frye
3,339,214 A 9/1967 Janapol
3,420,402 A 1/1969 Frater
3,524,553 A 8/1970 Zitmore
3,549,018 A 12/1970 Wilson
3,623,634 A 11/1971 Norgard
3,644,946 A 2/1972 Swatt
3,684,123 A 8/1972 Bridges
3,795,925 A 3/1974 Leagus, Jr.
3,854,153 A 12/1974 Fadler et al.
3,856,178 A 12/1974 Norgaard
3,874,725 A * 4/1975 Perry ..... A47D 1/002 297/133
3,885,259 A 5/1975 Cheong
3,921,230 A 11/1975 Hanning et al.
4,029,209 A 6/1977 Frahm et al.
4,042,199 A * 8/1977 Winkler ..... A47B 91/00 248/188.8
4,095,296 A 6/1978 Ferro
4,188,151 A 2/1980 Hall
4,194,255 A 3/1980 Poppe
D255,402 S 6/1980 Lundgren
4,243,263 A 1/1981 Thiboutot
4,333,573 A 6/1982 Holoubek
4,381,571 A 5/1983 Elliott
D271,729 S 12/1983 Dodrill
4,447,921 A 5/1984 Greenblatt
4,458,371 A 7/1984 Whitehead
4,589,151 A 5/1986 Behrens
4,589,620 A 5/1986 Sakamoto
4,619,363 A 10/1986 Wolfseder
4,764,881 A 8/1988 Gagnon
4,775,002 A 10/1988 Iwamoto
4,868,941 A 9/1989 Tai
4,919,386 A 4/1990 Cassina
4,981,214 A 1/1991 Rojas
5,040,681 A 8/1991 Grusin
5,079,790 A 1/1992 Pouch
5,165,129 A 11/1992 Rohm
5,210,890 A 5/1993 Hagglund
5,230,113 A 7/1993 Foster et al.
D338,360 S 8/1993 Petersen
5,235,258 A 8/1993 Schuerch
5,257,428 A 11/1993 Carroll et al.
5,297,616 A 3/1994 Pralus
5,318,182 A 6/1994 Thorud et al.
5,325,966 A 7/1994 Chang
5,335,313 A 8/1994 Douglas
5,385,326 A 1/1995 Bidwell
D361,476 S 8/1995 Bidwell
5,542,780 A 8/1996 Kourgli
5,544,376 A 8/1996 Fromson
5,575,401 A 11/1996 Trower et al.
5,577,280 A 11/1996 Elliott
5,592,153 A 1/1997 Welling et al.
5,600,214 A 2/1997 Fromson
5,615,429 A 4/1997 Williams
D379,061 S 5/1997 Williams
5,659,905 A 8/1997 Palmer, Jr. et al.
5,664,270 A 9/1997 Bell et al.
5,697,500 A 12/1997 Walker
5,720,471 A 2/1998 Constantinescu et al.

(56) References Cited

U.S. PATENT DOCUMENTS 5,758,586 A * 6/1998 Kieser ..... A47B 9/00 108/144.11
5,758,588 A 6/1998 Orfali
5,771,511 A 6/1998 Kummer et al.
5,787,528 A 8/1998 Antinori
5,926,877 A 7/1999 Lin
5,934,466 A 8/1999 Loeffler
5,948,303 A 9/1999 Larson
5,953,778 A 9/1999 Hiatt
5,969,488 A 10/1999 Fromson
5,978,992 A 11/1999 Antinori
6,003,706 A 12/1999 Rosen
6,006,379 A * 12/1999 Hensley ..... A47C 20/041 5/616
6,008,598 A 12/1999 Luff et al.
6,012,185 A 1/2000 Woods et al.
6,015,046 A 1/2000 Brunelle
6,026,553 A 2/2000 Brunelle
6,065,960 A 5/2000 Hardy
6,079,065 A 6/2000 Luff et al.
6,101,647 A 8/2000 Stroud et al.
6,106,576 A 8/2000 Fromson
6,128,798 A 10/2000 Barman et al.
6,163,904 A 12/2000 Royston
6,209,157 B1 4/2001 Hensley
6,216,295 B1 4/2001 Pearson
6,263,527 B1 7/2001 Ross et al.
6,276,011 B1 8/2001 Antinori
6,311,348 B1 11/2001 Luff et al.
6,315,319 B1 11/2001 Hanson et al.
6,347,423 B1 2/2002 Stumpf
6,374,436 B1 4/2002 Foster et al.
6,378,152 B1 4/2002 Washburn et al.
6,393,641 B1 5/2002 Hensley
6,446,282 B1 9/2002 Wu
6,446,807 B1 9/2002 Lafond et al.
6,486,792 B1 11/2002 Moster et al.
6,499,161 B1 12/2002 Godette
6,499,162 B1 12/2002 Lu
6,560,796 B1 * 5/2003 Diforio ..... A47C 19/024 5/185
6,575,414 B2 6/2003 Cuzzocrea
6,600,421 B2 7/2003 Freeman
6,678,907 B1 1/2004 Voelker et al.
6,681,425 B2 1/2004 Leventhal et al.
6,684,423 B2 2/2004 Godette
6,708,358 B2 3/2004 Hensley
6,748,278 B1 6/2004 Maymudes
6,789,280 B1 9/2004 Paul
D498,412 S 11/2004 Pehta et al.
6,857,148 B2 2/2005 Van Raemdonck
6,892,991 B1 5/2005 Soh
6,928,673 B2 8/2005 Risk, Jr.
6,948,688 B1 9/2005 Payne et al.
6,968,583 B1 11/2005 Rich
6,971,997 B1 12/2005 Ryan et al.
6,990,698 B2 1/2006 Wall, Sr.
7,000,269 B2 2/2006 Borda
7,017,208 B2 3/2006 Weismiller et al.
7,040,057 B2 5/2006 Gallant et al.
7,047,579 B2 5/2006 Piana et al.
7,120,956 B1 10/2006 Liao
7,134,154 B2 * 11/2006 Cloer ..... A47C 19/025 5/200.1
7,154,397 B2 12/2006 Zerhusen et al.
7,165,277 B2 1/2007 Taguchi et al.
7,174,586 B2 2/2007 Nagaoka
7,219,378 B2 * 5/2007 Polevoy ..... A47C 19/024 5/200.1
7,231,676 B2 * 6/2007 Cloer ..... A47C 19/025 108/147.19
7,237,287 B2 7/2007 Weismiller et al.
7,242,308 B2 7/2007 Ulrich et al.
7,278,687 B2 * 10/2007 Crue ..... A47C 9/007 248/188.4
7,315,535 B2 1/2008 Schuman
7,321,811 B1 1/2008 Rawls-Meehan
7,322,058 B2 1/2008 Long
7,346,944 B2 3/2008 Shaw
7,353,550 B2 4/2008 Antinori
7,364,539 B2 4/2008 Mackin et al.
7,448,100 B1 11/2008 Shih
7,465,280 B2 12/2008 Rawls-Meehan
7,477,285 B1 1/2009 Johnson
7,574,831 B2 8/2009 Meyers
7,690,060 B2 4/2010 Rodrigues Moreira
7,698,756 B1 4/2010 Chen
7,805,782 B2 10/2010 Hakamiun et al.
7,810,189 B2 10/2010 Boudreau
7,832,039 B2 11/2010 Chambers et al.
7,886,379 B2 2/2011 Benzo et al.
7,900,302 B2 3/2011 Long
7,930,780 B2 4/2011 Clenet
7,997,031 B2 8/2011 Meyers
8,069,512 B2 12/2011 Rawls-Meehan
8,091,165 B2 1/2012 Mossbeck
D653,870 S 2/2012 Messenger
D657,158 S 4/2012 McCarty et al.
8,146,188 B2 4/2012 Hibler
8,375,488 B2 2/2013 Rawls-Meehan
D717,088 S 11/2014 Rawls-Meehan
D717,575 S 11/2014 Rawls-Meehan
D719,759 S 12/2014 Rawls-Meehan
9,033,293 B1 5/2015 Glenn et al.
9,044,365 B2 * 6/2015 Rawls-Meehan ..... A61G 7/015
9,044,366 B2 * 6/2015 Rawls-Meehan ..... A61G 7/015
9,089,222 B2 7/2015 Stewart et al.
9,167,908 B1 10/2015 Anthony et al.
9,173,793 B2 11/2015 Rawls-Meehan
9,173,794 B2 * 11/2015 Rawls-Meehan ..... A61G 7/015
2001/0000828 A1 * 5/2001 Hensley ..... A47C 20/041 5/618
2001/0023509 A1 9/2001 Becker et al.
2002/0091340 A1 7/2002 Robbins
2002/0139907 A1 10/2002 Cuzzocrea
2003/0009831 A1 1/2003 Giori et al.
2003/0052787 A1 3/2003 Zerhusen et al.
2003/0145527 A1 8/2003 Meyers
2004/0068797 A1 4/2004 Smith et al.
2004/0117835 A1 6/2004 Lorkovic
2004/0133987 A1 7/2004 Reeder et al.
2004/0139546 A1 7/2004 Ferrand et al.
2004/0143201 A1 7/2004 Moriyasu
2004/0183681 A1 9/2004 Smith
2004/0216235 A1 11/2004 Rees
2005/0000020 A1 1/2005 Schermel
2005/0005357 A1 1/2005 Van Raemdonck
2005/0011005 A1 1/2005 Borda
2005/0102167 A1 5/2005 Kapoor
2005/0251917 A1 11/2005 Wall
2005/0278849 A1 * 12/2005 Polevoy ..... A47C 19/024 5/310
2006/0037532 A1 2/2006 Eidson
2006/0056616 A1 3/2006 Heimbrock
2006/0058587 A1 3/2006 Heimbrock et al.
2006/0087097 A1 4/2006 Kramer et al.
2006/0119156 A1 * 6/2006 Crue ..... A47C 9/007 297/344.18
2006/0146017 A1 7/2006 Leung et al.
2006/0179571 A1 8/2006 Newkirk
2006/0195982 A1 * 9/2006 Cloer ..... A47C 19/025 5/202
2006/0271207 A1 11/2006 Shaw
2006/0277683 A1 12/2006 Lamire et al.
2006/0282945 A1 12/2006 Gallawa et al.
2007/0000057 A1 1/2007 Ward
2007/0074344 A1 * 4/2007 Cloer ..... A47C 19/025 5/310
2007/0143920 A1 6/2007 Frondorf et al.
2007/0163045 A1 7/2007 Becker et al.
2007/0174964 A1 8/2007 Lemire et al.
2007/0220677 A1 9/2007 Dewert

(56) References Cited

U.S. PATENT DOCUMENTS

2007/0283494 A1 12/2007 Vasey
2008/0028535 A1 2/2008 Rodrigues Moreira
2008/0052831 A1 3/2008 Weismiller et al.
2008/0071200 A1 3/2008 Rawls-Meehan
2008/0092291 A1 4/2008 Rawls-Meehan
2008/0092292 A1 4/2008 Rawls-Meehan
2008/0092293 A1 4/2008 Rawls-Meehan
2008/0092294 A1 4/2008 Rawls-Meehan
2008/0094207 A1 4/2008 Collins et al.
2008/0104750 A1 5/2008 Rawls-Meehan
2008/0104754 A1 5/2008 Rawls-Meehan
2008/0104755 A1 5/2008 Rawls-Meehan
2008/0104756 A1 5/2008 Rawls-Meehan
2008/0104757 A1 5/2008 Rawls-Meehan
2008/0104758 A1 5/2008 Rawls-Meehan
2008/0104759 A1 5/2008 Rawls-Meehan
2008/0104760 A1 5/2008 Rawls-Meehan
2008/0104761 A1 5/2008 Rawls-Meehan
2008/0109959 A1 5/2008 Rawls-Meehan
2008/0115272 A1 5/2008 Rawls-Meehan
2008/0115273 A1 5/2008 Rawls-Meehan
2008/0115274 A1 5/2008 Rawls-Meehan
2008/0115275 A1 5/2008 Rawls-Meehan
2008/0115276 A1 5/2008 Rawls-Meehan
2008/0115277 A1 5/2008 Rawls-Meehan
2008/0115278 A1 5/2008 Rawls-Meehan
2008/0115279 A1 5/2008 Rawls-Meehan
2008/0115280 A1 5/2008 Rawls-Meehan
2008/0115281 A1 5/2008 Rawls-Meehan
2008/0115282 A1 5/2008 Rawls-Meehan
2008/0120775 A1 5/2008 Rawls-Meehan
2008/0120776 A1 5/2008 Rawls-Meehan
2008/0120777 A1 5/2008 Rawls-Meehan
2008/0120778 A1 5/2008 Rawls-Meehan
2008/0120779 A1 5/2008 Rawls-Meehan
2008/0127418 A1 6/2008 Rawls-Meehan
2008/0178388 A1 7/2008 Schermel
2008/0224861 A1 9/2008 McNeely et al.
2008/0276373 A1 11/2008 Clenet
2009/0038073 A1 2/2009 Dippl et al.
2009/0100599 A1 4/2009 Rawls-Meehan
2009/0120013 A1 5/2009 Meyers
2009/0121660 A1 5/2009 Rawls-Meehan
2009/0193587 A1 8/2009 Neuenswander et al.
2009/0300844 A1 12/2009 Taylor
2010/0186168 A1 7/2010 Harrison
2010/0275376 A1 11/2010 Benzo et al.
2010/0287699 A1 11/2010 Brune
2011/0010860 A1 1/2011 Grimes et al.
2011/0191959 A1 8/2011 Hornbach et al.
2011/0219545 A1 9/2011 Dorenbeck et al.
2013/0117932 A1 5/2013 Stewart et al.
2013/0191993 A1 8/2013 Rawls-Meehan
2013/0283531 A1* 10/2013 Rawls-Meehan ..... A61G 7/015 5/619
2014/0250594 A1* 9/2014 Rawls-Meehan ..... A61G 7/015 5/400
2014/0325761 A1 11/2014 Rawls-Meehan
2015/0296991 A1* 10/2015 Rawls-Meehan ..... A61G 7/015 5/613
2015/0297431 A1* 10/2015 Rawls-Meehan ..... A61H 23/04 5/617
2015/0335162 A1* 11/2015 Rawls-Meehan ..... A61G 7/015 5/617
2015/0366731 A1* 12/2015 Rawls-Meehan ..... A61H 23/04 5/617
2016/0000622 A1* 1/2016 Rawls-Meehan ..... A61H 23/04 5/412

* cited by examiner

2500

FIG. 59
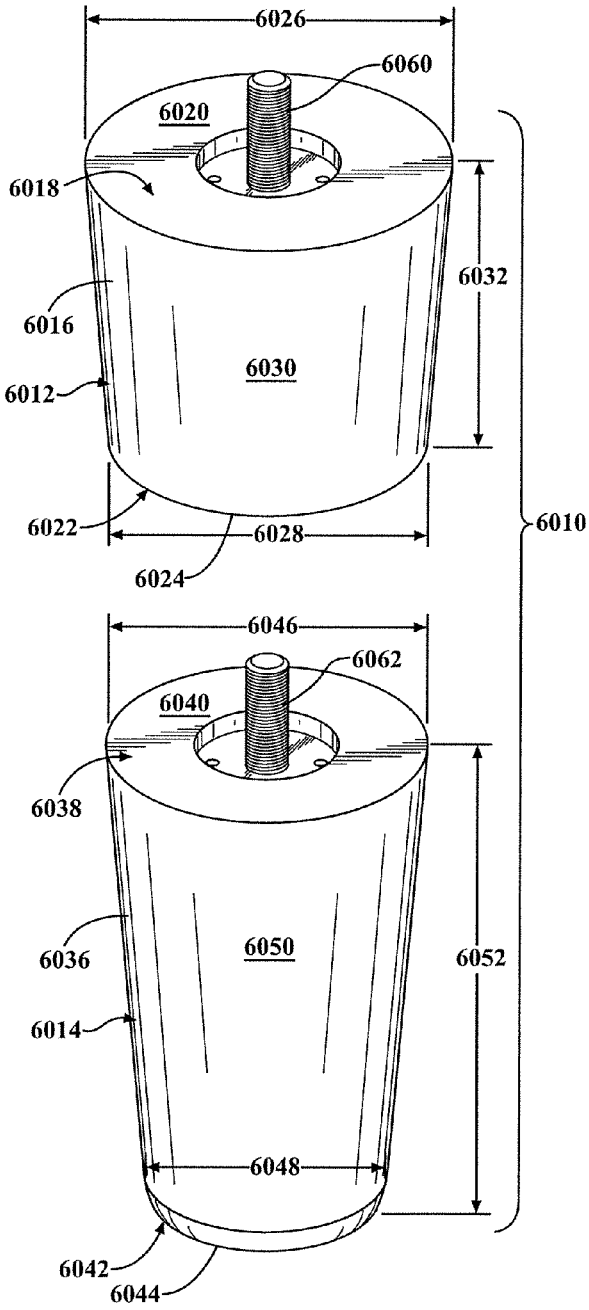
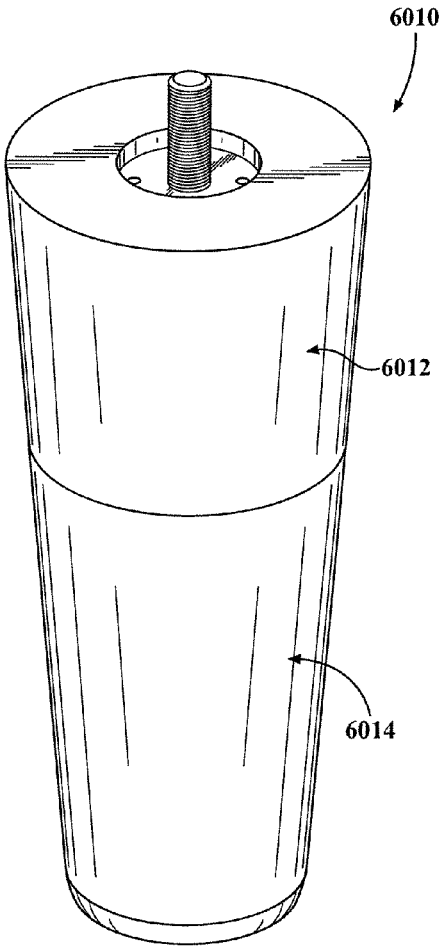
FIG. 60

LEG ASSEMBLY

CROSS-REFERENCE TO RELATED APPLICATIONS

This patent application is a continuation-in-part of U.S. patent application Ser. No. 14/754,214, filed Jun. 29, 2015. U.S. patent application Ser. No. 14/754,214 is a continuation of U.S. patent application Ser. No. 13/830,796 filed on Mar. 14, 2013. U.S. patent application Ser. No. 13/830,796 is a continuation-in-part of U.S. patent application Ser. No. 13/750,934 filed on Jan. 25, 2013. U.S. patent application Ser. No. 13/750,934 claims the benefit of U.S. Provisional Application No. 61/648,985 filed on May 18, 2012. U.S. patent application Ser. No. 13/750,934 is a continuation-in-part of U.S. patent application Ser. No. 12/702,405 filed on Feb. 9, 2010. U.S. patent application Ser. No. 12/702,405 claims the benefit of U.S. Provisional Application No. 61/170,187 filed on Apr. 17, 2009. U.S. patent application Ser. No. 12/702,405 claims the benefit of U.S. Provisional Application No. 61/150,910 filed on Feb. 9, 2009. The contents of each of which are incorporated herein in their entirety.

BACKGROUND OF THE INVENTION

1. Field

This invention relates to leg assembly, in particular a leg assembly for supporting a support system such as an adjustable bed frame.

2. Background

Adjustable beds are available in a number of configurations. There exists a need for a leg assembly for adjustable beds and other uses.

SUMMARY OF THE INVENTION

In an aspect of the invention, an embodiment of the present invention can be described as a leg assembly for supporting a support system. The leg assembly includes a first leg member having a body portion with a top end having a top surface and an opposite bottom end having a bottom surface. The top end has a side-to-side width greater than a side-to-side width of the bottom end. The first leg member further has a tapered outer surface extending between the top and bottom surfaces. The body portion of the first leg member has a first top-to-bottom length defined between the top surface and bottom surface. The leg assembly also includes a second leg member having a body portion with a top end having a top surface and an opposite bottom end having a bottom surface. The top end has a side-to-side width greater than a side-to-side width of the bottom end. The second leg member further has a tapered outer surface extending between the top and bottom surfaces. The body portion has a second top-to-bottom length defined between the top surface and bottom surface, with the second top-to-bottom length being different than the first top-to-bottom length. The first and second leg members are adapted to connect individually or in combination to the support frame such that at least three leg heights are selectably provided. The side-to-side width of the top end of the second leg member is approximately equal to the side-to-side width of the bottom end of the first leg member such that when the top end of the second leg member is connected to the bottom end of the first leg member, the top surface of the second leg member is disposed against the bottom surface of the first leg member and the combined leg members have a generally continuously tapered outer surface.

In some versions, the first and second leg members each have a connecting element extending from the top surface for connecting the leg member to another leg member or to the support frame. The connecting elements may be threaded elements. The body portion of each of the leg members may be formed substantially from wood and the connecting elements may be formed of metal.

In some versions, the first leg member has a receiving opening defined in the bottom surface for receiving the connecting element of the second leg member, and the second leg member does not have a receiving opening defined in the bottom surface.

In some versions, the top-to-bottom height of the first leg member is less than the top-to-bottom height of the second leg member. In certain versions, the outer surfaces of the first and second leg members are circular in side-to-side cross section.

In some versions, the support system is a support frame including a base frame and an articulating frame supported by the base frame, and the leg members adapted to connect to the base frame.

In some versions, the support system is a mattress support frame.

Some versions further include a plurality of leg assemblies.

A further embodiment of the present invention can be described as a bed foundation, having a mattress support frame with a base frame and an articulating frame supported on the base frame, and a plurality of modular leg assemblies. Each leg assembly has a first leg member that includes a top end having a top surface and an opposite bottom end having a bottom surface, the top end having a side-to-side width greater than a side-to-side width of the bottom end. The first leg member further has a tapered outer surface extending between the top and bottom surfaces. The body portion of the first leg member has a first top-to-bottom length defined between the top surface and bottom surface. Each leg assembly further has a second leg member having a body portion with a top end having a top surface and an opposite bottom end having a bottom surface, the top end having a side-to-side width greater than a side-to-side width of the bottom end. The second leg member further has a tapered outer surface extending between the top and bottom surfaces. The body portion has a second top-to-bottom length defined between the top surface and bottom surface, the second top-to-bottom length being different than the first top-to-bottom length. A plurality of the first leg members are each connected to the base frame to provide a first leg length for the bed foundation, a plurality of the second leg members are each connected to the base frame to provide a second leg length for the bed foundation, and a plurality of interconnected first and second leg members are connected to the base frame to provide a third leg length greater than the first or second leg length. The side-to-side width of the top end of each of the second leg members is approximately equal to the side-to-side width of the bottom end of each of the first leg members such that when the top end of one of the second leg members is connected to the bottom end of one of the first leg members, the top surface of the one of the second leg members is disposed against the bottom surface of the one of the first leg members and the combined leg members have a generally continuously tapered outer surface.

Another embodiment provides a modular leg kit for a bed foundation having a base frame. The modular leg kit includes a plurality of first leg members each having a body portion with a top end having a top surface and an opposite bottom end having a bottom surface. The top end has a side-to-side width greater than a side-to-side width of the bottom end. The first leg member further has a tapered outer surface extending between the top and bottom surfaces, the body portion of the first leg member having a first top-to-bottom length defined between the top surface and bottom surface. The kit further includes a plurality of second leg members each having a body portion with a top end having a top surface and an opposite bottom end having a bottom surface, the top end having a side-to-side width greater than a side-to-side width of the bottom end. The second leg member further has a tapered outer surface extending between the top and bottom surfaces. The body portion has a second top-to-bottom length defined between the top surface and bottom surface, the second top-to-bottom length being different than the first top-to-bottom length. A plurality of the first leg members are each connected to the base frame to provide a first leg length for the bed foundation, a plurality of the second leg members are each connected to the base frame to provide a second leg length for the bed foundation, and a plurality of connected together first and second leg members are connected to the base frame to provide a third leg length greater than the first or second leg length. The side-to-side width of the top end of each of the second leg members is approximately equal to the side-to-side width of the bottom end of each of the first leg members such that when the top end of one of the second leg members is connected to the bottom end of one of the first leg members, the top surface of the one of the second leg members is disposed against the bottom surface of the one of the first leg members and the combined leg members have a generally continuously tapered outer surface.

In some versions, each of the first and second leg members has a connecting element extending therefrom for connecting the leg member to another leg member or to the base frame, and the connecting element may be a threaded element. The body of each of the leg members may be formed substantially from wood and the connecting elements may be formed of metal. Each of the first leg members may have a receiving opening defined in the bottom surface for receiving the connecting element of one of the second leg members while each of the second leg members may lack a receiving opening defined in the bottom surface.

In some versions, the top-to-bottom height of each of the first leg members is less than the top-to-bottom height of each of the second leg members.

In certain versions, the outer surfaces of the first and second leg members are circular in side-to-side cross section.

BRIEF DESCRIPTION OF FIGURES

The systems and methods described herein may be understood by reference to the following figures:

FIG. 59 is an exploded perspective view of an embodiment of a modular leg assembly.

FIG. 60 is a perspective view of the modular leg assembly of FIG. 59 with the leg members connected together.

DETAILED DESCRIPTION OF FIGURES

Figure 1:
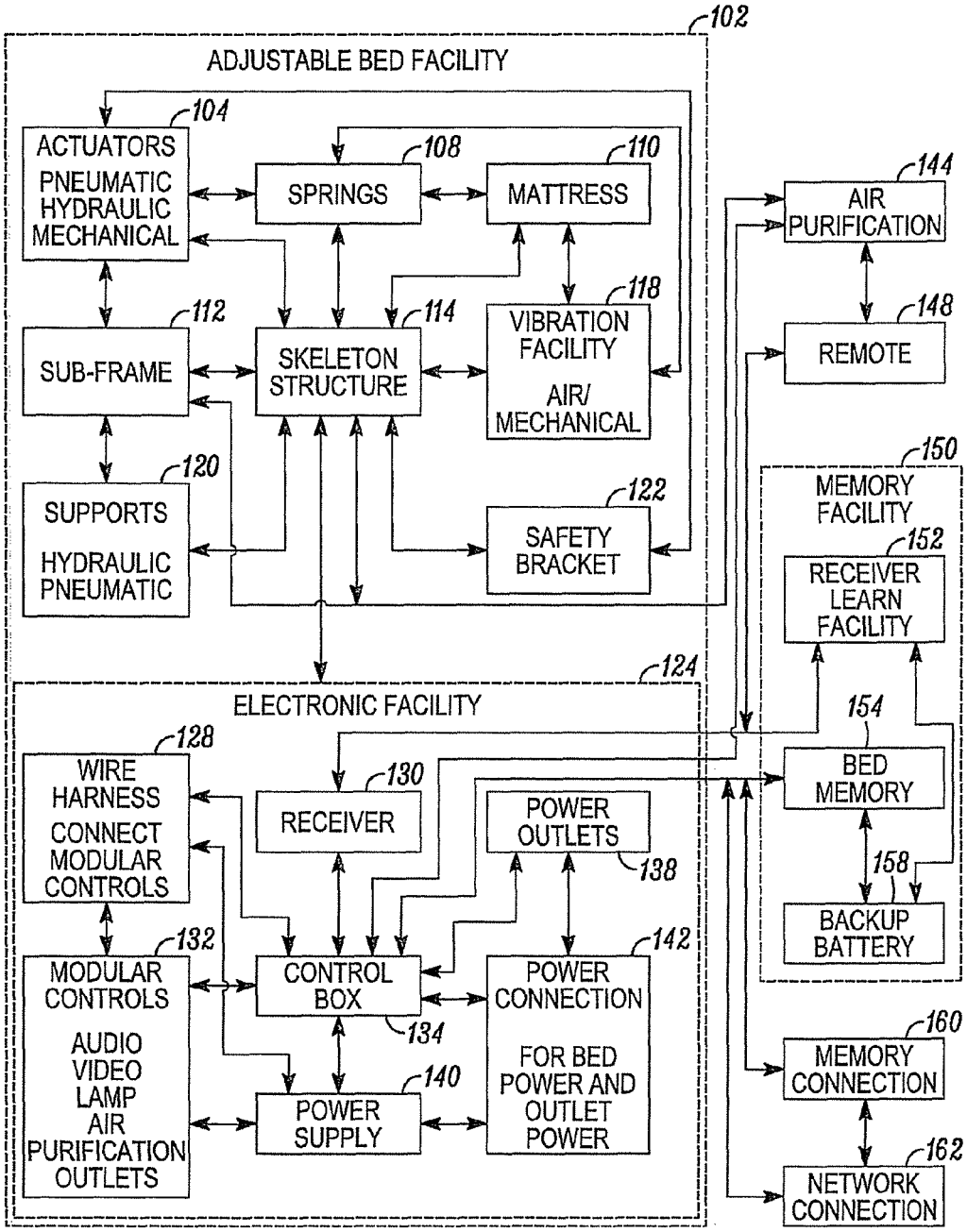
FIG. 1 shows a block diagram of an adjustable bed facility and associated components.

In the following description, terms such as 'adjustable mattress', 'adjustable bed', 'adjustable bed facility', 'adjustable bed apparatus', and the like are used interchangeably to refer generally to an apparatus including a sleeping or resting surface with one or more adjustable or moveable sub-surfaces that can be positioned for user comfort and/or convenience, unless a specific meaning is explicitly provided or otherwise clear from the context As users spend more and more time in adjustable beds they may desire to have a level of independence by controlling devices that may be in the room from the adjustable bed. The devices and facilities that users may wish to control may include audio equipment, video equipment, lamps, air purification facilities, power outlets, and the like. It may be desirable for the user to control these devices and facilities from the adjustable bed without having to leave the bed or ask for aid from someone else. For example, the user may be confined to the bed and may want the simple ability to control the lights around the adjustable bed.

In an embodiment, an adjustable bed may not be the only rest facility to benefit from position and additional function control. Users may also use beds, adjustable beds, adjustable chairs, adjustable couches, and the like to provide comfortable positions when the user may have limited mobility. For example, a user that has had hip replacement surgery may not be confined to bed but may require a chair or couch to be adjustable to provide a comfortable sitting position while providing control of other devices within the room to limit the number of times the user must get up and adjust the devices. In an embodiment, while recovering from a surgery, an injury, an illness, or the like, the user may use more than one type of rest facility. The user may require confinement to an adjustable bed for a time and then, with health improvement, be able to move to either an adjustable chair or adjustable couch.

Aspects of the invention may be described as an adjustable bed, but it may be understood that the same aspects may be applied to other rest facilities that may include a bed, a couch, a chair, or the like. Such rest facilities may be in a home, a car, a recreational vehicle, a cruise ship, an airline, a train, or anywhere that a user required them, and they may be fixed or mobile.

One aspect of this invention may be to provide the adjustable bed with more than one power option to move the adjustable bed sections. The adjustable bed may use electric motors with gearboxes, pneumatic springs, hydraulic springs, or the like to actuate the adjustable bed sections. There may be both pricing and durability reasons to have the different actuation types.

Another aspect of this invention may be to provide the ability to provide additional functionality to the adjustable bed by using modular controls that may be able to communicate with the user's interface control. The modular controls may be designed to control a number of additional devices and facilities that may include audio devices, video devices, lamps, air purification facilities, power outlets, and the like.

Another aspect of the adjustable bed may be to provide a support structure to support the bed materials (e.g. mattress), motors, actuators, hinges between bed sections, and the like. The support structure may be a frame structure to provide the support yet remain lightweight.

Another aspect may be the use of replaceable memory to maintain the bed memory and software applications. The replaceable memory may allow user specific information to be moved from one adjustable bed to another adjustable bed. This may be useful in care facilities where a user may move from one bed to another bed during the stay in the care facility. If the user has saved a preferred positioning of the adjustable bed, when the user moves to another bed, the preferred positioning settings may be moved to the other bed with the user.

Another aspect of the adjustable bed may be to provide safety features that may control the retraction of the adjustable bed sections to reduce the risk of crushing an object that may be under the adjustable bed.

Now referring to FIG. 1, a block diagram of the various components of the adjustable bed facility 102 is shown. In an embodiment, an adjustable bed facility 102 may be made up of a number of devices and facilities that may include actuators 104, springs 108, mattresses 110, a sub-frame 112, a skeleton structure 114, vibration motors 118, supports 120, safety brackets 122, an electronic facility 124, an air purification facility 144, a remote 148, a memory facility 150, a memory connection 160, a network connection 162, and the like. In an embodiment, the electronic facility 124 may include a wire harness 128, a receiver 130, modular controls 132, a control box 134, power outlets 138, a power connection 142, and the like. In an embodiment, the memory facility 150 may include a receiver learn facility 152, bed memory 154, a backup battery 158, and the like. In an embodiment, the receiver learn facility 152, bed memory 154, and backup battery 158 may not be part of the memory facility 150, but may be combined into other facilities or devices, be stand-alone devices, or the like.

In an embodiment, the physical aspects of the adjustable bed facility 102 that provide support for the user may include the actuators 104, springs 108, mattresses 110, a sub-frame 112, a skeleton structure 114, vibration motors 118, supports 120, and safety brackets 122.

In an embodiment, the skeleton structure 114 may provide the central structure that the other physical aspects may interact with. In an embodiment, the skeleton structure 114 may provide direct support to the mattress 110, springs 108, and the like. In an embodiment, the skeleton structure 114 may be a lightweight frame structure that may provide both the strength and rigidity required to properly support the mattress 110 and springs 108. In embodiments, the skeleton structure 114 may use materials that include metal, plastic, wood, or the like; the materials may be used individually or in combination. In an embodiment, the skeleton structure 114 may include more than one section/frame. The sections/frames may be fixed or may be adjustable/movable. Further, the sections/frames may be assembled together to form the skeleton structure 114 in such a way that the sections/frames may be able to move relative to each other to provide the various bed positions required by the user.

In an embodiment, springs 108 may be used with a mattress 110, instead of a mattress 110, or the like. In an embodiment, the springs may be a standard bed spring system (e.g. coils within a wire framework), individual coil springs, individual foam springs, air springs, or the like. In an embodiment, the individual springs (e.g. coil, foam, or air) may be used to provide variable firmness to provide comfort to the user. For example, the springs 108 may be less firm or firmer in a local area to provide the user with the support that may be required for a body location that is experiencing discomfort (e.g. a hip, shoulder, back, neck). Springs that may have local firmnesses will be described in more detail below.

In an embodiment, the mattress 110 may include foam, feathers, springs 108, material, or the like. In an embodiment, the different materials may be used individually or in combination. The mattress may be intended to provide the user with a firmness that provides for the comfort requirements of the user.

In an embodiment, the mattress 110 may be an air mattress 110. In an embodiment, the air mattress 110 may be constructed using a single chamber, a plurality of chambers, a plurality of individual chambers, a combination of chamber shapes, or the like. In an embodiment, the air mattress 110 may be inflated to various pressures that may provide the user with the desired comfort level. In an embodiment, there may be separate air mattresses 110 for each of the adjustable bed facility 102 sections. For example, there may be separate air mattresses 110 for the head, torso, and foot sections of the adjustable bed facility 102. In an embodiment, the inflation pressure of the individual air mattresses 110 may be different from each other depending on user settings.

In an embodiment, the adjustable bed facility 102 sections may each contain individual air mattresses 110. For example, the head, torso, and foot sections may each have individual air mattresses that may be individually controlled for air pressures and therefore firmness. In an embodiment, the user may be able to control the firmness of the individual air mattresses 110 using a remote 148. In an embodiment, the remote 148 may have indicators for each of the firmness adjustable air mattresses 110. For example, the remote 148 may have keys for increasing or decreasing the pressures of the individual air mattresses 148. Using the remote 148, the user may be able to adjust the firmness of the adjustable bed facility sections.

In an embodiment, the air mattress 110 may use a common air supply source facility as an air actuator 104. In an embodiment, a control box 134 may control both the air mattress 110 and air actuator 104. The control box 134 may provide controlling commands to both the air mattress 110 and air actuators.

In an embodiment, the skeleton structure 114 may have structural members that support the mattress 110 and springs 108 and may also provide support and connections for the actuators 104, sub-frame 112, supports 120, vibrator motors 118, safety bracket 122, and the like. In an embodiment, the structural members may be positioned on the peripheral edges of the mattress 110 and springs 108 to provide overall support and rigidity to the mattress 110 and springs 108 and may form the base of the individual adjustable bed facility 102 sections. Additionally, there may other structural members as support, cross pieces, or the like that may provide additional support to the mattress 110 and springs 108 as may be required. A person knowledgeable in the art may understand that the frame structure may have many different construction configurations to provide support and rigidity to the mattress 110 and springs 108.

In an embodiment, the skeleton structure 114 may include more than one section/frame. The sections/frames may be fixed or may be adjustable or movable. Further, the sections/ frames may be assembled together to form the skeleton structure 114 in such a way that the sections/frames may be able to move relative to each other to provide the various bed positions required by the user. To achieve this, the sections/frames may be connected together using hinges or like devices that allow a freedom of motion between them.

Figure 10A:
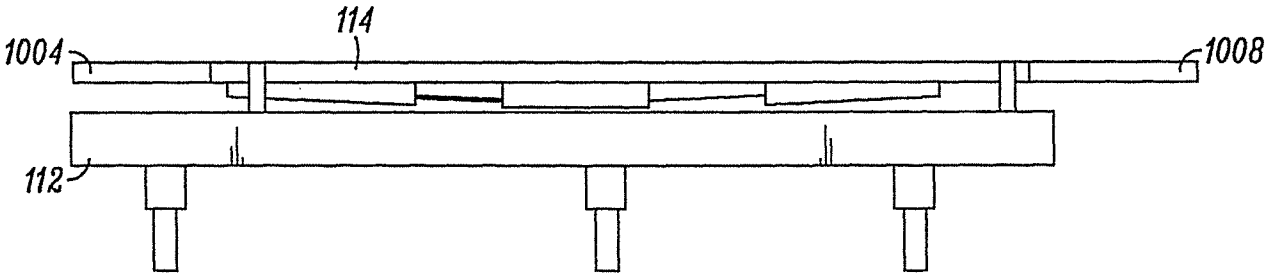
FIGS. 10A, 10B, and 10C show an adjustable bed facility according to an embodiment of the present invention.
Figure 10B:
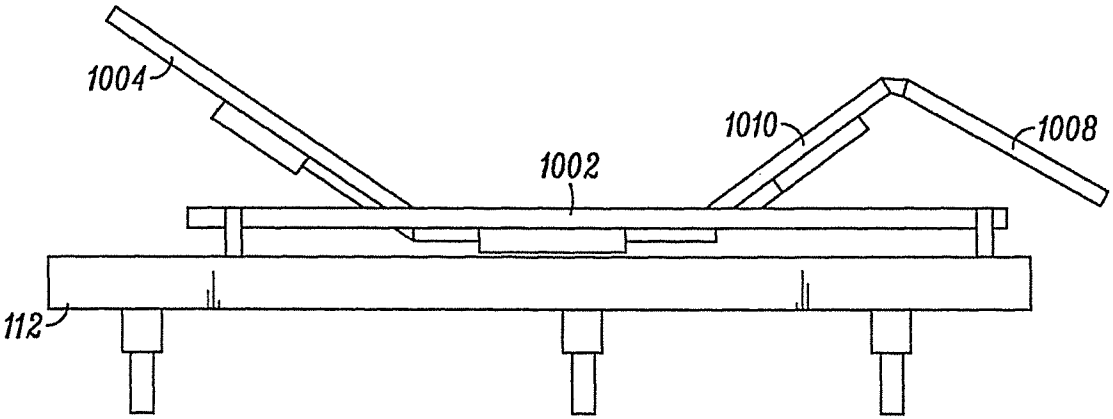
Figure 10C:
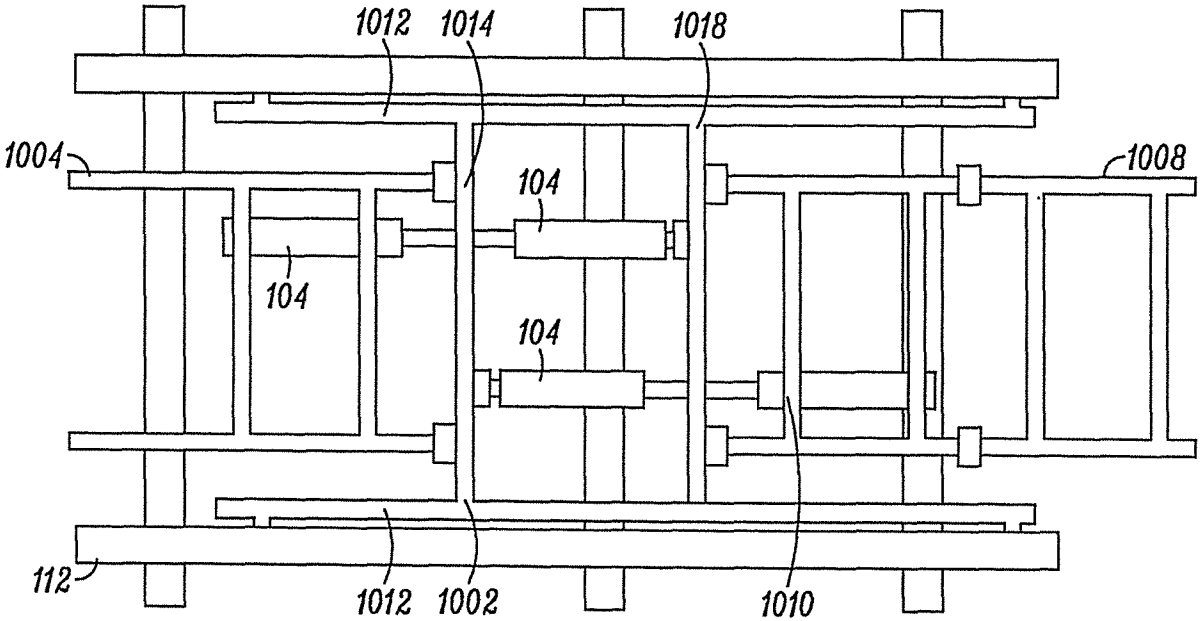

In one embodiment, one frame/section may remain fixed and may act as the foundation for the other movable frames/sections. For example, in an arrangement as shown in FIGS. 10A and 10B, the skeleton structure 114 may have a fixed center fame 1002 and adjustable frames for the head 1004, foot 1008, and leg 1010. In this arrangement, the adjustable head frame 1004 and the adjustable leg frame 1010 may be pivotally attached to the center frame 1002. The pivot attachments may enable rotational movement of the head frame 1004 and the leg frame 1010 with respect to the fixed center frame 1002. In a scenario, because of this rotational movement, the head frame 1004 may be raised with the help of the actuators 104 to raise the upper portion of a patient body during meals. Further, the head frame 1004 may be lowered to the normal level after the patient has had his/her meal. In a similar fashion, a person lying on the adjustable bed 102 may raise or lower the head frame 1004 and/or the foot frame 1008 to his/her convenience. FIG. 10C shows an example top view of one embodiment.

In another embodiment, any or none of the frames/sections may be a fixed foundation section in the adjustable bed facility 102. In embodiments, there may be more than one adjustable bed facility 102 configuration depending on the requirements of a user, cost requirements, medical needs, or the like. For example, there may be a configuration where only the head section is adjustable to provide the user with the ability to have an elevated upper body position. This configuration may be a single purpose bed but may also provide the user with a less expensive adjustable bed facility 102 that meets the user's needs. One skilled in the art may understand that there may be many different adjustable bed facility configurations containing fixed and moveable sections.

In embodiments, there may be different combinations of movable and fixed sections with one or all of the sections being movable. In an embodiment, the sections may include the skeleton structure 114, mattress 110, springs 108, and the like and may individually be small mattress structures of the entire adjustable bed facility 102 mattress.

In embodiments, the frames may be made of square tubular steel bars/pipes or any other material capable of providing required strength to the frames. In preferred embodiments, each frame may include two substantially parallel side frame members connected by one or more connector frame members. In order to connect the parallel side frame members, various joining methods such as welding, brazing, riveting, fastening with nuts, and the like can be used. For example, the center frame 1002 may include two substantially parallel side frame members 1012 connected by two substantially parallel connector frame members 1014 and 1018. The two connector frame members 1014 and 1018 may be located within approximately a center one-third of the length of the side frame members 1012. Once the frame members have been connected to each other using any one of the joining methods as discussed above, the center frame 1002 may take a substantially square or rectangular shape. Those skilled in the art would appreciate that the frames may have various other shapes and designs to perform the same functionality and without deviating from the scope of the invention.

In an embodiment, the skeleton structure 114, as part of each adjustable bed facility 102 frame/section, may also provide support and connection members for the components that may be used to move the various adjustable bed facility 102 sections. There may be skeleton structure 114 members that provide connection support to the actuators 104, supports 120, safety brackets 122, vibration motors 118, and the like. These support and connection members may have any shape or configuration required to provide the support and connections needed by the various other components. For example, in addition to the skeleton structure 114 that is used to provide support to the mattress 110 and springs 108 there may be at least one cross member that may provide a connection to the actuator 104 and safety bracket 122.

In an embodiment, the skeleton structure 114 and the sub-frame 112 may interface with each other; the sub-frame 112 may provide structural support and a rigid foundation base to the skeleton structure 114. In an arrangement of this embodiment, only one frame of the skeleton structure 114 may be attached with the sub-frame 112. For example, the center frame 1002 may be rigidly attached to the sub frame 112 in such a manner that the center frame 1002 may not move with respect to the sub frame 112. The sub-frame 112 may provide a base to solidly connect the center frame 1002 to provide a fixed non-moving section. The other moveable frames such as the head frame 1004 and the foot frame 1008 may be moveably connected to the fixed center frame 1002 and additionally supported by the sub-frame 112 using a moveable interface connection.

In an embodiment, the sub-frame 112 may be the rigid structure that is in contact to the floor and may provide a base for any fixed adjustable bed facility 102 sections and an interface for any movable adjustable bed facility 102 sections. In an embodiment, the sub-frame 112 legs may be connected to the sub-frame 112 using a threaded stud into threads of the sub-frame 112. In an embodiment, to prevent the threaded stud from pulling out of the legs during tightening, the head of the threaded stud may be fixed between two or more layers of leg material. This construction may trap the threaded stud head to prevent it from moving away from the end of the leg and may also prevent the threaded stud head from being pulled through the end of the leg during the tightening of the leg to the sub-frame. In addition, the two or more layers of leg material may provide for added strength to the sub-frame 112 legs to prevent distortion at the sub-frame 112 and leg interface.

In an embodiment, the sub-frame 112 may have structural members that may run along the length of the adjustable bed facility 102, run along the width of the adjustable bed facility 102, run diagonally across the adjustable bed facility 102, or other orientation in relation to the adjustable bed facility 102 that may be required for support or connection to components.

In an embodiment, the skeleton structure 114 may be used as an RF antenna for receiving communication from the remote 148. In embodiment, the entire skeleton structure 114 may be used as an antenna; a portion of the skeleton structure 114 may be used as an antenna, or the like.

In one embodiment, the sub-frame 112 may provide solid connections for any fixed section and skeleton structure 114 by rigidly connecting the skeleton structure 114 directly to the sub-frame 112. In this manner, any fixed section and skeleton structure 114 may be rigidly connected to the sub-frame 112, and through the sub-frame 112, rigidly connected to the floor.

Figure 11:
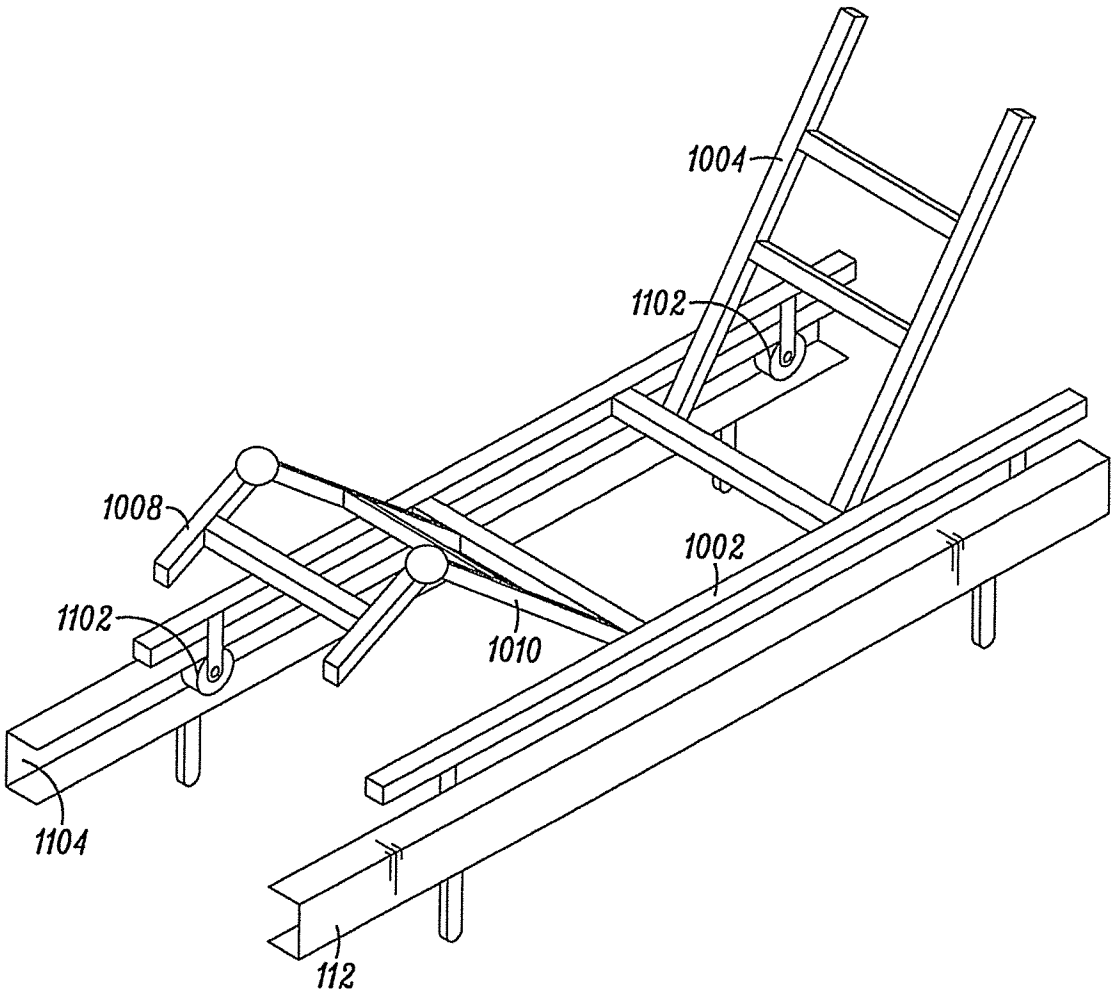
FIG. 11 shows operation of an adjustable bed facility according to an embodiment of the present invention.

In another embodiment, the sub-frame 112 may provide an interface for the fixed adjustable bed facility 102 section and skeleton structure 114 where the fixed section may be able to move or slide in relation to the sub-frame 112. By providing a non-rigid interface connection between the sub-frame 112 and the skeleton structure 114, the fixed adjustable bed facility 102 section may have a freedom of motion but still may be supported by the sub-frame in a solid foundation manner. For example, as shown in FIG. 11, the center frame 1002 may have wheels 1102 that run in a track 1104 and may be able to move horizontally during the motion of one or more of the movable frames. The track 1104 may be in form of a groove, a "C" channel, or the like. Alternatively, the track 1104 may be in the form of a tube and the wheels 1102 may include a concave surface that meets the track 1104, allowing the wheels 110 to run over the track 1104. In embodiments, concave wheels 1102 may wrap partially around the shape of the tubing and ride along it keeping various segments from shifting side to side. The wheel may include a stabilizing member to prevent the wheels from separating from the tubing. The stabilizing member may extend from the wheel along the side of the tubing. The side of the tubing may be the left side, the right side, and the like. The stabilizing member may wrap around the tubing to extend below the tubing to a side of the tubing that is opposite from the wheel. The side of the tubing that is opposite from the wheel may be underneath the tubing. The stabilizing member may extend vertically upward on the opposite side of the wheel. The stabilizing member may be in the shape of an "L", of a "U", and the like. In an embodiment, the horizontal freedom of motion may provide for a "wall hugger" feature where, as the head frame 1004 is adjusted up, the center frame 1002 may move, along with the head frame 1004, horizontally backward and towards an adjacent wall to maintain a fixed distance between the head frame 1004 and the wall, therefore "hugging" the wall. Similarly, when the head frame 1004 is adjusted down, the center frame 1002 may move horizontally forward and away from the wall to maintain the fixed distance. It may be understood by one skilled in the art that the moveable interface between the skeleton structure 114 and sub-frame 112 may be any type of interface, such as a rack and a pinion arrangement that may allow freedom of motion between the sub-frame 112 and skeleton structure 114.

Figure 12:
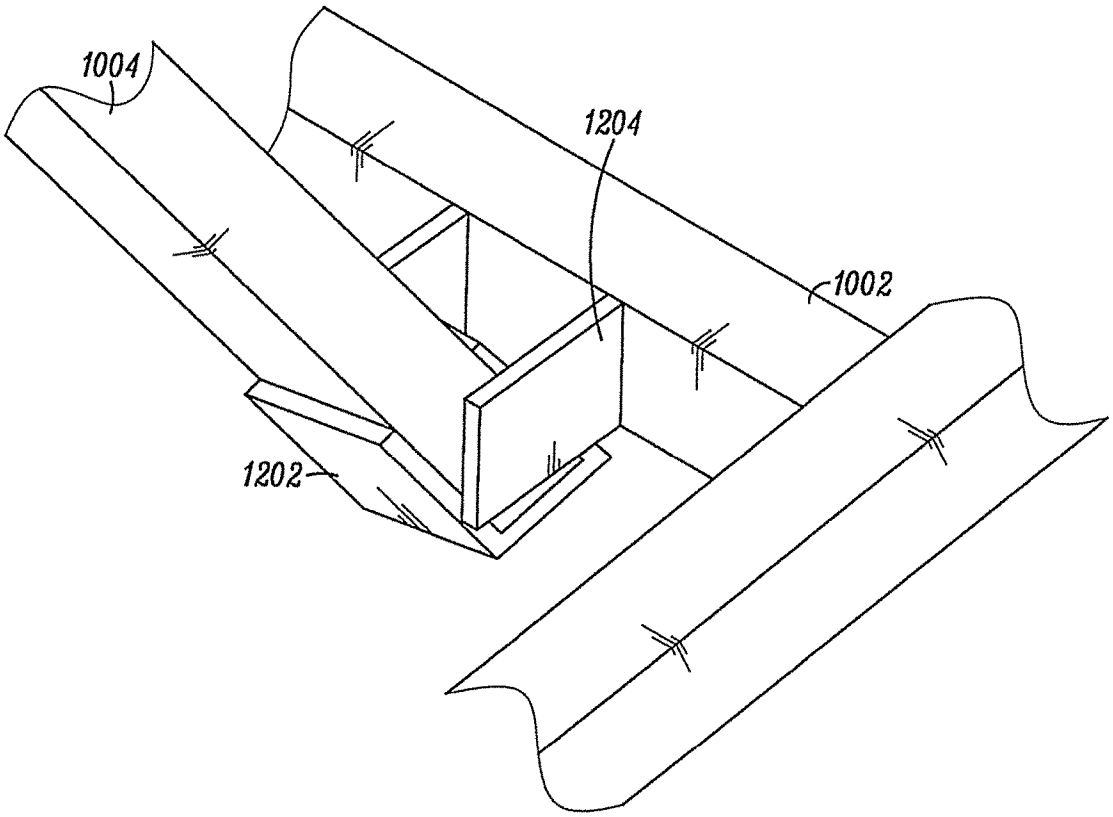
FIG. 12 shows a hinge joint between the frames/sections of an adjustable bed facility.
Figure 13A:
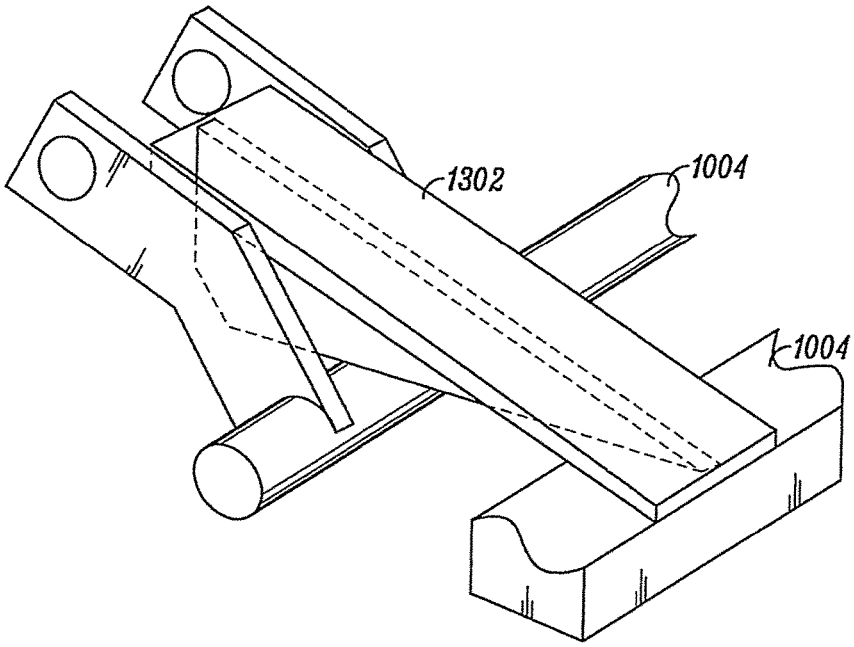
FIG. 13A shows a gusset from an angled view in accordance with an embodiment of the present invention.

In an embodiment, any adjustable section/frame may have two connections, a first connection may be provided by a hinge type connection and a second connection may be the connection with the actuator 104 and safety bracket 122 that may provide the force to rotate the adjustable bed facility 102 section up or down. In an embodiment, the hinge type connection between the skeleton structure 114 of a first section and a second section may provide the point of rotation for the section motion. In an embodiment, the adjustable bed facility 102 may contain more than one section and any or all of the sections may be connected by a hinge type connection. For example, as shown in FIG. 12, the head frame 1004 may be connected to the center frame 1002 by two hinge joints. Here, the parallel side frame members of the head frame 1004 may be pivotally connected to a forward connector frame member 1014 of the center frame 1002. The hinged joints between each of the parallel side frame members of the head frame 1004 and the forward connector frame member 1014 may enable the rotational motion between the center frame 1002 and the head frame 1004. In an arrangement of this embodiment, the hinge joints may be reinforced by providing a "U" shaped end bracket 1202 at the end of the parallel side frame members. The "U" shaped end bracket 1202 may be of any thickness that increases the strength of the hinge joint to prevent bending. The thickness of the "U" shaped end bracket 1202 may be determined by the amount of force and torque that may need to be resisted during the movement With the adjustable bed facility 102 sections interconnected using hinge type connections there may be at least one actuator 104 that may provide a connection between a fixed adjustable bed facility 102 section and a moveable section. In an embodiment, the hinge connection between the adjustable bed facility 102 sections may be a pivot point bracket that may include additional strengthening to resist bending forces. In an embodiment, the actuation 104 connection may be between two of the skeleton structures 114. For example, a first end of the actuator 104 may be connected to a rear connector frame member 1018 of the center frame 1002 and a second end of the actuator 104 may be connected to the frame that is to be moved (e.g. head frame 1004, leg frame 1010, or foot frame 1008). In an arrangement, as shown in FIG. 13A, a downwardly facing extension frame member/a gusset 1302 may be attached to the head frame 1004 or any other frame to be moved. Further, as shown in FIG. 13B, the actuator 104 may be connected to the head frame 1004 to be moved using the downwardly facing extension frame member.

Figure 13B:
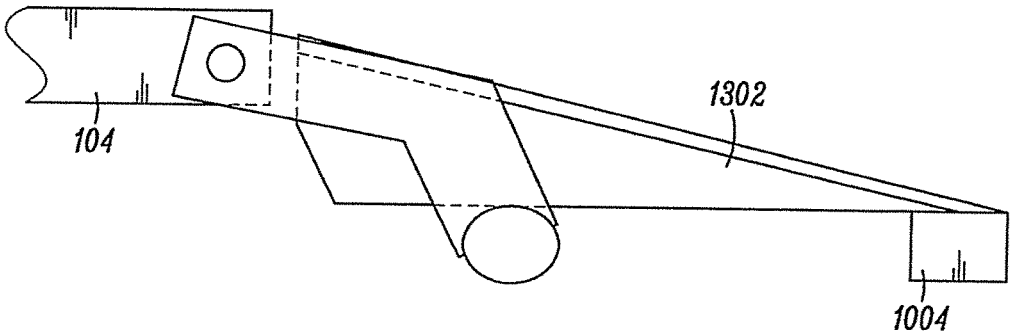
FIG. 13B shows a gusset from a side view in accordance with an embodiment of the present invention.

In an embodiment, as shown in FIG. 13B, there may be the gusset 1302 for connection between the actuator 104 and the adjustable bed facility 102 section/frame. In embodiments, the gusset 1302 may be an I beam, a T beam, an L beam, a box beam, or any other beam design that may provide the strength to lift the combined weight of the adjustable bed facility 102 section and the user without bending. In an embodiment, to resist bending forces at the connections to the actuator 104 and the adjustable bed facility 102 section, the ends of the gusset may be reinforced. In embodiments, the reinforcement may be an additional bracket added to the ends of the gusset, such as a U bracket or other bracket shape, to provide for increased material thickness and strength of the gusset ends. The thickness of the additional bracket may be determined by the amount of force and torque that may need to be resisted during the adjustable bed facility 102 section movement.

In an embodiment, the actuator 104 may use electric motors and mechanical gears, pneumatic pressure, hydraulic pressure, pneumatic spring, air spring, hydraulic spring or the like to provide the force to extend and retract the actuator 104. The action of extending and retracting the actuator 104 may move the various movable bed sections up or down. By the actuator 104 pushing against the section, the section may rotate upward around the pivot point provided by the hinge type connection. In the same manlier, by the actuator 104 pulling against the section, the section may rotate downward around the pivot point provided by the hinge type connection. In an embodiment, there may be at least one actuator 114 for every moveable adjustable bed facility 102 section.

In an embodiment, the combination of actuator 114, safety bracket 122, and supports 120 may provide a safety feature to prevent an object that may be under the adjustable bed facility 102 from being damaged, impinged, crushed, or the like during the decent of the adjustable bed facility 102 section. During the downward motion of one adjustable bed facility 102 sections, the section may come in contact with an object that is under the adjustable bed facility 102. If the actuator 104 is allowed to continue to pull the section in the downward direction, the object may be crushed under the force the actuator 104 may apply. In an embodiment, the safety bracket 122 may have a slot that may provide time to determine that there is an object under the section that is moving downward.

In an embodiment, the slot may have a first side that is on the opposite side of the slot from the actuator 104 and a second side that is on the same side as the actuator 104. In an embodiment, the slot that is between the first side and the second side may be of any length. In an embodiment, the actuator may push against the first side to move the adjustable bed facility 102 section in an upward direction. In an embodiment, during the downward motion of the section, the actuator 104 may move at the same speed as the adjustable bed facility 102 section and therefore the actuator connection to the safety bracket 122 may remain within the safety bracket 122 slot without contacting either the first or second sides of the slot. In an embodiment, the section may move in the downward direction under the weight of the section without the actuator 104 pulling on the second side of the safety bracket 122.

In an embodiment, the adjustable bed facility 102 section downward speed may be further controlled by supports 120 that may provide resistance to the section motion to control the rate of decent. In an embodiment, the support 120 may be a pressurized device using pneumatic pressure, hydraulic pressure, or the like to provide a resistive force to slow the decent of the adjustable bed facility 102 section. In an embodiment, the supports may provide enough resistance to control the rate of decent of the section as the actuator 104 is retracted.

In an embodiment, as the actuator 104 retracts, the adjustable bed facility 102 section, with the aid of the support 120, may descend at the same rate as the as the actuator 104 is retracting. By matching the rates of the actuator 104 retraction and the adjustable bed facility 102 section descending, the actuator 104 connection within the safety bracket 122 slot may remain within the slot area and not contact either the first or second side of the slot. In an embodiment, as the section descends, if an object is encountered, the adjustable bed facility 102 section may stop its decent and the actuator 104 connection will move within the safety bracket 122 slot without pulling the section downward. In an embodiment, the amount of time that the actuator 104 connection is moving within the safety bracket 122 slot while the adjustable bed facility 102 section is stopped may provide time to the user to realize that an object has been contacted and to stop the downward motion of the section.

In an embodiment, an additional safety feature may be the addition of a shut off sensor, shut off switch, or the like on the first side of the safety bracket 122 slot to stop the retraction of the actuator 104 if the actuator 104 connection comes in contact with the first side of the slot. In this manner, if the actuator 104 connection with the safety bracket 122 slot reaches the first side of the slot, the actuator 104 retraction may be stopped and the adjustable bed facility 102 section will not be forcibly pulled down into the object that may be under the section. In an embodiment, there may be an indication to the user that the actuator 104 connection has come in contact with the first side of the slot and the adjustable bed facility 102 sections downward motion has been stopped. In an embodiment, the indication may be an audio indication, a visual indication, a motion indication (e.g. vibration), or the like to indicate to the user that the motion has been stopped and there may be an obstruction with the adjustable bed facility 102 section.

In an embodiment, there may be at least one vibration motor 118 that may provide vibration and massage functions to the adjustable bed facility 102 sections and mattresses 110. In an embodiment, there may be vibration motors 118 associated with any of the adjustable bed facility 102 sections. In an embodiment there may be more than one vibration motor 118 for each adjustable bed facility 102 section that may have vibration motors 118. In an embodiment, using the remote 148, the user may be able to control the vibration mode of the various vibration motors 118; the mode may include the vibration setting for a particular bed section, the vibration frequency of at least one of the vibration motors, stopping the vibration of at least one of the vibration motors, or the like. In an embodiment, the vibration motors 118 may be operated independently or in combination. In an embodiment, the user may select a vibration mode on the remote 148 and the control box 134 may use a software application to control the various vibration motors 118 to the user's request.

Figure 5A:
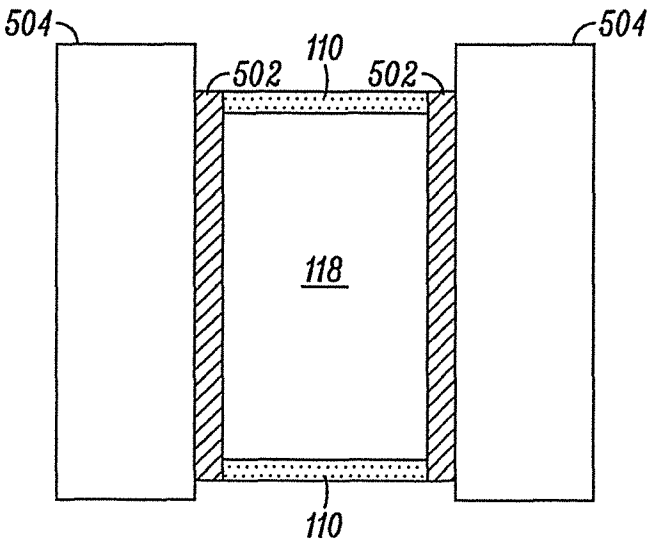
FIG. 5A shows a top view of a vibration motor within an opening of an adjustable bed facility section lateral surface.
Figure 5B:
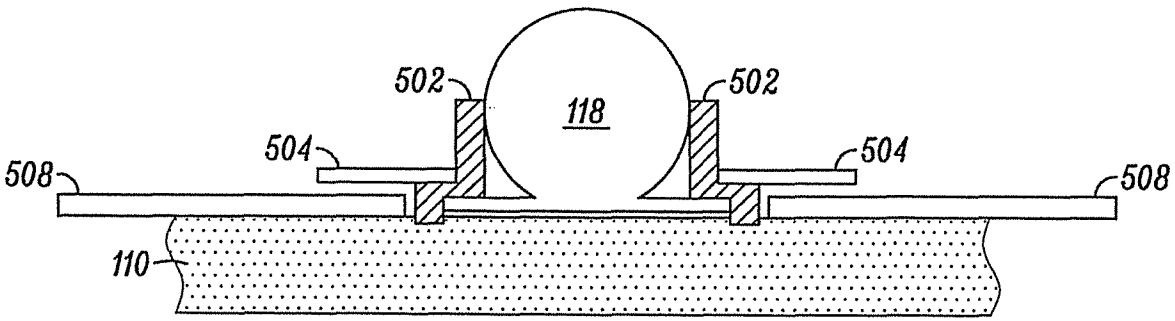
FIG. 5B shows a side view of a vibration motor within an opening of an adjustable bed facility lateral surface.

In an embodiment, the vibration motor 118 may be an electric/mechanical device, a pneumatic device, a hydraulic device, or the like. The mechanical device may use an electric motor to rotate an offset mass to create a vibration; the vibration motor may be controlled for vibration frequency and amplitude by the speed of rotation of the electric motor. Referring to FIG. 5A and FIG. 5B, an embodiment of a vibration motor 118 is shown within an opening of a adjustable bed facility 102 support lateral surface 508. The adjustable bed facility 102 section may have a lateral surface 508 and the lateral surface 508 may include an opening in which the vibration motor 118 may be located; the vibration motor 118 may fit within the opening such that the vibration motor 118 may not contact the lateral surface 508.

In an embodiment, the vibration motor 118 may be secured to the adjustable bed facility 102 section using at least one bracket 504. In an embodiment, when more than one bracket 504 is used, at least one of the brackets 504 may be separable and removable. In an embodiment, the at least one bracket 504 may be shaped to secure the vibration motor 118 within the section opening such as a straight bracket, a U shaped bracket, an L shaped bracket, or the like; in FIG. 5A and FIG. 5B the bracket 504 is shown as a straight bracket 504. In an embodiment, the removal of one of the brackets 504 may facilitate securing the vibration motor 118 to the bed section, facilitating the servicing of the vibration motor 118, or the like. The bracket 504 may be positioned such that at least one portion of the bracket 504 is within the opening of the lateral surface 508 and may also be positioned such that the bracket 504 may overlap the vibration motor 118 flange. The bracket 504 may provide support to the vibration motor 118 flange along a majority of the perimeter of the mattress support opening. The bracket 504 may be coupled to the mattress support 508 using a removable coupling. Removing the bracket 504 may facilitate removing and servicing the vibration motor 118. The vibration motor 118 flange may extend beyond the perimeter of the opening of the mattress support 508 and the resilient material 502 may provide positional support for the motor so that the flange may impart vibration to the mattress without contacting the mattress support. The resilient material 502 may provide mechanical insulation between the flange and the perimeter of the opening in the mattress support 508. The resilient material 502 disposed between the flange and the lateral support 508 surface of the bracket 504 may further provide positional support for the vibration motor 118 housing.

The bracket 504 may be constructed using material such as plastic, metal, or the like, and may be constructed using the materials individually or in combination. In an embodiment, there may be a resilient material 502 associated with the brackets 504, the resilient material may provide for dampening the vibration between the vibration motor 118 and the adjustable bed facility 102, may contact the vibration motor 118 to secure the vibration motor 118 to the bed section, may provide for dampening of vibration to the adjustable bed facility 102 and hold the vibration motor 118 in place, or the like. The resilient material 502 may include latex foam, polyurethane foam, polypropylene foam, polyethylene foam, or the like and may be used individually or in combination.

In an embodiment, either of the pneumatic or hydraulic devices may act as a vibration motor 118 increasing and decreasing the pressure within a cylinder, bladder, or the like at certain frequencies to provide the vibration required by the user. In an embodiment, a device to provide the pressure frequency may be part of the vibration motor 118, a separate device from the vibration motor 118, or the like.

In an embodiment, the vibration facility 118 may be connected to the skeleton structure 114, the mattress 110, the lateral surface 508, or the like where the vibration may be imparted into the adjustable bed facility 102 mattress 110 as desired by the user. In an embodiment, the vibration motor 118 flange may provide surface area that may impart a vibration into the mattress 110. In another embodiment, the vibration motor 118 may be in proximity to a vibration distribution facility (not shown) that may aid in the propagation of vibration energy to the adjustable bed facility 102 section. In an embodiment, the vibration motor 118 may be operatively connected to the vibration distribution facility, may be in contact with the vibration distribution facility, may not be in contact with the vibration distribution facility, or the like. The vibration distribution facility may be constructed using materials such as plastic, rubber, metal, or the like and may be constructed using these materials individually or in combination. In an embodiment, the vibration distribution facility may provide for a more uniform distribution of the vibration characteristics of the vibration motor 118 and may have a size and shape relative to the size and shape of the adjustable bed facility 102 section.

Referring again to FIG. 1, in an embodiment, the adjustable bed facility 102 may have an electronic facility 124 that may contain components that provide control of the physical aspects of the adjustable bed facility 102 (e.g. actuator, vibration motors), interface with the remote 148, interface with networks, interface with bed memory 154, control electronic devices of the adjustable bed facility 102, and the like.

In an embodiment, the control box 134 may coordinate the electronic requirements of the electronic facility 124. In an embodiment, the control box 134 may interface with the receiver 130, remote 148, air purification facility 144, power outlets, power connection 142, power supply 140, modular controls 132, wire harness 128, and the like. In an embodiment, the control box 134, receiver 130, and power supply 140 may be mounted directly to the skeleton structure 114. The control box 134, receiver 130 and the power supply 140 may be mounted on the center frame 1002.

Figure 14:
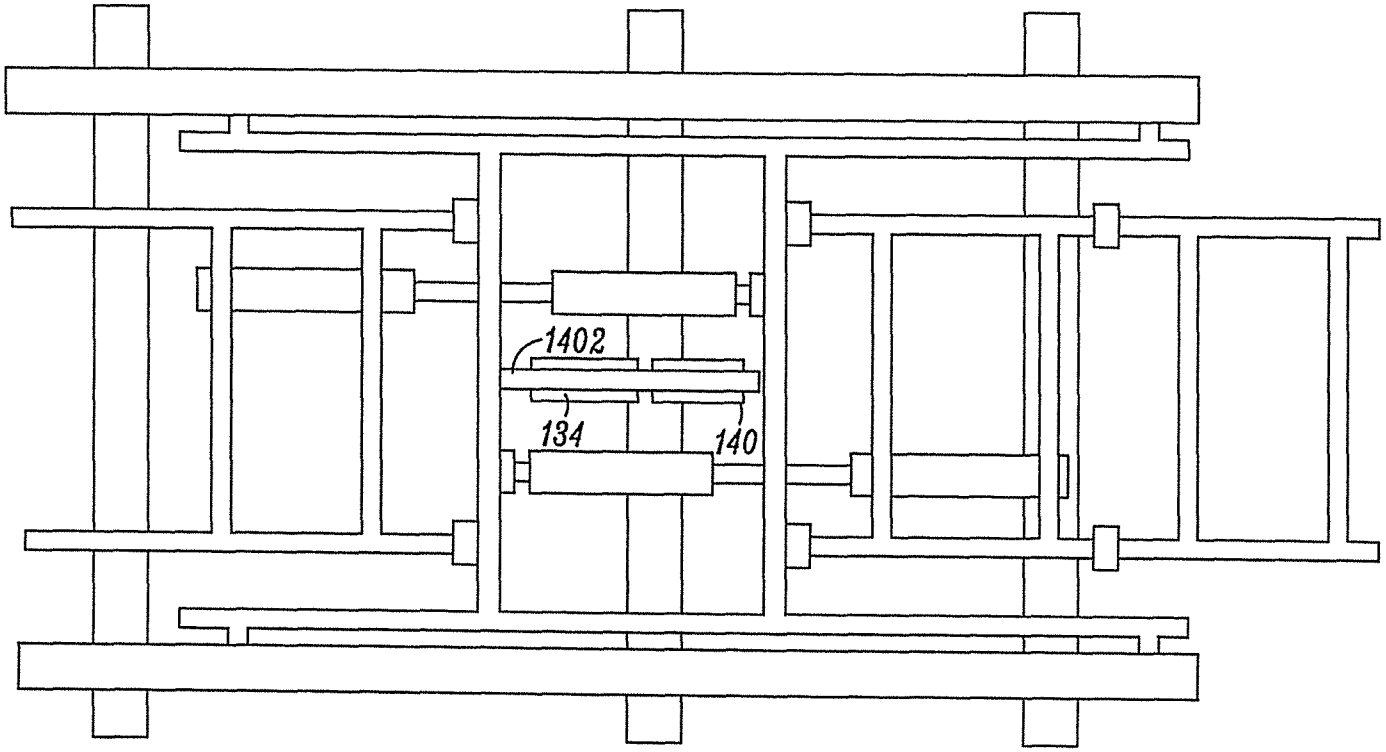
FIG. 14 shows mounting of a control box, a receiver, and a power supply on an adjustable bed facility according to an embodiment of the present invention.

Referring now to FIG. 14, in order to provide a proper mounting space to the control box 134, the receiver 130, and the power supply 140, an additional frame member 1402 may be added. The additional frame member 1402 may be made of a tubular construction. The additional frame member 1402 is designed in such a manner that it can bear the load of the components mounted on it.

In another embodiment, the control box 134, the receiver 130, and the power supply 140 may be mounted on any other frame member of the center frame 1002.

In an embodiment, the control box 134 may receive its command request from the user requesting adjustable bed facility 102 functions using the remote 148. In an embodiment, the remote may communicate to the receiver 130 and the receiver may transmit the received user command request to the control box 134. In an embodiment, the receiver 130 and control box 134 may be individual devices or a combined device.

In an embodiment, the remote 148 and receiver 130 may have wired or wireless communication. In an embodiment, the wireless communication may be by radio frequency (RF), infrared (IR), Bluetooth, or the like. In an embodiment, the receiver 130 may receive the user commands from the remote 130 and transmit the same command to the control box 134; the receiver may not provide any interpretation of the remote 148 commands. In an embodiment, the remote 148 and receiver 130 may be communication matched by the use of a code key. The code key may be any indicator that may be interpreted by the remote 148 and receiver 130 that commands may be received and executed between the remote 148 and receiver 130. In embodiments, the code key may be a number, a word, a serial number, a bed identification, a remote identification, a user identification, or any other identification known to both the remote 148 and receiver 130, all an indication that communications should be received. The code key may be transmitted as the beginning of the communication, the end of the communication, as part of the communication or the like.

In an embodiment, the skeleton structure 114 may be used as an RF antenna for receiving communication from the remote 148 to the receiver 130. In embodiment, the entire skeleton structure 114 may be used as an antenna; a portion of the skeleton structure 114 may be used as an antenna, or the like.

In an embodiment, the control box 134 may also control the functions of the adjustable bed facility 102 using a wireless technology in place of or in coordination with, the wire harness 128. In an embodiment, the wireless technology may include Bluetooth, ultra-wideband (UWB), wireless USB (WUSB), IEEE 802.11, cellular, or the like. The various controlled functions (e.g. actuators 104 or external devices) may be able to communicate using the wireless technology, may use an intermediate wireless receiver, or the like to communicate with the control box 134.

In an embodiment, the control box 134 wireless communication may use a wireless network protocol that may include peer-to-peer communication, master/slave communication, as a hub, as a server, or the like. In an embodiment, the wireless communication may be used to control more than one adjustable bed facility. For example, the user may be able to control his/her adjustable bed facility and may additionally be able to control another adjustable bed that may be within the range of the communication method.

In an embodiment, the cellular communication may utilize a cell phone, a smart phone, or the like to provide the communication method with the control box 134, modular controls 132, or the like. In an embodiment, the control box 134 may be controlled by a programmable control circuit (PLC). In an embodiment, the user may use a menu on the cell phone for adjustable bed functions that may be controlled by the cell phone. For example, the cell phone technology may be able to control the bed position and vibration characteristics of the adjustable bed facility 102 and therefore the cell phone menu may present the user with options for controlling the bed position and vibration.

In an embodiment, if the communication between the remote 148 and receiver 130 is wireless, the receiver learn facility 152 may be used to establish the communication between them. In an embodiment, a learn protocol between the remote 148 and receiver 130 may be user initiated by pressing a button on the receiver learn facility 152, powering up the receiver learn facility 152, bringing the receiver learn facility 152 within a certain proximity of the receiver 130, indicating on the remote 152 to begin the learn protocol, or the like. In an embodiment, the learn protocol may be fully automatic, semi-automatic with user intervention, manual, or the like. In an embodiment, a user may select a channel, frequency, or the like during learn protocol or after the learn protocol. The changing of the channel, frequency, or the like may prevent two different remote 148 and receiver 130 combinations from interfering with other wireless communication devices. In an embodiment, each time the learn protocol is executed, a new unique communication link may be established; there may be a plurality of unique communication links available for each remote 148 and receiver 130 combination.

In an embodiment, the remote 148 may be a user controlled device to provide control commands to the control box 134 to command certain functions of the adjustable bed facility 102. In an embodiment, the certain functions may be adjustable bed facility section movement (e.g. up or down), vibration control, modular controlled 132 devices, or the like. In an embodiment, the remote 148 may communicate with the control box using wired communication, wireless communication, or the like. In an embodiment, the wireless communication may use a radio frequency (RF), infrared (IR), Bluetooth, or the like. If the remote communicates using a wireless technology, the communication may be with the receiver 130 and the receiver 130 may pass the command request to the control box 134.

Figure 3:
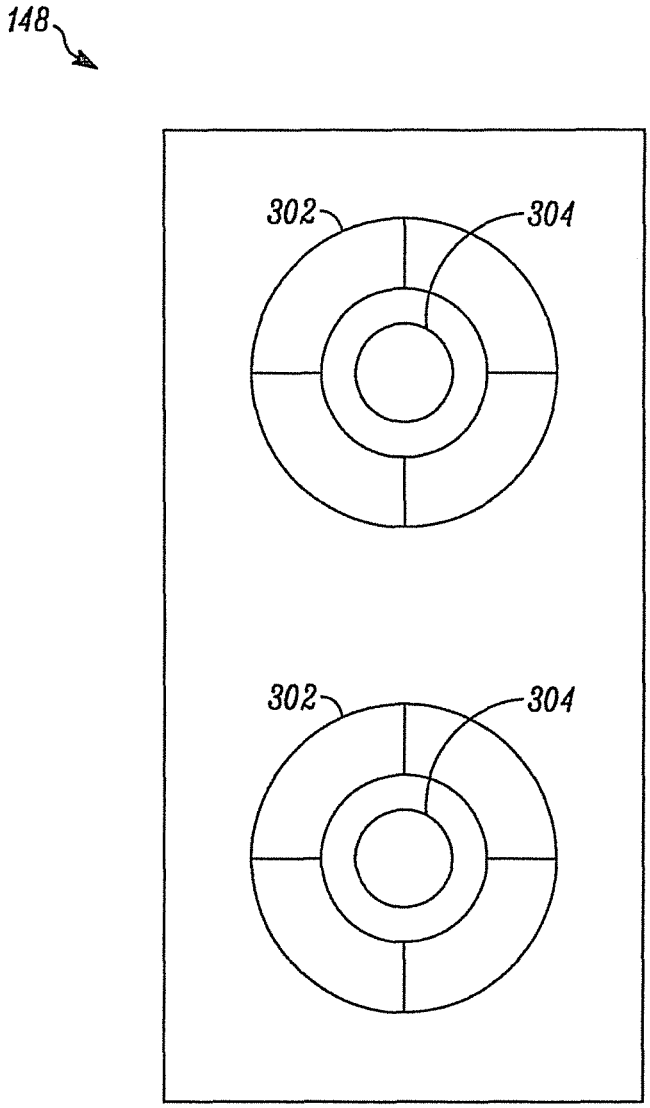
FIG. 3 shows an embodiment of a remote control used to command the adjustable bed facility.

In an embodiment, the inputs of the remote control 148 may be organized into groups of common function control; the remote control 148 groups may be arranged in a circular orientation. As shown in FIG. 3, the remote control 148 may include more than one group 302 and may include at least one positioning control group and one vibration control group. In one embodiment, the remote control 148 groups 302 may be organized into a circular pattern where the circular pattern may provide for inputs that control increasing a function, decreasing a function, storing a function, global command functions 304, or the like. For example, a circular group 302 may be divided up into a number of segments to control certain functions of the adjustable bed facility 102. FIG. 3 shows four sections for each of the circular groups 302, but it should be understood that there may be any number of sections to provide the required adjustable bed facility 102 control.

In one example, one of the circular groups 302 may be used to control movements of the adjustable bed facility 102 sections. The movement circular group 302 may have inputs for moving the head section up/down, moving the foot section up/down, inputs for storing a user preferred positions to the PLC, or the like. Additionally, there may be a global command input 304 that may provide for commanding more than one adjustable bed facility 102 function using a single input such as commanding the adjustable bed facility 102 to go to a flat position. For example, the user may be able to select the flat button and the adjustable bed facility 102 may move all of the adjustable sections to the flat position.

A vibration circular group 302 may have inputs for controlling the vibration of the head section up/down, controlling the foot section vibration up/down, inputs for storing a user preferred vibration characteristics to the PLC, or the like. Additionally, there may be a global command input 304 that may provide for commanding more than one adjustable bed facility 102 vibration characteristic using a single input such as commanding the adjustable bed facility 102 to stop all vibration. For example, the user may be able to select the stop vibration input and the adjustable bed facility 102 may stop all of the adjustable sections from vibrating. In an embodiment, the user may select the all stop global 304 input to stop the adjustable bed facility 102 vibration before selecting a different vibration characteristic for one of the adjustable bed facility 102 sections.

In an embodiment, the user may be able to determine the control functions that the global command 304 may control. For example, the user may be able to input a command sequence to indicate the global command that should be applied to the global command 304 input. In an embodiment, the global command may be stored in the adjustable bed facility 102 memory 154 for later recall. In an embodiment, after the global command 304 has been stored, the user may select the global command 304 input for the command sequence execution.

The function of the remote 148 has been described with controlling adjustable bed facility 102 movement and vibration, but it should be understood that the remote may have control inputs for any function of the adjustable bed facility 102. Additionally, the control inputs have been described as having a circular pattern, but it should be understood that other embodiments of the control input organization may be used for controlling the function of the adjustable bed facility 102.

The remote 148 may include a timer that has a user defined setting that may allow the user to determine when the remote 148 communicates a control command to the adjustable bed facility. For example, the user may be able to set a timer on the remote 148 to indicate a time when the adjustable bed facility 102 is to go to a flat position. The user may use this function in the evening where the user may want to read for a half hour and then go to sleep, the user could set the timer for a half hour and the adjustable bed facility 102 may go to the flat position after the half hour. In another embodiment, the timer may be a clock where the user may be able to set a time when the adjustable bed facility 102 is to complete a certain function. In an embodiment, the user may be able to indicate the command that the remote 148 is to transmit to the adjustable bed facility 102 when the timer or clock setting indication has been reached.

In an embodiment, the remote 148 may be able to directly control the settings of external power outlets associated with the adjustable bed facility 148. The power outlet may be an RF controlled power outlet and the remote 148 may be able to transmit an RF command directly to the RF power outlet. In an embodiment, the power outlet may include settings of at least on, off, a percentage of power, or the like. The power outlet control power setting may be controlled by a hardware setting, a software setting, or the like. The power outlet may be an AC powered power outlet or a DC powered power outlet.

The remote 148 may include a timer that has a user defined setting that may allow the user to determine when the remote 148 communicates a control command to the RF power outlet. For example, the user may be able to set a timer on the remote 148 to indicate a time when the RF power outlet is to turn on or off. For example, the user may use this function in the evening where the user may want to read for a half hour and then go to sleep, the user could set the timer for a half hour to turn off a power outlet that controls a light fixture, after the half hour the remote 148 may command the RF power outlet to turn off and therefore turn the light fixture off. In another embodiment, the timer may be a clock where the user may be able to set a time when the RF power outlet may turn on or off. In an embodiment, the user may be able to indicate the command, such as on or off, that the remote 148 is to transmit to the RF power outlet when the timer or clock setting indication has been reached.

In an embodiment, the user may indicate adjustable bed facility 102 functions using the remote 148 by pressing a button, touching a screen, entering a code, speaking a command, or the like. In an embodiment, the control box 134, using the receiver 130, may receive and interpret the command provided by the remote 148. The remote may control devices with commands that may include on, off, high power, medium power, low power, volume, play, fast forward, rewind, skip, modular device to control, or the like. For example, the remote 148 may transmit a command to move the head section up and the control box 134 may command the actuator 104 to extend a certain amount in response to the command. In another example, the remote 148 may command that a modular control 132 connected lamp be turned off. The control box 134 may command the modular control 132 to turn off the lamp.

Referring again to FIG. 1, in an embodiment, the electronic facility 124 may use the bed memory 154 to store adjustable bed facility 102 settings, application software, demonstration software, and the like. In an embodiment, the user may determine that certain adjustable bed locations are preferred and should be saved for future recall. The control box 134 may save the user preferred settings in the bed memory 154 in order to recall the preferred settings at the use request. In an embodiment, the control box 134 may also store non-user requested information to the bed memory 154 as needed for the control of the various adjustable bed facility 102 components. For example, when the user requests an adjustable bed facility 102 section to move, the control box 134 may store the last position into bed memory 154 to be used as a last position recall, an undo command, the last settings for all the adjustable bed facility 102 component at shutdown, or the like.

In an embodiment, the control box 134 application software may be stored in the bed memory 154. In an embodiment, the software may be downloaded to the control box 134, may be run from the bed memory 154, or the like. In an embodiment, the application software may be an interrupt type application, a polling type application, or the like for sensing what command the user may have indicated on the remote 148. For example, in an interrupt application, each command requested by the remote 148 may send an interrupt code to the control box 134. The control box 134 may then request from the application software the command sequence that is associated with the received interrupt. In another example, the polling application may continually poll the remote 148 for requested user commands and when a user command is detected, then request the command sequences for the requested user command.

In another embodiment, the control box 134 may use programmable logic circuits (PLC) to store application programs for control of the adjustable bed facility components. In an embodiment, the PLC may be part of the control box 134, part of a bed memory 154, in a separate control box, or the like. In an embodiment, the PLC may include a microcomputer, a microprocessor, volatile memory, non-volatile memory, IO connection to components, or the like. The PLC may provide an interface to permit software application updates to the PLC memory; PLC memory may be over written. In an embodiment, this may provide a method and system for providing software application upgrades to the adjustable bed facility 102.

In an embodiment, the PLC may have a connection to an external interface that may allow updates to be downloaded to the PLC. The connection may be a serial connection, a USB connection, a USB device, a parallel connection, a wireless connection, a bed memory 154, or the like. The capability to download information to the PLC may allow for software updates to the PLC, may allow for remote 148 interface updates to the PLC, may allow memory updates to the PLC, or the like. For example, if the user was supplied with a new or upgraded remote 148, the user may also be supplied with updated software for the PLC. The user may be able to connect the device containing the new software to the external interface and download the new software to the PLC.

In an embodiment, the PLC may have a connection interface with the modular controls 132 to provide the user with control over other devices that may be connected to the adjustable bed facility 102. The PLC may receive commands from the remote 148 for the modular controls 132 and may pass the command through to the modular control 132, may interpret the remote 148 command and command the modular control 132, or the like.

In an embodiment, the PLC may interface with a modular control 132 that is associated with external power outlets. In this embodiment, the user may be able to control the setting of the external power outlet by selecting a setting on the remote 148. The setting on the remote 148 may be received by the receiver 130 and PLC within the control box 134 to set the power outlet setting. For example, the user may be able to turn on the external power outlet by selecting an external outlet on input on the remote. This may result in the external outlet power being turned on to power an attached device such as a lamp.

In an embodiment, the bed memory 154 may be part of the PLC, external from the PLC, a combination of internal and external memory from the PLC, or the like.

In an embodiment, the bed memory 154 may be separate from the control box 134 and the PLC. In an embodiment, the bed memory 154 may be removable memory, the bed memory 154 may be moved from a first adjustable bed facility 102 to a second bed facility 102 to move user settings from the first adjustable bed facility 102 to the second bed facility 102. For example, a user in a care facility may be moved from a first adjustable bed facility 102 to a second adjustable bed facility 102 but the user may have already determined and saved at least one preferred setting to the bed memory 154. The bed memory may be removed from the first adjustable bed facility 102 and moved to the second adjustable bed facility 102 with the user and therefore the user may keep the same preferred adjustable bed 102 settings.

In this manner the bed memory 154 may be considered portable memory. In an embodiment, the removable bed memory 154 may be flash memory, programmable logic circuit (PLC), secure digital (SD) memory, mini SD memory, Compact Flash type I memory, Compact Flash type H memory, Memory Stick, Multimedia Card, xD Picture card, Smartmedia, eXtreme Digital, Microdrive, or the like.

In an embodiment, the bed memory 154 may be part of the remote 148. As part of the communication between the remote 148, receiver 130, and control box 134 memory information may be exchanged between the remote 148 and control box 134. For example, the user may indicate that a certain adjustable bed facility 102 position should be maintained for future recall. The control box 134 may receive the save position request from the remote 148 and transmit the position information back to the remote 148 for storage within the bed storage 154. In a like manner, when the user requests the recall of a previously saved position, the control box 134 may request the position information from the remote 148 bed memory 154.

In an embodiment, if the remote 148 is wireless, the remote 148 may contain both a transmitter and receiver, or a transceiver, to transmit and receive information with the control box 134. In an embodiment, the remote 148 may communicate with the receiver 130 using a connection key. The connection key may be a code that indicates that a certain remote is associated with a certain adjustable bed facility 102. When the remote 148 transmits information to the receiver, the remote may first send a key code to indicate that the remote 148 is associated with the adjustable bed facility 102. If the key code matches the key that the receiver 130 is listening for, the receiver 130 may receive the command from the remote.

Figure 2:
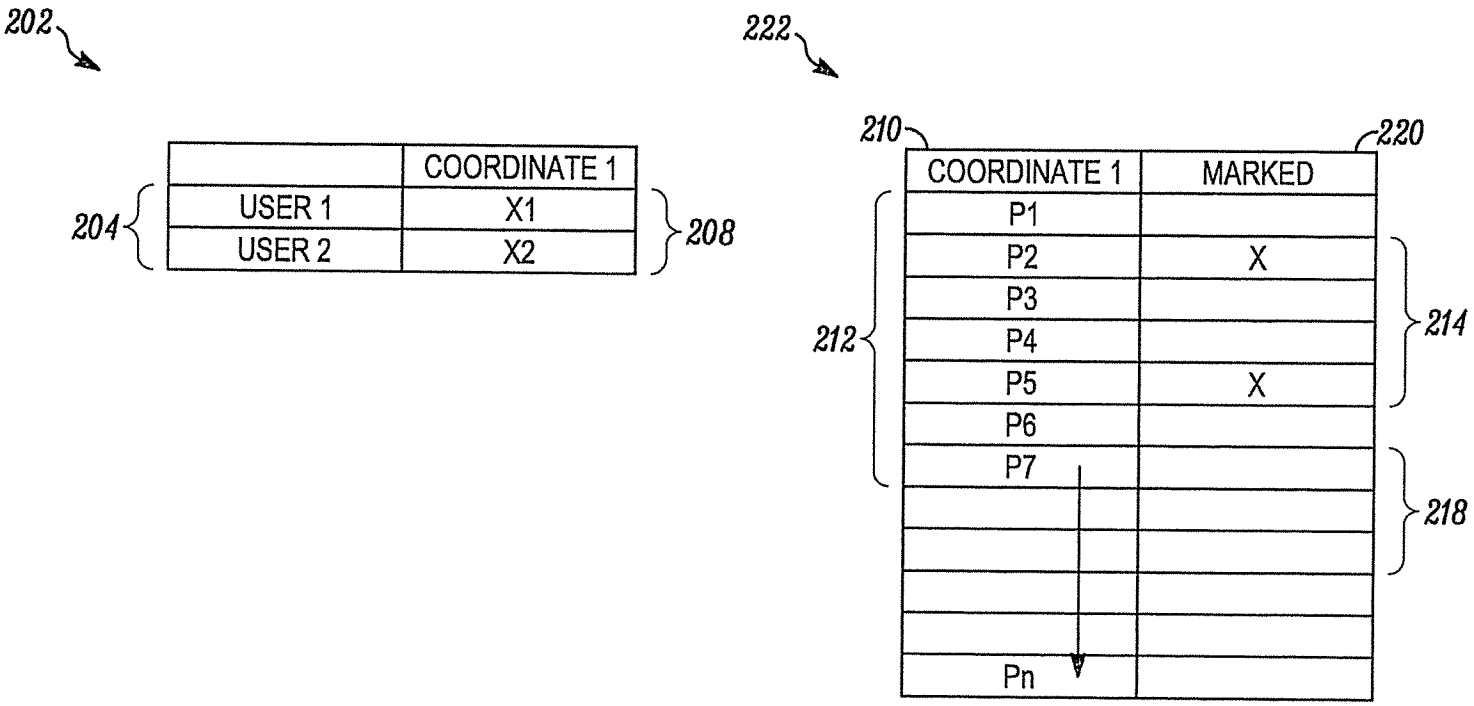
FIG. 2 shows an embodiment of two methods of maintaining user memory for storing user preferred adjustable bed positions.

In an embodiment, the bed memory 154 may maintain the position information for the user preferred positions of the adjustable bed facility 102 sections. In an embodiment, the bed memory 154 may be implemented as a programmable logic circuit (PLC), a logic circuit (LC), or the like. FIG. 2 shows an embodiment of two methods of maintaining the user preferred positions in memory. In an embodiment, a first method may be to have discreet memory table 202 for each preferred user bed position 204. There may be the same number of preferred bed positions 204 and memory locations 208 as indicators on the user remote 148. For example, the remote may have two buttons for the user to set the preferred positions that may be used for later recall; the two buttons may be associated with two discreet memory locations 208. In an embodiment, each time the user indicates a new preferred position for a button on the remote 148 the memory location 208 may be over written with the new position information. In an embodiment, this method may only allow the user to set one user preferred position for every button on the remote 148.

In an embodiment, a second method of memory storage for user preferred adjustable bed positions may be a table 222 that may have a plurality of possible positions 212 the user may select. In an embodiment, as shown, the possible positions 212 may be P1 through Pn. In an embodiment, the possible positions 212 may be a plurality of values that may define the range of available positions for the adjustable bed facility 12; the plurality of values may be a set of values that define the range of available positions for one or more adjustable bed facility 102 functions. For example, the available positions 212 may be a set of increments of section positions that may include a set of actuator 104 positions, a set of actuator 104 activation times, bed section rotation angles, or the like. The set of increments may be determined from a base value for the section. For example, the increments may start at zero from the flat position for the adjustable bed facility 102 section. In an embodiment, the user may be able to select the increment set to be used as possible positions 212 for the section. For example, the user may be able to select the type of graduations by selecting from a set of possible graduation methods such as distance, angle of rotation, actuation time, or the like.

In FIG. 2, the table 222 is shown with an increment column 210 and an indication column 220. In an embodiment, the table 222 may have a plurality of columns 220 to store position information for any of the adjustable aspects of the adjustable bed facility 102. For example, there may be an indication column 220 for the head section angle, the foot angle section, the vibration characteristics for the various vibration motors of the adjustable bed facility 102, or the like. In another embodiment, the adjustable aspects of the adjustable bed facility 102 may be represented by a plurality of individual tables 210 for storing indication information for each of the individual adjustable attributes for the adjustable bed facility 102. The individual tables 210 may be substantially the same as the table 222 shown in FIG. 2 where there may be one column 210 for increments 212 and another column 220 for indication information (214 and 218). For example, there may be individual tables 210 for the head section angle, foot section angle, vibration motor characteristics, or the like. In an embodiment, the PLC may be able to access the adjustable bed facility 102 settings by accessing large tables 210 that contain many columns, small tables 210 that contain a few columns, a combination of large and small tables 210, or the like.

In an embodiment, the PLC may store the tables 210 within the PLC memory for accessing the settings of the adjustable bed facility 102. In another embodiment, the table 222 may be stored in memory outside of the PLC and the PLC may access the table 222 through an interface connection. The table 222 increment column 210 may represent a plurality of available positions associated with adjustable bed facility functions. In an embodiment, the increment values may be a measurement scale (e.g. inches or angle), may be the number of rotations of the actuator, the vibration frequency of the vibration motor, or other increment scale. In response to a user input, the indication column 220 may be marked with the indication 214 to represent the position intended by the user. When the user makes a request to save a position, the PLC may search the increment column 210 to determine which of the plurality of increments 212 represents the current position value of the adjustable bed facility 102 section. Once the current position value increment 212 within the table 222 is determined, an indication 214 may be stored to the indication column 220 associated to the current position value increment 212. In an embodiment, the indication 214 may be any character that may represent a position being selected such as a letter, a number, special character, or the like. In embodiments, the indication column 220 may include all indications, no indications, one indication, more than one indication, or the like to indicate the user's intended position. The storing of the indication association of the current position value with the user selected position may include adding a store indication to the table 222 entry representing the current position value, removing the current position value from the table 222 of values, removing a plurality of the table 222 values where the removal does not include removing the current position value, adding a store indication to every table 222 entry except a table 222 entry representing the current position value, or the like.

In an embodiment, when a user indicates on the remote 148 that a position is to be saved in the table 222, the PLC may select the increment value 212 from within the increment column 210 set of values that represents the current position of the adjustable bed facility 102. The PLC may store an indication 214 associated with the increment value 212; the stored indication associated with the current position value may be a recall value that may be recalled at a later time to reposition the adjustable bed facility 102.

In an embodiment, in response to the user requesting to return to a recall value, the PLC may scan the table 222 indication column 220 for an indication 214 that may represent the user's recall value. Upon locating the recall value indication 214, the PLC may command the adjustable bed function to the recall value indicated 214 location, position, vibration, or the like.

In an embodiment, the indication column 220 of the table 222 may initially contain indications 214 in all to the available discrete locations 212. As a user indicates that current position value is the position to be stored within the table 222, the indication 214 for the current position value may be removed from the table 222. This may result in one increment location 212 being empty of an indication. In this case, when a user requests to return to the recall position, the PLC may scan the table 222 indication column 220 for the empty increment location 212. Once the empty increment location is found, the PLC may command the adjustable bed function to the recall position, vibration, or other adjustable bed facility 102 function. In an embodiment, if the user stores a different current position value, the empty discrete location 212 may be filled with an indication and the new indication associated to the current position value may have the indication 214 removed. In an embodiment, the user may be able to clear the stored position by indicating a clear command and all of the increment locations 212 may be filled with indications 214.

In an embodiment, the available increment locations 212 in the indication column 220 of the table 222 may initially contain no indications 214 so that the indication column 220 may be empty. As a user indicates that a current position value is the position to be stored within the table 222, the indication 214 associated to the current position value may be added to the table 222. This may result in one increment location 212 having an indication. In this case, when a user requests to return to recall value position, the PLC may scan the table 222 indication column 220 for the increment location 212 containing the indication 214 associated with the recall value. Once the increment location is found, the PLC may command the adjustable bed function to the recall value position, position, vibration, or other adjustable bed facility 102 function. In an embodiment, if the user stores a different position, the increment location 212 indication 214 may be removed and the new current position value may have the indication 214 added. In an embodiment, the user may be able to clear the stored position by indicating a clear command and all of the discrete locations 212 may have the indication 214 removed.

In an embodiment, when a user indicates a current position value is to be indicated in the table 222, the indication may represent the user's preferred adjustable bed facility 102 position. In an embodiment, the user's indicated current position value may be rounded to the closest table 222 increment location 214. For example, if the user selects a current position value that is between two increment positions on the table 222, an algorithm may be used to determine which of the increment positions are to be indicated in the indication column 220.

Embodiments of the present invention involve setting a recall bed position in response to a user making a storage selection. The user's storage selection may send a command to the adjustable bed facility's 102 controller (e.g. the PLC) indicating that the user would like the present position of the adjustable bed facility 102 stored such that the user can later have the adjustable bed facility 102 return to the stored position. The user may use a user interface (e.g. the remote control 148) and make such a storage selection once the adjustable bed facility 102 is in a desired position. As described herein elsewhere, a plurality of position values that define a range of available positions for the adjustable bed facility 102 may be stored in memory accessible by the adjustable bed facility's 102 controller. The available positions may be stored in a table 222 or other structure for example. Once the user initiates such a storage request, the controller may receive the request to save the current adjustable bed facility 102 position as a user selected position. The controller may then make a determination of which of the plurality of position values represent the current position of the adjustable bed facility 102 to provide a current position value. In determining which of the plurality of position values represents the current position, the controller may use an algorithm to decide which of the plurality of values best represents the current adjustable bed facility 102 position. For example, the actual adjustable bed facility 102 position may match one of the values and the algorithm may then select the matching value as the one that best represents the current position. In another situation, the actual adjustable bed facility 102 position may not match any of the plurality of values. In this case an algorithm may be used to determine which value best represents the position of the adjustable bed facility 102. The algorithm may run an averaging calculation, interpolation calculation or other form of prediction algorithm to select between two positions representing positions on either side of the actual adjustable bed facility 102 position, for example. Once the controller has made the determination as to which value represents the current adjustable bed facility 102 position, the controller may then store an association of the current position value with the user-selected position (e.g. as described elsewhere herein).

The embodiment of unmarking 218 preferred positions will be used in the following illustrations, but it should be understood that marking a current position value may also be used as a method of indicating a preferred position 212.

In an embodiment, the user may indicate the current position value by indicating a set position on the remote 148; this indication may result in all of the possible increment locations 212 having an indication 214 except for the one increment the user has selected which may be non-marked 218. For example, if the user selected the P3 position 212 as a preferred position, all of the positions 212 may receive a mark 214 except the one position P3 which may receive a non-mark 218.

In an embodiment, the positioning recall position logic of the adjustable bed may seek possible positions 212 that do not have a mark 218 when determining what user positions to select.

In an embodiment, the user may be able to set more than one increment position 212 in the table 222 for a single button on the remote 148. For example, the user may be able to press a button on the remote 148 in a certain way to set a non-mark 218 at different preferred positions 212. In another example, when the user presses a button on the remote 148, the current position value may be unmarked 218 as a preferred position and an algorithm may be executed to unmark 218 other preferred positions 212 at certain increments from the user selected position. In one example of the algorithm, every 3rd position may be selected to be unmarked 218 as a preferred position 212. The additional non-markings 218 may be by actuation time, section rotation angle, or the like. A person skilled in the art may understand that there may be any number of different methods of unmarking more than one position 212 using a single button on the remote 148.

In an embodiment, with user preferred positions 212 unmarked 218 on the table 222, the user may indicate on the remote 148 to recall the user preferred position 212. In an embodiment, there may be an algorithm to search the table 222 for an unmarked 218 user preferred position 212 to position the bed to the recall value. Once the preferred position 212 is determined, the command logic may command the actuator or actuators to move the adjustable bed sections into the preferred position 212 recall value. In an embodiment, there may be more than one preferred position 212 unmarked 218 on the table 222. In this case, the algorithm may seek the first unmarked 218 position 212 and move the adjustable bed section to that position. In an embodiment, if this is not the user desired position, the user may indicate again on the remote to recall a preferred position and the algorithm may seek the next unmarked 218 position 212. A person skilled in the art may understand that there may be a number of different methods of recalling a plurality of marked 214 or unmarked 218 positions 212 from the table 222.

Referring again to FIG. 1, in an embodiment, the removable bed memory 154 may be used to upgrade the adjustable bed facility 102 memory and software. For example, if new control box 134 software was developed to provide better control over one of the adjustable bed facility 102 components, the software may be saved to a new replaceable memory that may replace the existing replaceable memory. In this manner, the software of the adjustable bed facility 102 could be upgraded just by providing the user with a new replaceable memory.

In an embodiment, the removable memory may be used to provide a sales enterprise with adjustable bed facility 102 demonstration software where the enterprise may be able to indicate at least one of a plurality of demonstrations for a user. For example, the user may be interested in how the adjustable bed facility 102 sections may be adjusted and the enterprise may select a demonstration to shows all the section motion available. In an embodiment, before an adjustable bed facility 102 is shipped to a user, the enterprise may remove the demonstration removable memory and replace it with a standard adjustable bed facility 102 bed memory 154.

In an embodiment, the memory connection 160 may be any connection type that provides a connection between the bed memory 154, control box 134, and the like. In an embodiment, the memory connection 160 may be a wired or wireless connection. The wired connection may be a USB connection, a serial connection, parallel connection, or the like. The wireless connection may be by radio frequency (RF), infrared (IR), Bluetooth, or the like. In an embodiment, the memory connection 160 may be in a location that is easy for the user to access the bed memory 154, may be attached to the memory facility 150, may be attached to the control box 134, or the like. In an embodiment, the easy access memory connection may be on the side of the adjustable bed facility 102, on a rail of the adjustable bed facility 102, under the adjustable bed facility 102, or the like.

In an embodiment, the control box 134 may also access a network using a network connection 162. In an embodiment, the network may be a LAN, WAN, Internet, intranet, peer-to-peer, or other network with computer devices that the control box 134 may communicate with. In an embodiment, the network connection 162 may be a wired or wireless connection.

In an embodiment, using the network connection 162, the control box 134 may be able to communicate with the network to periodically check for application software updates. In an embodiment, if an application software update is located, the control box 134 may send the user an email, instant messenger message, phone message, phone call, cell phone message, cell phone call, fax, pager message, or the like to indicate that software updates are available. The user, using the device that received the notice of software update, may send a reply to the control box that the software upgrade should be downloaded, should not be downloaded, or the like.

In an embodiment, an adjustable bed facility 102 enterprise, an adjustable bed facility 102 manufacturer, an adjustable bed facility 102 service enterprise, or the like may send the control box 134 software updates using the network connection 162. In an embodiment, an adjustable bed facility 102 enterprise, an adjustable bed facility 102 manufacturer, an adjustable bed facility 102 service enterprise, or the like may notify the user of available software upgrades for the adjustable bed facility 102 by email, instant messenger message, phone message, phone call, cell phone message, cell phone call, fax, pager message, or the like. The user, using the device that received the notice of software upgrade, may send a reply to the adjustable bed facility 102 enterprise, the adjustable bed facility 102 manufacturer, the adjustable bed facility 102 service enterprise, or the like that the software upgrade should be downloaded, should not be downloaded, or the like.

In an embodiment, the user may access the network connection 162 with the user's own computer device.

In an embodiment, the remote 148 and control box 134 may be able to control other devices that may be connected to modular controls 132. In an embodiment, the modular controls 132 may be similar to the control box by interpreting commands to control a device, but may be unique to the device that is connected to it. In an embodiment, the modular controls 132 may control audio equipment, video equipment, lamps, air purification facilities, outlets, and the like. For example, the modular control 132 may be connected to audio equipment and may contain the command sequences to control the audio equipment based on commands that may be received from the remote 148. It may be obvious to someone in the art that any of the devices that are connected to modular controls 132 may be controlled in the same manner.

In an embodiment, the user may indicate a function to be accessed for a certain device connected to a modular control 132, the control box 134 may receive the request from the remote 148 and pass the command onto the appropriate modular control 132. In an embodiment, the remote 148 may have modular control 132 device functions that the user may select to control a modular control 132 device. For example, the remote 148 may have functions such as play, fast-forward, rewind, skip, pause, and the like for an audio device connected to the modular control 132.

In an embodiment, the modular controls 132 may be connected to the control box 134 and power supply 140 using a wire harness 128. The wire harness 128 may contain power and data connections for all of the possible connection locations for the modular controls 132. For example, if there are six locations on the adjustable bed facility 102 for attaching modular controls 132, the wire harness 128 may have six sets of power and data connections available.

In another embodiment, the wire harness may provide only power to the modular controls 132 and the communication between the modular controls 132 and control box 134 may be wireless that may include radio frequency (RF), infrared (IR), Bluetooth, and the like.

In an embodiment, using the remote 148, the control box 134 may be able to control power outlets 138 to which external devices may be connected; the power outlets may be associated with the adjustable bed facility 102, remote from the adjustable bed facility 102, or the like. In an embodiment, the control box may communicate with the power outlet using wired or wireless communications. In this embodiment, the power outlets 138 may receive power directly from a household outlet, fuse box, circuit box, or the like but the function of the power outlets 138 (e.g. on or off) may be controlled by the control box 134. For example, an external lamp may be connected to the power outlets 138, there may be a selectable control on the remote 148 for the user to turn the power outlet 138 on and off and therefore to turn the lamp on and off. In an embodiment, the power outlets 138 may include a control circuit that is able to control if the power outlet 138 receives power from the household current. In an embodiment, there may be more than one power outlet controlled by the control box 134 and there may be a selection for each of the power outlets 138 on the remote 148.

In an embodiment, the power outlets 138 may be directly controlled by the remote control 148 using radio frequency (RF). The remote control and power outlets may be RF capable for communication within the adjustable bed facility 102. The remote control 148 may be able to directly control the power outlets 138 to turn the power outlets on and off using RF without interfacing with the control box 134.

In an embodiment, the control box 134 may be able to control an external air purification 144 facility; the air purification 144 facility may be directly controlled by the control box using a wired or wireless connection. In an embodiment, the wireless connection may be radio frequency (RF), infrared (IR), Bluetooth, or the like. In an embodiment, the air purification facility 144 may be any type of device or facility that may be capable of improving that air environment in the area of the adjustable bed facility 102. In an embodiment, the air purification facility 144 may be an absorbent type (e.g. carbon), electro-static, HEPA filter, or the like. In an embodiment, absorbent materials may be used in a filter, in the adjustable bed facility 102, in the mattress 110, or the like to absorbed odor, dust, contaminants, or the like from the air environment around the bed, within the bed, or the like. In an embodiment, electro-static or iconic air filters may use negative ions to attract dust, contaminants, and the like from the air. In an embodiment, electro-static materials (e.g. tourmaline) may be used in a filter, in the adjustable bed facility 102, in the mattress 110, or the like to absorbed odor, dust, contaminants, or the like from the air environment around the bed, within the bed, or the like. In an embodiment, HEPA filters are composed of a mat of randomly arranged fibers that are designed to trap at least 99.97% of dust, pollen, mold, bacteria, and any airborne particles with a size of 0.3 micrometers (μm) at 85 liters per minute (Lpm). The HEPA filter may be used in a device, facility, or the like for filtering the air in the area of the adjustable bed facility 102.

In an embodiment, the air purification facility 144 may be part of the adjustable bed facility 102, a freestanding device or facility, or the like. In an embodiment, if the air purification facility 144 is part of the adjustable bed facility 102 the air purification facility 144 may be attached to any part of the adjustable bed facility 102 such as the mattress 110, sub-frame 112, skeleton structure 114, or the like. In an embodiment, the air purification facility 144 that is attached to the adjustable bed facility 102 may be controlled direct control of the air purification facility 144 device, control using the remote 148, or the like.

In an embodiment, the air purification facility 144 may be a free standing device that may be plugged into a adjustable bed facility 102 power outlet 138 and therefore may be controlled with the remote 148 controlling the on/off condition of the power outlet 138.

In an embodiment, the air purification facility 144 may be a freestanding device that may be connected to an adjustable bed facility 102 modular control 128. The modular control may provide power (AC or DC), control communication, and the like to the air purification facility 114. In an embodiment, the user may be able to control the air purification facility 144 using the remote 148 to control the modular controls 132.

In an embodiment, an adjustable bed facility 102 may be any bed that is capable of adjusting at least one aspect of the bed such as a head section, a foot section, a leg section, a torso section, or the like. In an embodiment, the adjustment may include moving the sections up, down, higher, lower, longer, shorter, and the like. In an embodiment, the section adjustments may also include vibration, massage, and the like. In an embodiment, the adjustable bed facility 102 may include components such as actuators 104, springs 108, a mattress 110, a sub-frame 112, a skeleton structure 114, vibration motors 118, supports 120, safety brackets 122, wire harness 128, receiver 130 modular controls 132, control box 134, power outlets 138, power supply 140, power connection 142, air purification facility 144, remote control 148, receiver learn facility 152, bed memory 154, backup battery 158, memory connection 160, network connection 162, and the like.

In an embodiment, the adjustable bed facility 102 sections may be adjustable by a user, a care giver, a medical person, or the like to provide a comfortable position, a medical required position, a working position, a resting position, or the like. For example, a medical position may be required to have a user's legs elevated to aid in the reduction of swelling and therefore the leg or foot sections may be elevated. In another example, a user with a back condition may need to rest his or her back and may still wish to work, the user may be able to position the adjustable bed facility 102 to provide a comfortable back position that allows the user to work on papers or a computer device.

In an embodiment, the adjustable bed facility 102 may be used in a home, a hospital, a long-term care facility, or the like. The adjustable bed facility 102 may be used by users that may have limited mobility, are restricted to bed rest, require a non-flat sleeping position, and the like.

In an embodiment, actuators 104 may be used to move the adjustable bed facility 102 sections. The actuator 104 may typically be a cylinder device where a first component, under a force, is extendable from second component that may result in the action of moving an object. In an embodiment, there may be more than one actuator 104 per adjustable bed facility 102. There may be an actuator 104 to move any of the adjustable bed facility 102 sections or other aspects of the adjustable bed facility 102. For example, there may be individual actuators for the head section, leg section, foot section, torso section, or the like. In an embodiment, a single actuator may be used to move more than one adjustable bed facility 102 section. For example, one actuator may be used to move the leg and foot sections; the leg and foot sections may be connected by a mechanical structure that may control the orientation of the leg and foot sections during movement. In an embodiment, the actuators 104 may be connected between the adjustable bed facility 102 section to be moved and the sub-frame 112, skeleton structure 114, or the like.

In an embodiment, the actuator 104 may have different driving means to extend and retract the actuator 104 such as an electric motor, pneumatic pressure, hydraulic pressure, or the like.

In an embodiment, the electric motor driven actuator 104 may use a DC or AC motor and gear assembly to extend and retract the actuator 104.

In an embodiment, the pneumatic pressure actuator 104 may use an air source to extend and retract the actuator 104. The air source may be part of the pneumatic actuator 104, may be a separate device, or the like. In an embodiment, the separate air source device may be part of the adjustable bed facility 102 or may be external to the adjustable bed facility 102.

In an embodiment, the hydraulic pressure actuator 104 may use a fluid source to extend and retract the actuator 104. The fluid source may be part of the hydraulic actuator 104, may be a separate device, or the like. In an embodiment, the separate fluid source device may be part of the adjustable bed facility 102 or may be external to the adjustable bed facility 102.

In an embodiment, springs 108 may be used with a mattress 110, instead of a mattress 110, or the like. In an embodiment, the springs may be a standard bed spring system (e.g. coils within a wire framework), individual coil springs, individual foam springs, air springs, or the like. In an embodiment, the individual springs (e.g. coil, foam, or air) may be used to provide variable firmness to provide comfort to the user. For example, the springs 108 may be less firm or firmer in a local area to provide the user with the support that may be required for a body location that is experiencing discomfort (e.g. a hip, shoulder, back, neck).

In an embodiment, the mattress 110 may include foam, feathers, springs 108, material, or the like. In an embodiment the different materials may be used individually or in combination. The mattress may be intended to provide the user with a firmness that provides for the comfort requirements of the user.

In an embodiment, the mattress 110 may be an air mattress. In an embodiment, the air mattress may be constructed using a single chamber, a plurality of chambers, a plurality of individual chambers, a combination of chamber shapes, or the like. In an embodiment, the air mattress 110 may be inflated to various pressures that may provide the user with the desired comfort level. In an embodiment, there may be separate air mattresses 110 for each of the adjustable bed facility 102 sections. For example, there may be separate air mattresses 110 for the head, torso, and foot sections of the adjustable bed facility 102. In an embodiment, the inflation pressure of the individual air mattresses 110 may be different from each other depending on user settings.

In another embodiment of an air mattress 110 with individual chambers, local firmness control may provide local firmness comfort to a user to provide comfort. For example, a user may be recovering from surgery and may require the air mattress 110 to be less firm in a certain area, the user may be able to indicate the area to be less firm and the individual chamber pressures may be adjusted to provide the less firm area. Additionally, while a local area may be provided with a less firm pressures, the remainder of the mattress 110 may have a consistent firmness pressure.

In an embodiment, the sub-frame 112 may be a structural support frame in contact with the floor and may include the floor legs, connections for the actuators 104, connections for the supports 120, support for the skeleton structure 114, and the like. In an embodiment, the sub-frame 112 materials may include wood, metal, plastic, and the like. In an embodiment, the sub-frame 112 may provide a support interface to the skeleton structure 114 and may support the freedom of motion for the skeleton structure 114. For example, the sub-frame 112 may include an interface such as a track, surface, groove, slot, or the like in which the skeleton structure 114 may interface and use as a guide while providing motion support for the various adjustable bed facility 102 sections. In an embodiment, the sub-frame 112 interface may be a "C" channel in which the skeleton structure 114 may have interfacing wheels to move within the "C" channel during the adjustable bed facility 102 section movements.

In an embodiment, the sub-frame 112 may be substantially the same shape as the adjustable bed facility 102 and may have structural members along the length and width of the sub-frame 112. In an embodiment, the structural members may be assembled in any configuration that meets the requirements of supporting the adjustable bed facility 102 and the various devices such as the actuators 104, supports 120, skeleton structure 114, and the like.

In an embodiment, the skeleton structure 114 may be a mechanical structure that may provide support to the springs 108, provide support to the mattress 110, interface with the sub-frame 112, provide a connection to the actuators 104, provide a connection to the supports 120, support the vibration motors 118, and the like. In an embodiment, there may be more than one skeleton structure 114 within the adjustable bed facility 102; there may be a skeleton structure 114 for each adjustable bed facility 102 section. For example, there may be a skeleton structure 114 for the head section, foot section, leg section, torso section, and the like.

In an embodiment, the skeleton structure 114 may be a frame type structure to support at least one mattress 110, provide connectivity between more than one mattress 110, contain a hinge mechanism to allow the motion of a first mattress 110 in relation to a second mattress 110, and the like. The frame structure may be substantially the same shape as the mattress 110 that the skeleton structure 114 is supporting and may have individual structure members at the peripheral edges of the mattress 110 in addition to other individual structural members that may be required for support of mechanical connections, support of the mattress 110, or the like. In an embodiment, the skeleton structure 114 may include materials such as metal, wood, plastic, and the like. The skeleton structure 114 materials may be used individually or in combination.

In an embodiment, the skeleton structure 114 may have an interface facility such as wheels, slides, skids, rails, pivot points, and the like that may interface with the sub-frame 112 support interface. The skeleton structure 114 interface facility may provide for smooth interaction with the sub-frame 112 support interface when the skeleton structure 114 is in motion as a result of actuation from the actuators 104.

In an embodiment, a vibration facility 118 may provide vibration input to the adjustable bed facility 102 sections such as the head section, foot section, leg section, torso section, and the like; there may be vibration facilities in any or all of the adjustable bed facility 102 sections. In an embodiment, the vibration facilities 118 may be operated independently, at the same time, at alternate times, in coordination, or the like. For example, the vibration facilities in the head section and foot section may be operated at the same time to provide a full body massage or the vibration frequencies may operate at alternating times to provide a wave effect of the vibration moving from the head to foot of the adjustable bed facility 102. In another example, the different vibration facilities 118 may be used in concert where the vibration facilities 118 may be vibrated in sequences to create a massaging effect. It may be understood by one knowledgeable in the art that different effects may be created with more than one vibration facility 118.

In an embodiment, using the remote 148, the user may be able to control the vibration mode of the various vibration motors 118; the mode may include the vibration setting for a particular bed section, the vibration frequency of at least one of the vibration motors 118, stopping the vibration of at least one of the vibration motors, or the like. The remote 148 may provide vibration motor 118 control information to the adjustable bed facility 102 control box 134 for control of the vibration characteristics of the adjustable bed facility 102. In an embodiment, the remote 148 may include user inputs that include at least one of head vibration increase, head vibration decrease, foot vibration increase, foot vibration decrease, user preferred vibration settings, vibration stop, or the like.

In an embodiment, the vibration motor 118 may be capable of a plurality of vibration frequencies. For example, the vibration motor 118 may be able to operate on frequencies such as high, medium, low, settings 1-10, or the like. In an embodiment, a first vibration frequency may be stopped before a second vibration frequency is started. In embodiments, the stopping between the first vibration and the second vibration may be automatic and controlled by the logic within the control box 134, may be manually indicated by the user using the remote 148, or the like. As an example of manual input, the vibration motor 118 may be operating on a medium frequency and the user may provide a stop vibration input on the remote 148 to stop the first vibration motor 118 vibration before pressing the low vibration frequency input.

Referring to FIG. 5A and FIG. 5B, an embodiment of a vibration motor 118 is shown within an opening of a adjustable bed facility 102 support lateral surface 508. The adjustable bed facility 102 section may have a lateral surface 508 and the lateral surface 508 may include an opening in which the vibration motor 118 may be located; the vibration motor 118 may fit within the opening such that the vibration motor 118 may not contact the lateral surface 508. In an embodiment, the vibration motor 118 may be secured to the adjustable bed facility 102 section using at least one bracket 504. In an embodiment, when more than one bracket 504 is used, at least one of the brackets 504 may be separable and removable. In an embodiment, the at least one bracket 504 may be shaped to secure the vibration motor 118 within the section opening such as a straight bracket, a U shaped bracket, an L shaped bracket, or the like; in FIG. 5A and FIG. 5B the bracket 504 is shown as a straight bracket 504. In an embodiment, the removal of one of the brackets 504 may facilitate securing the vibration motor 118 to the bed section, facilitating the servicing of the vibration motor 118, or the like. The bracket 504 may be positioned such that at least one portion of the bracket 504 is within the opening of the lateral surface 508 and may also be positioned such that the bracket 504 may overlap the vibration motor 118 flange. The vibration motor 118 flange may extend beyond the perimeter of the opening of the mattress support and the resilient material 502 may provide positional support for the vibration motor 118 so that the flange imparts vibration to the mattress 110 without contacting the mattress support. The at least one bracket 504 may be coupled to the mattress support 508 using a removable coupling. Removing the at least one bracket may facilitate removing and servicing the motor. The resilient material 502 may provide mechanical insulation between the flange and the perimeter of the opening in the mattress support 508. The resilient material 502 disposed between the flange and the lateral support 508 surface of the at least one bracket 504 may further provide positional support for the vibration motor 118 housing. The bracket 504 may be constructed using material such as plastic, metal or the like and may be constructed using the materials individually or in combination. In an embodiment, there may be a resilient material 502 associated with the brackets 504, the resilient material may provide for dampening the vibration between the vibration motor 118 and the adjustable bed facility 102, may contact the vibration motor 118 to secure the vibration motor 118 to the bed section, may provide for dampening of vibration to the adjustable bed facility 102 and hold the vibration motor 118 in place, or the like. The resilient material 502 may include latex foam, polyurethane foam, polypropylene foam, polyethylene foam, or the like and may be used individually or in combination.

In an embodiment, the vibration facility 118 may be connected to the skeleton structure 114, the mattress 110, the lateral surface 508, or the like where the vibration may be imparted into the adjustable bed facility 102 mattress 110 as desired by the user. In an embodiment, the vibration motor 118 flange may provide surface area that may impart a vibration into the mattress 110. In an embodiment, the vibration motor 118 may be secured to the adjustable bed facility 102 section using two separable brackets; at least one of the two separable brackets may be removable. In an embodiment, the removal of one of the brackets may facilitate securing the vibration motor 118 to the bed section, facilitating the servicing of the vibration motor 118, or the like. The bracket may be constructed using a material such as plastic, metal, or the like and may be constructed using the materials individually or in combination. In an embodiment, there may be a resilient material attached to the brackets, the resilient material may provide for a dampening the vibration between the vibration motor 118 and the adjustable bed facility 102, may contact the vibration motor 118 to secure the vibration motor 118 to the bed section, or the like. For example, the brackets may be attached to the adjustable bed facility 102 section with the resilient material making contact with the vibration motor 118 that may be in an opening of the section. The resilient material may provide the force required to hold the vibration motor in place within the section opening and may provide dampening of the vibration to the adjustable bed facility. The resilient material may include latex foam, polyurethane foam, polypropylene foam, polyethylene foam, or the like and may be used individually or in combination.

In an embodiment, the electric motor vibration facility 118 may use DC or AC current to power the motor. In an embodiment, to provide the vibration, the motor may rotate an offset mass on the motor shaft that may cause the vibration facility 118, mattress 110, skeleton structure 114, or the like to vibrate. The user may feel the vibration through the mattress 110, springs 108, or the like.

In an embodiment, an air bladder or air spring may be used to provide a vibration to the adjustable bed facility 102. In an embodiment, the air bladder or air spring air pressure may be varied at a frequency to create a vibration within the vibration facility 118, mattress 110, skeleton structure 114, or the like. In an embodiment, there may be an air supply unit that supplies the frequency varied air pressure to the air bladder or air spring.

In an embodiment, the vibration motor 118 may be in proximity to a vibration distribution facility that may aid in the propagation of vibration energy to the adjustable bed facility 102 section. In an embodiment, the vibration motor 118 may be operatively connected to the vibration distribution facility, may be in contact with the vibration distribution facility, may not be in contact with the vibration distribution facility, or the like. In an embodiment, the vibration distribution facility may provide for a more uniform distribution of the vibration characteristics of the vibration motor 118 and may have a size and shape relative to the size and shape of the adjustable bed facility 102 section. The vibration distribution facility may be constructed using materials such as plastic, rubber, metal, or the like and may be constructed using these materials individually or in combination. In an embodiment, the user may be able to control the speed, amplitude, pulse, and the like of the vibration facility 118 using an interface such as the remote 148.

In an embodiment, the vibrator facility 118 may be mounted to the mattress 110 using the vibration distribution facility, resilient material 502, strong fabric, or the like. In an embodiment, each adjustable bed facility 102 section that includes a vibrator facility 118 may have an opening in the section to accept the vibrator facility 118. In an embodiment, over the opening in the section, a layer of resilient material 502, strong fabric, or the like may be placed. The layer of resilient material 502, strong fabric, or the like may be placed between the vibrator facility 118 and the mattress 110. In an embodiment, the vibrator facility 118 may impart vibrations to a mattress 110 through the resilient material 502 disposed over an opening in an adjustable bed facility 102 section. In an embodiment, a fabric cover may be disposed over the resilient material 502 and/or an adjustable bed facility 102 section, between the vibrator facility 118 and the mattress 110. In embodiments, a plurality of fabric covers may be disposed over the resilient material 502 and/or an adjustable bed facility 102 section to provide stabilization. In an embodiment, the vibrator facility 118 may impart vibrations to a mattress 110 through a resilient material 502 and a fabric or plurality of fabrics covering the resilient material 502 and/or adjustable bed facility 102 section.

In an embodiment, the resilient material 502 may be foam, cotton matting, or the like. In an embodiment, the vibration distribution facility may be plastic, wood, rubber, metal, or the like and may be any size and/or shape that supports the required vibration characteristics. The vibration distribution facility may have a plurality of barbs or other anchoring devices that may be pushed into the resilient material, strong fabric, or the like to secure the vibration distribution facility in place on top of the resilient material, strong fabric, or the like. In an embodiment, the barbs or other anchoring devices may have a number of gripping edges, points, or the like to provide a connection with the resilient material and strong fabric.

In an embodiment, the vibrator facility 118 may be mounted to the vibration distribution facility through the opening of the adjustable bed facility 102 section lateral surface 508. In an embodiment, the vibration motor 118 may be operatively connected to the vibration distribution facility, may be in contact with the vibration distribution facility, may not be in contact with the vibration distribution facility, or the like. In an embodiment, there may be a layer of resilient material, strong fabric, or the like between the vibrator motor 118 and the vibration distribution facility.

In an embodiment, any space between the vibration facility 118 and the opening of the adjustable bed facility 102 section may be filled with a vibration absorbent material such as foam, cotton matting, rubber, or the like. The absorbent material may provide a layer of vibration insulation between the vibration facility 118 and the adjustable bed facility 102 section opening.

In an embodiment, the combination of the vibration distribution facility and vibration facility 118 may be a vibration facility assembly. In an embodiment, the vibration facility 118 assembly may be attached to the adjustable bed facility 118 sections with the plurality of barbs or anchoring devices.

Referring again to FIG. 1, in an embodiment, the supports 120 may be hydraulic pressurized cylinders that may provide additional control of the decent of the adjustable bed facility 102 sections. The pressurized supports 120 may be designed to support a certain amount of weight that may include the skeleton structure 114, mattress 110, springs 108, user, and the like. In an embodiment, the pressurized cylinders may be similar to the type of supports that are used in automobile trunks to support the trunk open while the user access the trunk area.

In an embodiment, the supports 120 may provide a safety feature when combined with the safety bracket 112. The safety bracket 122 may prevent the actuators from forcibly pulling the adjustable bed facility 102 sections down; the safety bracket is described in more detail below. The supports 120 may be positioned on the sections that are actuated and may provide a controlled speed at which the sections will return to a horizontal position. In an embodiment, the support 120 may provide support of a weight that is less than the weight of the section, therefore the section will provide enough force (e.g. weight) on the support 120 to compress the cylinder and move the section down. In an embodiment, there may be more than one support 120 for each actuated adjustable bed facility 102 section. In an embodiment, the support 120 may be connected between the skeleton structure 114 and the sub-frame 112.

In an embodiment, the safety bracket 122 may be a slotted bracket that provides the connection between the actuators 104 and the skeleton structure 114 for the purpose of moving the adjustable bed facility 102 sections. A side of the slot that is farthest from the actuator 104 may be the slot first side and may be the side that the actuator 104 pushes on to move the adjustable bed 102 section up. A side of the slot that is nearest to the actuator 104 may be the slot second side and may be the side the actuator 104 pulls on to move the adjustable bed 102 section down. In an embodiment, when the actuator 104 is expanding and moving an adjustable bed facility 102 section it may apply a force on the first side of the slot and move the section in an upward direction. When the actuator 104 is retracted to move the section in a downward direction, the actuator 104 connection may move into the middle area (e.g. not in contact with the first or second side of the slot) of the safety bracket 122 slot. As the actuator 104 connection moves into the slot middle area, the adjustable bed facility 102 section may move in a downward motion under the force of section weight. In an embodiment, the actuator 104 may retract at the same speed as the safety bracket 122 moves, therefore the actuator 104 connection may stay in the safety bracket 122 slot middle area and not make contact with the second side of the safety bracket 122 slot. In this manner, the actuator 104 connection may not contact the second side of the slot and therefore the adjustable bed 102 section may not move in the downward direction by the force of the actuator 104.

In an embodiment, if the actuator 104 connection comes in contact with the second side of the safety bracket 122 slot, there may be a shutoff switch, shutoff indicator, or the like that may stop the retraction of the actuator 104.

In an embodiment, the adjustable bed facility 102 may include an electronic facility 124. In an embodiment, the electronic facility 124 may include a wire harness 128, a receiver 130, power outlets 138, modular controls 132, a power supply 140, a power connection 142, and the like. In an embodiment, different components of the electronic facility 124 may be individual components, combined components, individual and combined components, or the like. For example, the receiver 130, control box 134, and power supplied may be individual components, may be combined into a single component, may be a combination of individual and combined components, or the like. In an embodiment, the various electronic facility 124 components may be mounted on the sub-frame 112, skeleton structure 114, or the like as required for the particular component.

In an embodiment, the wire harness 128 may provide power and data connections to a plurality of modular controls 132. Depending on the power supply 140, the wire harness may provide either DC or AC power to the modular controls 132. In an embodiment, the data connections may be serial, parallel, or the like. In an embodiment, the wire harness may have the same number of power/data connections as there are possible modular controls 132. In an embodiment, the wire harness may be a unit of power/data connections that may be bound together into a single wire harness. In another embodiment, the wire harness may be a group of individual power/data connections. In an embodiment, for each individual wire in the bundle, group, or the like, a first end may have connections for the control box 134 and power supply 140. A second end of the wire harness 128 may be a power and data connection for each individual modular control 132.

In an embodiment, a receiver 130 may receive user commands from a remote control 148. In an embodiment, the receiver 130 may have a wireless or wired connection to the remote 148. In an embodiment, the wireless remote 148 to receiver 130 communication may be a radio frequency (RF) communication, infrared (IR) communication, Bluetooth communication, or the like. In an embodiment, the receiver 130 may receive the communication command from the remote 148 and transmit the remote 148 command to the control box 134. The communication with the control box 134 may be wireless or wired. In an embodiment, the wireless communication between the receiver 130 and the control box 134 may be a radio frequency (RF) communication, infrared (IR) communication, Bluetooth communication, or the like. In an embodiment, the receiver 130 may be combined with the control box 134 into a single component. In an embodiment, the skeleton structure 114 may be used as an RF antenna for receiving communication from the remote 148 to the receiver 130. In embodiment, the entire skeleton structure 114 may be used as an antenna; a portion of the skeleton structure 114 may be used as an antenna, or the like.

In an embodiment, the modular controls 132 may provide additional functionality to the adjustable bed facility 102 that may include a stereo, a CD player, an MP3 player, a DVD player, a lamp, power outlets 138, an air purification facility 144, or the like. The additional functionality that the modular controls 132 provide may be considered optional equipment that may be offered with the adjustable bed facility 102. For example, a user may be able to purchase an adjustable bed facility 102 without any modular controls 132 and may add modular controls as he or she desires. In another example, the user may purchase the adjustable bed facility 102 with modular controls already installed. In an embodiment, the modular controls 132 may have predetermined mounting locations on the sub-frame 112, skeleton structure 114, or the like.

In an embodiment, the modular controls 132 may directly control devices, indirectly control devices, or the like. For example, the modular control 132 may directly control a lamp that is connected to the modular control 132 but may indirectly control a device or facility that is plugged into an outlet 138 controlled by the modular control 132. The devices and facilities may include a stereo, CD player, DVD player, air purification facilities, or the like may receive power from power outlets 138 that are controlled by the modular control 132. In this example, the user control of the power outlet 138 to turn the device on or off but the user may not be able to control the individual device (e.g. the volume of stereo). In an embodiment, the user may control the additional function devices by using the remote 148 that may have an interface for each of the modular controls 132. For example, there may be an interface on the remote 148 for turning on a lamp, turning off a lamp, dimming a lamp, and the like. In a similar manner, the user may be able to control if a power outlet 138 provided by a modular control 132 is on or off.

In an embodiment, the modular controls 132 may be connected to the control box 134, power supply 140, or the like; the connection may be the wire harness 128. In an embodiment, the modular controls 132 may communicate with the control box 134 by a wireless means that may include radio frequency (RF), infrared (IR), Bluetooth, or other wireless communication type.

In an embodiment, the control box 134 may interpret commands received from the receiver 130 into commands for the various adjustable bed facility 102 components such as the actuators 104, the vibration facility 118, the modular controls 132, power outlets 138, and the like. In an embodiment, the control box 134 may contain a microprocessor, microcontroller, or the like to run a software application to interpret the commands received from the remote 148 through the receiver 130. In an embodiment, the software application may be interrupt based, polling based, or other application method for determining when a user has selected a command on the remote 148. In an embodiment, the software application may be stored in the control box 134, stored in bed memory 154, or the like and may be stored as software, as firmware, as hardware, or the like.

In an embodiment, the control box 134 may receive information from the receiver 130 by wired communication, wireless communication, or the like. In an embodiment, the wireless communication may be by radio frequency (RF), infrared (IR), Bluetooth, or other wireless communication type.

In an embodiment, after the control box 134 has interpreted the received user commands, the control box 134 may transmit the interpreted commands to the various controllers for the adjustable bed facility 102 components such as the actuators 104, vibrator facility 118, modular controls 132, power outlets 138, and the like. The control box 134 may transmit information that may be further interpreted by the components into commands for the individual components. For example, the control box 134 may receive a command to move the head section up. The control box 134 may interpret the remote 148 command into a command the actuator may understand and may transmit the command to extend the head section actuator to move the head section up.

In an embodiment, the power supply 140 may receive power from a standard wall outlet, fuse box, circuit box, or the like and may provide power to all the powered components of the adjustable bed facility 102. In an embodiment, the power supply 140 may provide DC power or AC power to the components. In an embodiment, if the power supply 140 provides DC power, the power supply 140 may convert the incoming AC power into DC power for the adjustable bed facility 102.

In an embodiment, the power outlets 138 may provide standard household AC current using a standard outlet for use by external devices using a standard plug. In an embodiment, the power outlets 138 may receive power directly from a standard wall outlet, a fuse box, a circuit box, or the like, but the control box 134 may control whether the power outlet 138 on or off. In an embodiment, the power outlet 138 may have a control circuit that may determine if the power outlet 138 is active (on) or inactive (off). In an embodiment, the command to indicate if the power outlet 138 is active or inactive may be received from the control box 134. In an embodiment, the control box 134 may receive commands for the power outlet 138 control from the remote 148.

In an embodiment, the power connection 142 may receive standard power for the adjustable bed facility 102 from a standard outlet, fuse box, circuit box, or the like. In an embodiment, the power connection 142 may provide standard AC power to the power outlets 138, the power supply 140, or the like.

In an embodiment, the air purification facility 144 may be any type of device or facility that may be capable of improving that air environment in the area of the adjustable bed facility 102. In an embodiment, the air purification facility 144 may be an absorbent type (e.g. carbon), electrostatic, HEPA filter, or the like. In an embodiment, absorbent materials may be used in a filter, in the adjustable bed facility 102, in the mattress 110, or the like to absorbed odor, dust, contaminants, or the like from the air environment around the bed, within the bed, or the like. In an embodiment, electro-static or iconic air filters may use negative ions to attract dust, contaminants, and the like from the air. In an embodiment, electro-static materials (e.g. tourmaline) may be used in a filter, in the adjustable bed facility 102, in the mattress 110, or the like to absorbed odor, dust, contaminants, or the like from the air environment around the bed, within the bed, or the like. In an embodiment, HEPA filters are composed of a mat of randomly arranged fibers that are designed to trap at least 99.97% of dust, pollen, mold, bacteria, and any airborne particles with a size of 0.3 micrometers (μm) at 85 liters per minute (Lpm). The HEPA filter may be used in a device, facility, or the like for filtering the air in the area of the adjustable bed facility 102.

In an embodiment, the air purification facility 144 may be part of the adjustable bed facility 102, a freestanding device or facility, or the like. In an embodiment, if the air purification facility 144 is part of the adjustable bed facility 102 the air purification facility 144 may be attached to any part of the adjustable bed facility 102 such as the mattress 110, sub-frame 112, skeleton structure 114, or the like. In an embodiment, the air purification facility 144 that is attached to the adjustable bed facility 102 may be controlled direct control of the air purification facility 144, control using the remote 148, or the like.

In an embodiment, the air purification facility 144 may be a free standing device that may be plugged into an adjustable bed facility 102 power outlet 138 and therefore may be controlled with the remote 148 controlling the on/off condition of the power outlet 138.

In an embodiment, the air purification facility 144 may be a freestanding device that may be connected to an adjustable bed facility 102 modular control 128. The modular control may provide power (AC or DC), control communication, and the like to the air purification facility 114. In an embodiment, the user may be able to control the air purification facility 144 using the remote 148 to control the modular controls 132.

In an embodiment, the remote 148 may be a user controlled device to provide control commands to the control box 134 to command certain functions of the adjustable bed facility 102. In an embodiment, the certain functions may be adjustable bed facility section movement (e.g. up or down), vibration control, modular controlled 132 devices, or the like. In an embodiment, the remote 148 may communicate with the control box using wired communication, wireless communication, or the like. In an embodiment, the wireless communication may be using a radio frequency (RF), infrared (IR), Bluetooth, or the like. If the remote communicates using a wireless technology, the communication may be with the receiver 130 and the receiver 130 may pass the command request to the control box 134.

In an embodiment, the user may indicate the certain adjustable bed facility 102 function using the remote 148 by pressing a button, touching a screen, entering a code, speaking a command, or the like. In an embodiment, the control box 134, using the receiver 130, may receive and interpret the command provided by the remote 148. In an embodiment, the certain functions available on the remote may instruct the control box 134 to directly control a device (e.g. actuator 104), control a modular control 132 connected device, or the like. The remote may control devices with commands that may include on, off, high power, medium power, low power, volume, play, fast forward, rewind, skip, modular device to control, or the like. For example, the remote 148 may transmit a command to move the head section up and the control box 134 may command the actuator 104 to extend a certain amount in response to the command. In another example, the remote 148 may command that a modular control 132 connected lamp be turned off. The control box 134 may command the control box 132 to turn off the lamp.

In an embodiment, the remote 148 may save adjustable bed facility 102 user preferred settings to a plurality of memory locations that may be used to maintain the user determined bed position, an adjustable bed facility 102 historical setting, or the like. For example, the user may have a certain preferred adjustable bed facility 102 position that may be stored in at least one of the memory locations that the user may be able to later recall to move the adjustable bed facility into the user preferred position. By indicating the recall of the at least one memory locations, the adjustable bed facility 102 control box 134 may command the various components to move to the stored memory location position to achieve the recalled position. In an embodiment, for a remote 148 that may contain buttons, the user may press a single button, a combination of buttons, or the like to recall the memory position desired.

In an embodiment, the remote 148 may have buttons, an LCD screen, a plasma screen or the like to allow the user to indicate the desired command. In an embodiment, the user may press a button to indicate a command to the control box 134. In an embodiment, the LCD or plasma screens may be touch screen sensitive. In an embodiment, the remote 148 screen may present the available controls to the user and the user may touch the screen to indicate the command desired. For example, the remote 148 screen may only present controls that are available in the adjustable bed facility 102; therefore if a modular control 132 is not available, the remote 148 may not display a selection for that modular control 132. In an embodiment, the remote 148 screen may present content sensitive selections to the user. For example, if the user selected to control a CD player, the user may be presented with CD player controls that may include play, fast forward, rewind, skip, stop, repeat, or the like.

In an embodiment, the remote 148 may provide feedback to the user to indicate the success of the certain command. In an embodiment, the feedback may be an audio feedback, a visual feedback, a forced feedback, or the like. In an embodiment, the feedback types may be used individually or in combination. In an embodiment, the audio feedback may be a sound that indicates that the command was successful, failed, is in progress, in conflict with a command in progress, failed for safety reasons, or the like. In an embodiment, the visual feedback may be an indication of the remote 148 screen that indicates that the command was successful, failed, is in progress, in conflict with a command in progress, failed for safety reasons, or the like. In an embodiment, the forced feedback may be a vibration that indicates that the command was successful, failed, is in progress, in conflict with a command in progress, failed for safety reasons, or the like.

In an embodiment, a memory facility 150 may contain components that are intended to maintain certain memory locations for the control box to access, receiver to access, and the like. In an embodiment, the memory facility 150 may include a receiver learn facility 152, a bed memory 154, a backup battery 158, and the like. In an embodiment, the receiver learn facility 152, bed memory 154, and backup battery 158 may be in a single memory facility 150 or may be in more than one memory facilities 150. In an embodiment, the memory facility 152 may be part of the adjustable bed facility 102, part of the electronic facility 124, a separate facility, or the like. In an embodiment, the receiver learn facility 152, bed memory 154, and backup battery 158 may not be part of the memory facility 150, but may be combined into other facilities or devices, be stand-alone devices, or the like.

In an embodiment, the receiver learn facility 152 may act to establish the communication link between the remote 148 and the receiver 130 where the communication between the remote 148 and receiver 130 is a wireless connection. In an embodiment, the communication link between the remote 148 and the receiver 130 may need to be a unique connection to assure that the remote 148 communicates with only one receiver 130 within one adjustable bed facility 102. In an embodiment, the receiver learn facility 152 may be used to provide a unique communication between any remote 148 and any adjustable bed facility 102. For example, a remote 148 may be used to communicate with a first adjustable bed facility 102 and may be used to establish communication between the same remote and a second adjustable bed facility 102. The remote 148 may only be able to communicate with one adjustable bed facility 102 at a time.

In an embodiment, a learn protocol between the remote 148 and receiver 130 may be user initiated by pressing a button on the receiver learn facility 152, powering up the receiver learn facility 152, bringing the receiver learn facility 152 within a certain proximity of the receiver 130, indicating on the remote 148 to begin the learn protocol, or the like. In an embodiment, the learn protocol may be fully automatic, semi-automatic with user intervention, manual, or the like. In an embodiment, a user may select a channel, frequency, or the like during learn protocol or after the learn protocol. The changing of the channel, frequency, or the like may prevent two different remote 148 and receiver 130 combinations from interfering with other wireless communication devices. In an embodiment, each time the learn protocol is executed, a new unique communication link may be established; there may be a plurality of unique communication links available for each remote 148 and receiver 130 combination.

In an embodiment, the bed memory 154 may be the memory location where the control box 134 stores user desired preset information, software for interpreting remote 148 commands, demonstration software, and the like. In an embodiment, the bed memory 154 may be removable memory. For example, the bed memory 154 may be moved from a first adjustable bed facility 102 to a second bed facility 102 to move user settings from the first adjustable bed facility 102 to the second bed facility 102. In this manner the bed memory 154 may be considered portable memory. In an embodiment, the removable bed memory 154 may be flash memory, programmable logic circuit (PLC) memory, secure digital (SD) memory, mini SD memory, Compact Flash type I memory, Compact Flash type II memory, Memory Stick, Multimedia Card, xD Picture card, Smartmedia, eXtreme Digital, Microdrive, or the like.

In an embodiment, the removable bed memory 154 may be used to upgrade the adjustable bed facility 102 memory and software. For example, if new control box 134 software was developed to provide better control over one of the adjustable bed facility 102 components, the software may be saved to a new replaceable memory that may be used in the place of the existing replaceable memory. In this manner, the software of the adjustable bed facility 102 could be upgraded just by providing the user with a new replaceable memory.

In an embodiment, the removable memory may be used to provide a sales enterprise with adjustable bed facility 102 demonstration software where the enterprise may be able to indicate at least one of a plurality of demonstrations for a user. For example, the user may be interested in how the adjustable bed facility 102 sections may be adjusted and the enterprise may select a demonstration to shows all the section motion available. In an embodiment, before an adjustable bed facility 102 is shipped to a user, the enterprise may remove the demonstration removable memory and replace it with a standard adjustable bed facility 102 bed memory 154.

In an embodiment, the backup battery 158 may be used to provide power to volatile memory, provide power to the receiver learn facility 152, provide power to the programmable logic circuit (PLC) memory, or the like.

In an embodiment, the memory connection 160 may be any connection type that provides a connection between the bed memory 154, control box 134, and the like. In an embodiment, the memory connection 160 may be a wired or wireless connection. The wired connection may be a USB connection, a serial connection, parallel connection, or the like. The wireless connection may be by radio frequency (RF), infrared (IR), Bluetooth, or the like. In an embodiment, the memory connection 160 may be in a location that is easy for the user to access the bed memory 154, may be attached to the memory facility 150, may be attached to the control box 134, or the like. In an embodiment, the easy access memory connection may be on the side of the adjustable bed facility 102, on a rail of the adjustable bed facility 102, under the adjustable bed facility 102, or the like.

In an embodiment, the network connection 162 may be used to connect the control box 134 to a network connection.

In an embodiment, the network connection may be a LAN, a WAN, an Internet, an intranet, peer-to-peer network, or the like. Using the network connection 162, the control box 134 may be able to communicate with computer devices on the network. In an embodiment, the network connection 162 may be a wired or wireless connection.

In an embodiment, using the network connection 162, the control box 134 may be able to communicate with the network to periodically check for software updates. In an embodiment, if a software update is located, the control box 134 may send the user an email, instant messenger message, phone message, phone call, cell phone message, cell phone call, fax, pager message, or the like to indicate that software updates are available. The user, using the device that received the notice of software, may send a reply to the control box that the software upgrade should be downloaded, should not be downloaded, or the like.

In an embodiment, an adjustable bed facility 102 enterprise, an adjustable bed facility 102 manufacturer, an adjustable bed facility 102 service enterprise, or the like may send the control box 134 software updates using the network connection 162. In an embodiment, an adjustable bed facility 102 enterprise, an adjustable bed facility 102 manufacturer, an adjustable bed facility 102 service enterprise, or the like may notify the user of available software upgrades for the adjustable bed facility 102 by email, instant messenger message, phone message, phone call, cell phone message, cell phone call, fax, pager message, or the like. The user, using the device that received the notice of software, may send a reply to the adjustable bed facility 102 enterprise, the adjustable bed facility 102 manufacturer, the adjustable bed facility 102 service enterprise, or the like that the software upgrade should be downloaded, should not be downloaded, or the like.

Figure 4B:
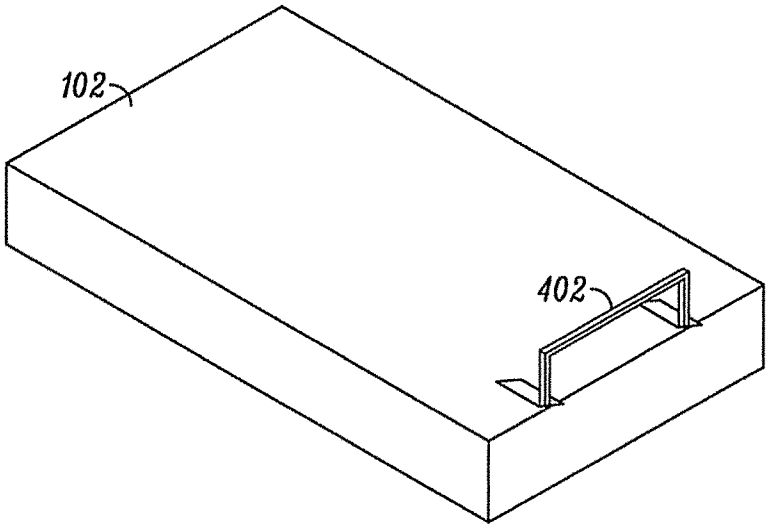
FIG. 4B shows an embodiment of the shipping of a mattress retainer bracket in the upside down position.
Figure 4A:
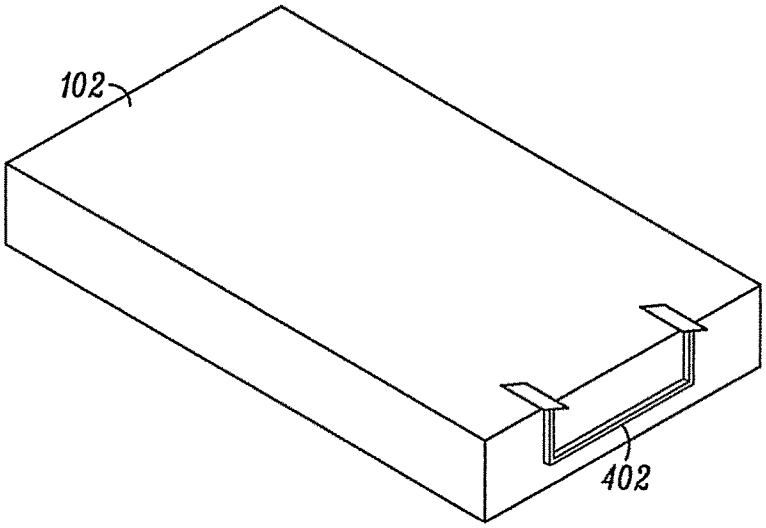
FIG. 4A shows an embodiment of the shipping of a mattress retainer bracket in the upside down position.

Referring now to FIG. 4A and FIG. 4B, an embodiment of shipping and assembling a mattress retaining bracket 402 is shown. The mattress retaining bracket 402 may be used to hold the mattress 110 (not shown) in place on the adjustable bed facility 102 as the adjustable bed facility 102 sections are adjusted. For example, as the head section is adjusted up, the mattress 110 may tend to slide down towards the foot of the bed; the mattress retaining bracket 402 may stop the mattress from sliding and may maintain the mattress 110 in the proper position on the adjustable bed facility 102. In an embodiment, there may be a mattress retaining 402 bracket at the head section and/or the foot section of the adjustable bed facility 102.

In an embodiment, the mattress retaining bracket 402 may be made of materials that include metal, plastic, rubber, wood, or the like. In an embodiment, the materials may be used individually or in combination.

In an embodiment, as shown in FIG. 4A, when the adjustable bed facility 102 is shipped to the user, the mattress retaining bracket 402 may be mounted upside down at the final location of the mattress retaining bracket 402. This mounting method may provide benefits that may include mattress retaining bracket 402 breakage prevention, mattress retaining bracket 402 bending prevention, clear user understanding of the final mattress retaining bracket 402 location, prevention of the mattress retaining bracket 402 becoming lost, and the like. In an embodiment, as shown in FIG. 4B, once the user receives the adjustable bed facility 102 with the upside down mounted mattress retaining bracket 402, the user may rotate the mattress retaining bracket 402 into the upright position and re-secure it to the adjustable bed facility 102.

Figure 6:
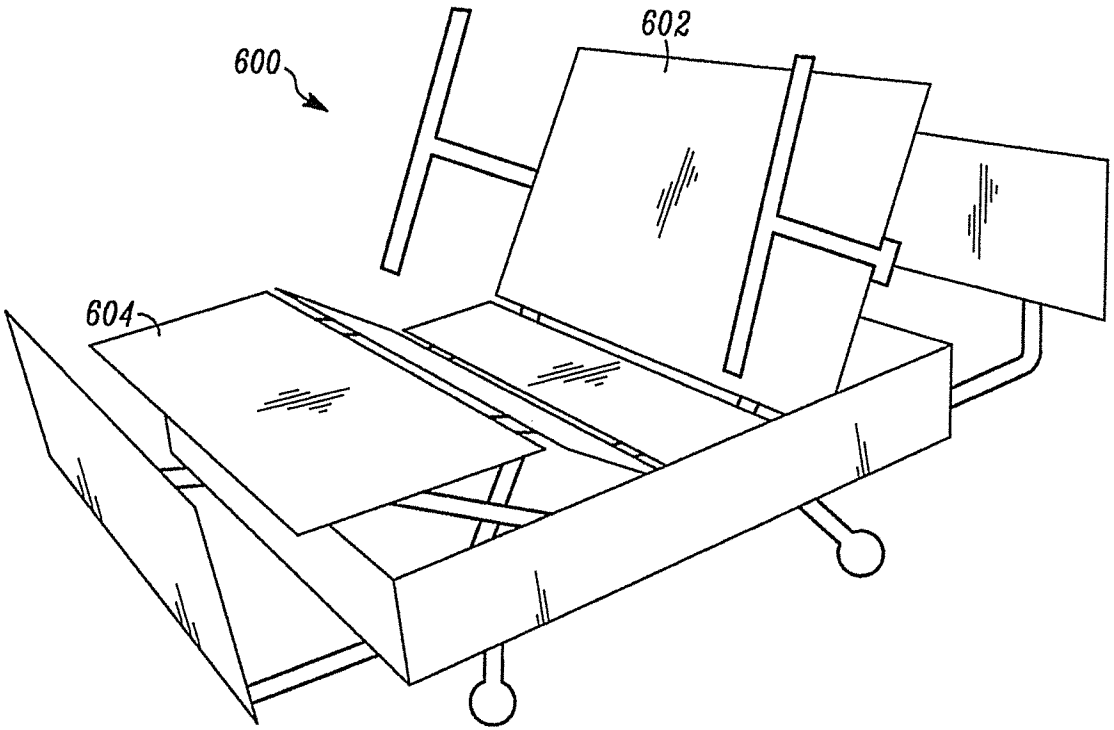
FIG. 6 shows a typical hospital adjustable bed.

Referring to FIG. 6, an example of an adjustable bed 600 (without the mattress) is shown with the head 602 and foot 604 sections raised to an elevated position. This adjustable bed 600 shows that sections, in this case the foot 604 section may be divided into more than one section to provide contouring of bed sections.

Figure 7:
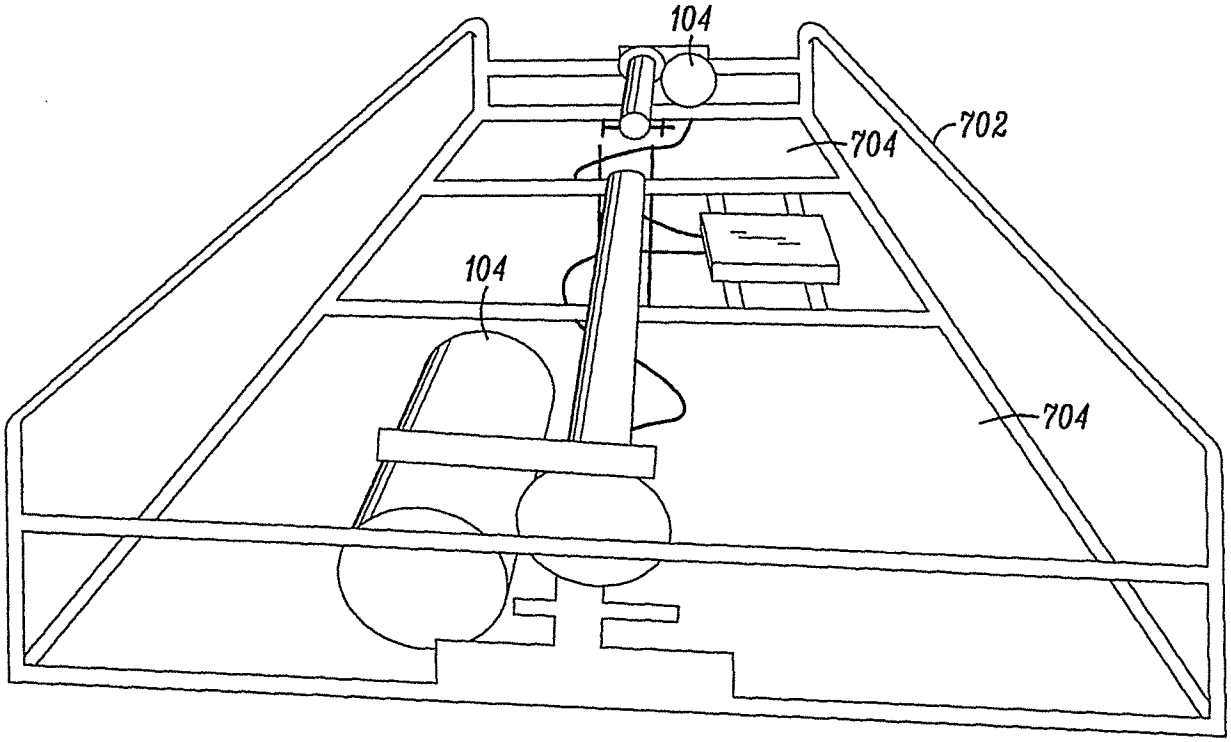
FIG. 7 shows one use of actuators connected to the bed frame and the adjustable sections.

Referring to FIG. 7, an example of actuators 104 connected to the bed frame 702 and the adjustable sections 704 is shown. In this case two actuators 104 are used, one for each adjustable bed section 704.

Figure 8:
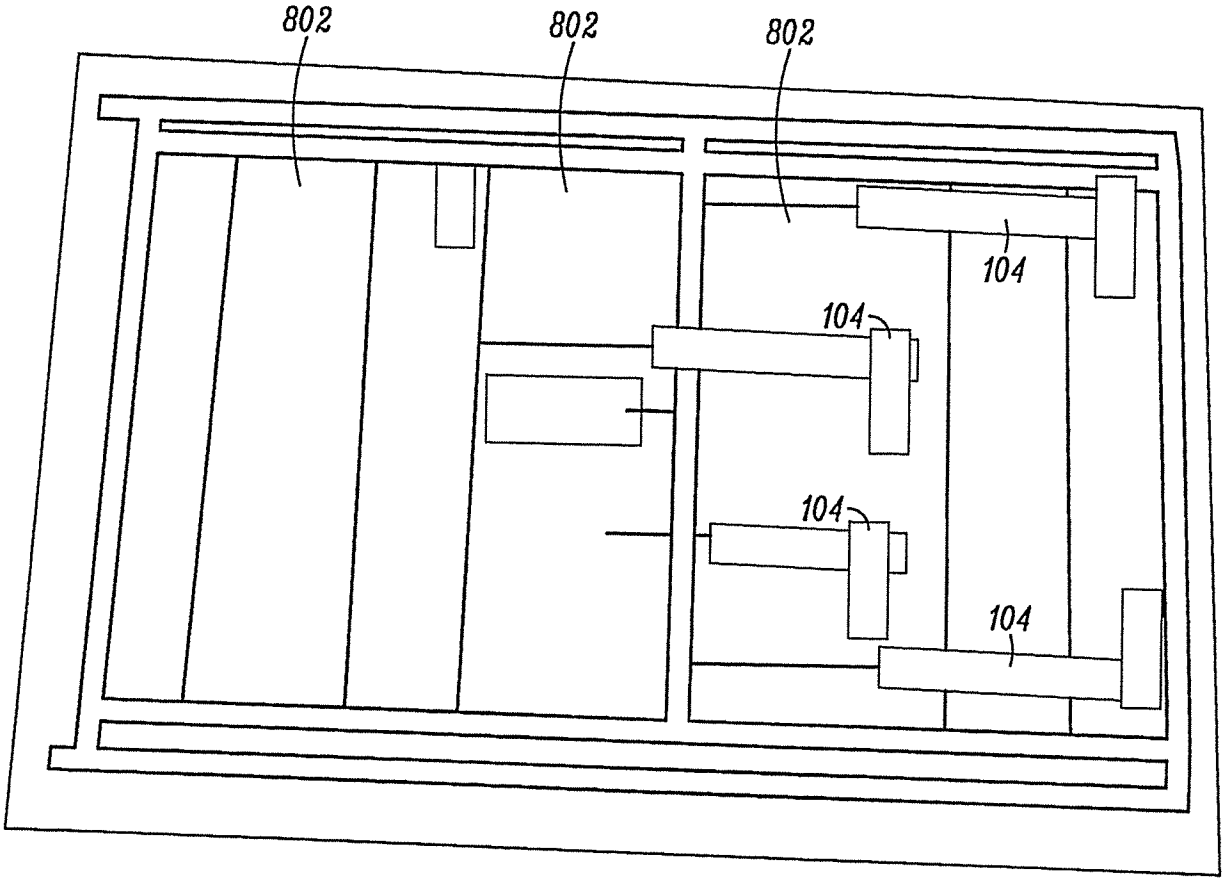
FIG. 8 shows more than one actuator for each adjustable bed section, in this case there are two actuators for each adjustable section.

Referring to FIG. 8, an example of more than one actuator 104 for each adjustable bed section 802 is shown, in this case there are two actuators 104 for each adjustable section 802. In embodiments, more than one actuator 104 per section 802 may be used if the bed sections 802 are heavy, smaller actuators 104 are used, if the bed is a wide bed (e.g. king bed), or the like.

Figure 9:
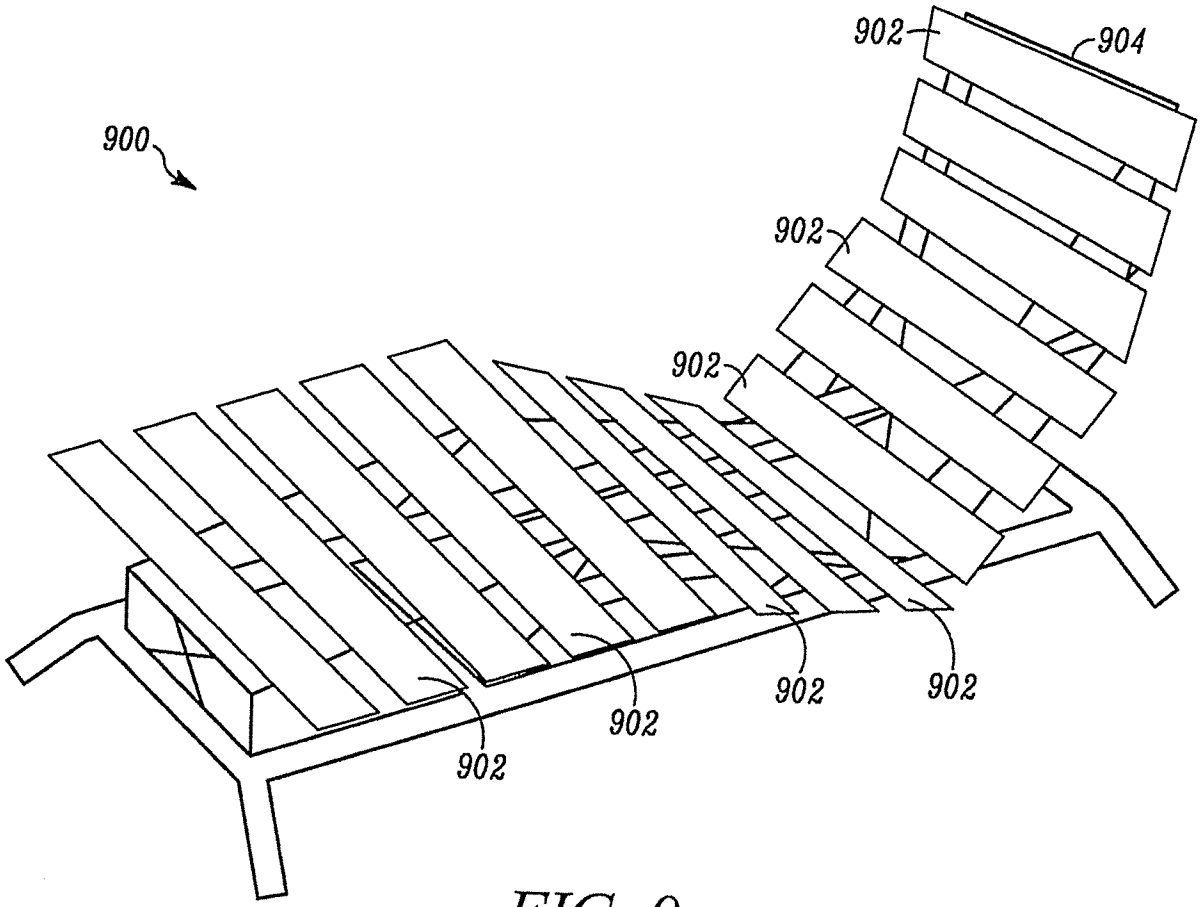
FIG. 9 shows an adjustable bed using slats instead of wood decking for the foundation of the adjustable sections.

Referring to FIG. 9, an example of an adjustable bed 900 using slats 902 instead of wood decking for the foundation of the adjustable sections is shown. In embodiments, the slats 902 may be wood, plastic, rubber, cloth, elastic material, or the like. Using this design, the adjustable bed 900 may be provided with curved contours has shown in the head section 904. In an embodiment, the curved sections may be constructed of a number of small connected individual sections.

An adjustable bed may be constructed in a variety of ways, including distinct functional frame assemblies that are functionally connected to each other and/or to a base frame. The distinct frame assemblies may allow for separate controlled movement and positioning of portions of the adjustable bed to enhance user comfort. The adjustable bed embodiments of FIGS. 15 through 19 include various features that provide independent adjustability, ease of assembly, wheeled movement of the bed, and other capabilities through the use of an assembly of distinct frame assemblies.

Figure 15:
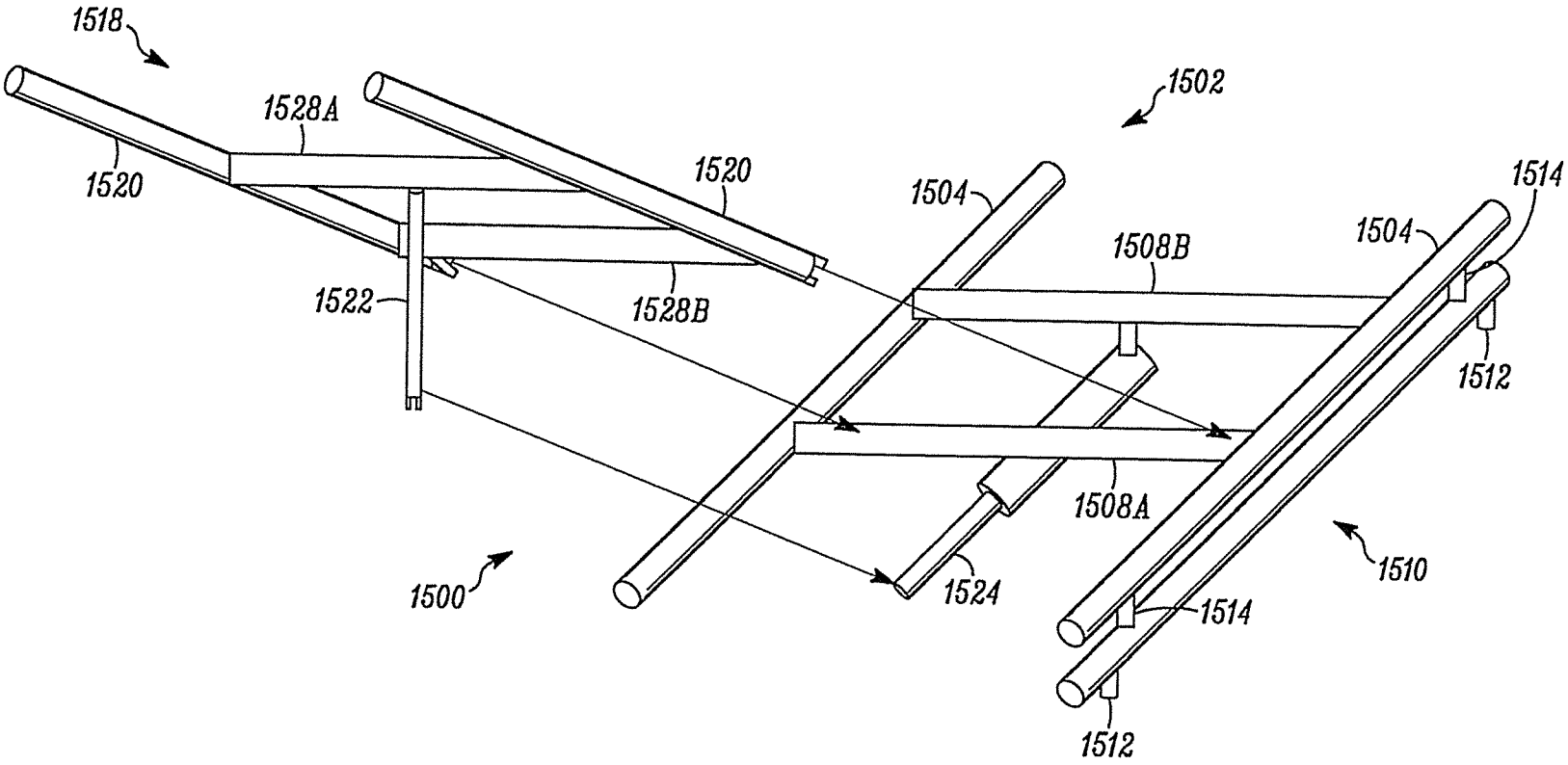
FIG. 15 shows an adjustable bed frame perspective assembly view.

Referring to FIG. 15 which depicts portions of an adjustable bed frame assembly, the adjustable bed frame assembly 1500 includes a center frame 1502 comprising two substantially parallel side frame members 1504 connected by two substantially parallel connector frame members, a forward connector frame member 1508A and a rear connector frame member 1508B, wherein the two connector frame members 1508A and 1508B are located within approximately a center one-third of the length of the side frame members 1504. The adjustable bed frame assembly 1500 also includes a base frame 1510, a portion of which is shown in FIG. 15, that includes a plurality of legs 1512 for mounting on a floor is rigidly affixed 1514 to the center frame 1502 such that the center frame 1502 does not move with respect to the base frame 1510. The adjustable bed frame assembly 1500 further includes a head frame 1518 that comprises two substantially parallel side frame members 1520 connected by a pair of connector frame members 1528A and 1528B, wherein a lower end of each of the head frame's parallel side frame members 1520 are pivotally attached to the forward connector frame member 1508A of the center frame 1502. In addition, a downwardly facing extension frame member 1522 is attached to connector frame member 1528A. The adjustable bed frame assembly 1500 also includes an actuator 1524 for raising and lowering the head frame 1518, wherein one end of the actuator 1524 is pivotally connected to the head frame's extension frame member 1522 and an opposing end of the actuator 1524 is connected to the center frame's rear connector frame member 1508B. The adjustable bed frame assembly 1500 also includes a mattress platform (not shown in FIG. 15) affixed to a top side of the head frame 1518 to provide support to a head portion of a mattress (also not shown in FIG. 15). The adjustable bed frame assembly 1500 may be made of tubular construction with a round profile, square profile, oblong profile, and the like. Alternatively the frame assembly 1500 may be made of angle iron, u-channel, I-beam, and other metal fabrication shapes. Any and all shapes may be used on various frame elements in various combinations to assemble the frame assembly 1500.

In operation, the actuator 1524 may retract to raise the head frame 1518 and may extend to lower the head frame 1518. When extended, the adjustable bed frame assembly 1500 provides a substantially horizontal plane for supporting a mattress. An angle between the base frame 1510 and the head frame 1518 is approximately 180 degrees. During retraction of the actuator 1524, the pivot connections between the head frame's parallel side frame members 1520 and the forward connector frame member 1508 causes the head frame 1518 to move relative to the base frame 1510 resulting in the angle being formed between the head frame 1518 and the base frame 1510 to decrease below 180 degrees. Extending the actuator 1524 causes the angle to increase until the angle is approximately 180 degrees again.

The actuator 1524 may be controlled through a programmable logic controller. Alternatively a programmable logic controller (PLC) executes actuator control as indicated through receipt of a user remote control instruction. The mattress platform may be made of wood.

Figure 16A:
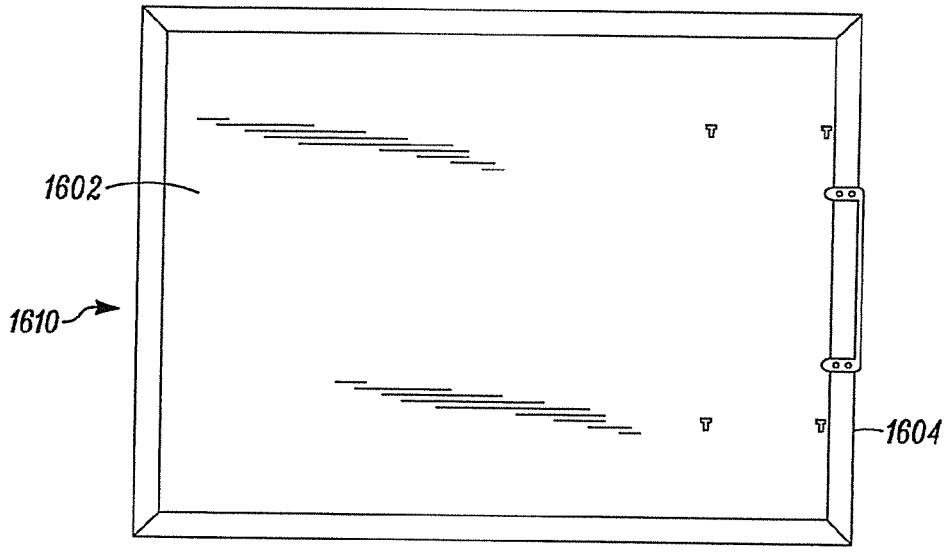
FIGS. 16A, 16B, 16C, 16D, and 16E show various views of an adjustable bed incorporating frame concepts from the frame of FIG. 15.
Figure 16B:
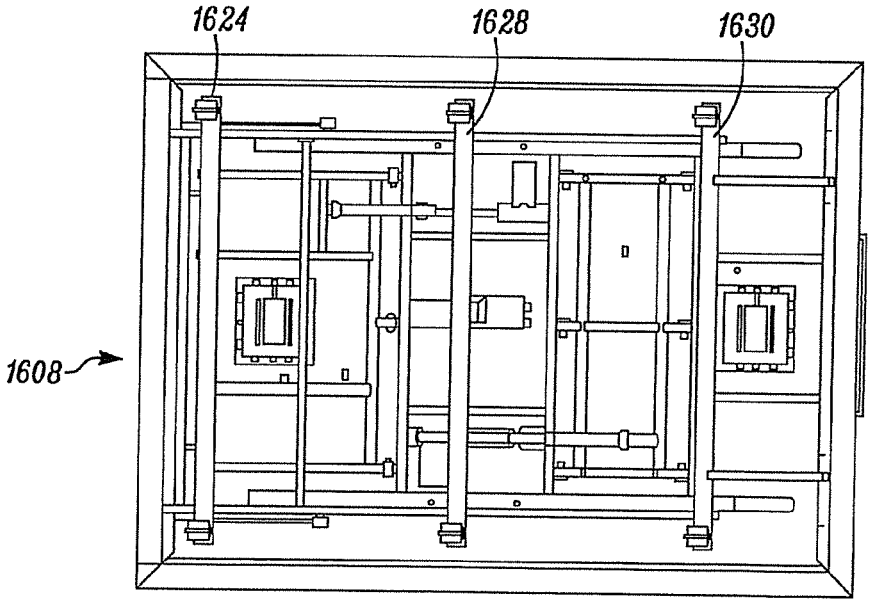
Figure 16C:
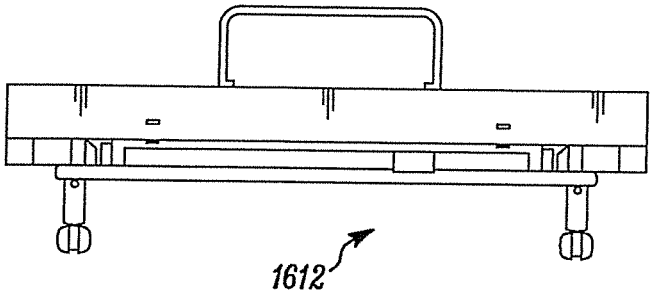
Figure 16D:
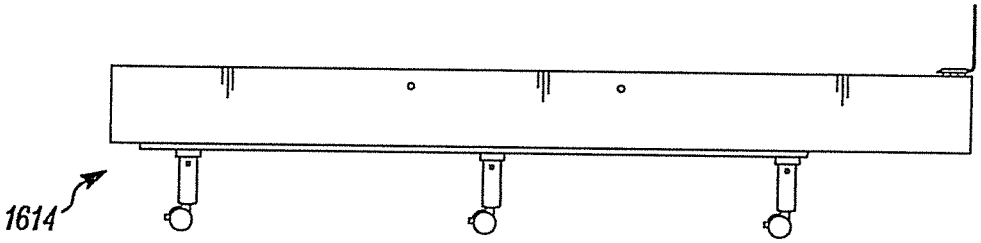
Figure 16E:
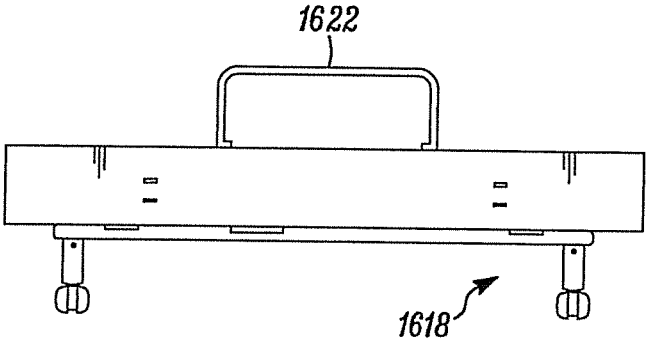

Referring to FIGS. 16A, 16B, 16C, 16D, and 16E which depict various orthogonal views of an embodiment of an adjustable bed, the adjustable bed frame assembly 1500 may be fitted with a flexible mattress platform 1602, shown in FIG. 16A. The flexible mattress platform 1602 may be surrounded by fixed position skirt panels 1604 which may be rigidly attached to the center frame 1502, the base frame 1510, or a combination thereof. In operation, as the actuator 1524 extends and the head frame 1518 pivots in relationship to the base frame 1510, the flexible mattress platform 1602 flexes substantially along the axis of the forward connector frame member 1508A. A mattress stop 1604 may be secured to one of the skirt panels 1604 that is opposite the head frame 1518. The mattress stop 1604 may keep a mattress that is placed on top of the flexible mattress support 1602 from being unintentionally repositioned by the operation of the actuator 1524. An exemplary top view 1610 is shown. FIG. 16B includes a bottom view 1608. FIG. 16C includes a head view 1612. FIG. 16D includes a side view 1614. FIG. 16E includes a foot view 1618. In an alternative configuration of the adjustable bed depicted in FIG. 16A, the flexible mattress support 1602 and the skirt panels 1604 may be co-joined to form a rigid mattress support that substantially inhibits adjustability of the bed frame.

Also depicted in FIG. 16B, base frame 1510 may include lateral support members 1624, 1628, and 1630.

Figure 17A:
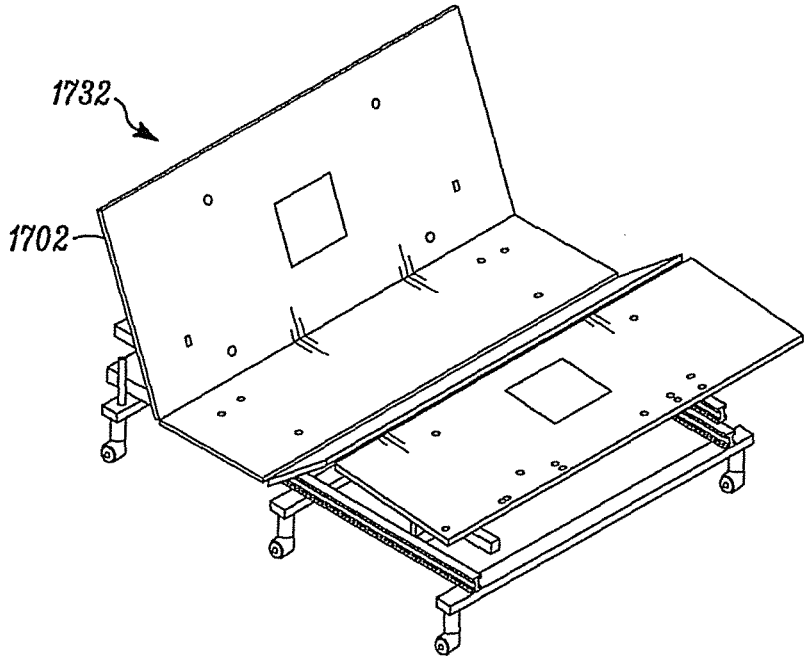
FIGS. 17A, 17B, 17C, 17D, 17E, and 17F show various views of an adjustable bed incorporating frame concepts from the frame of FIG. 15 with separated mattress support panels.
Figure 17B:
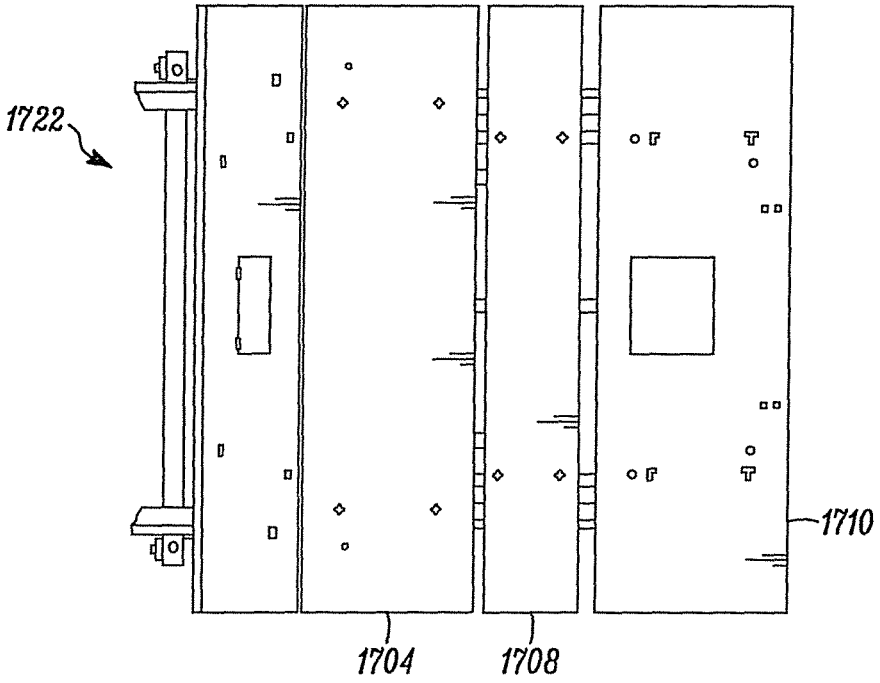
Figure 17C:
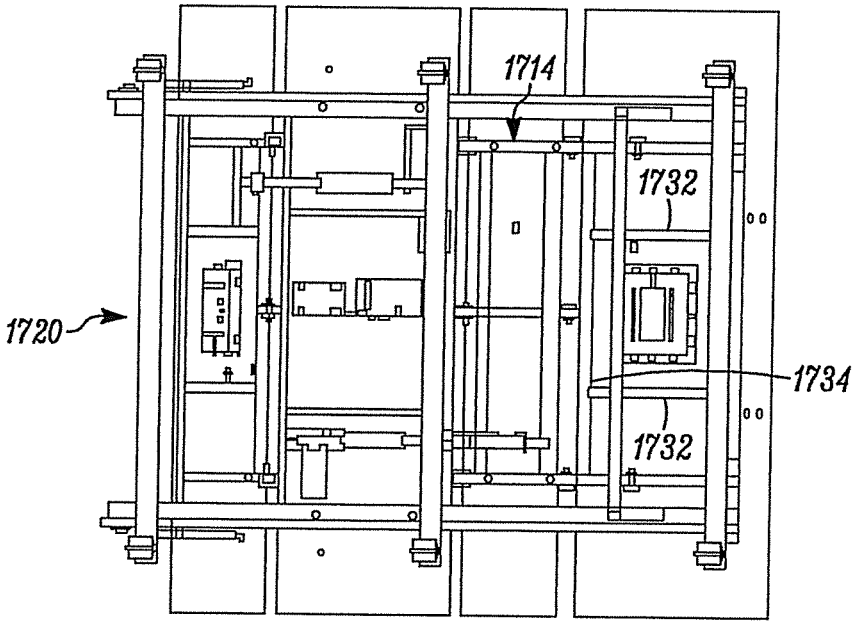
Figure 17D:
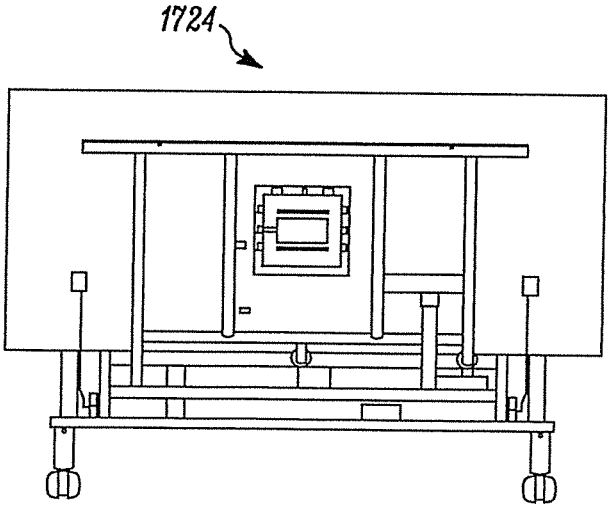
Figure 17E:
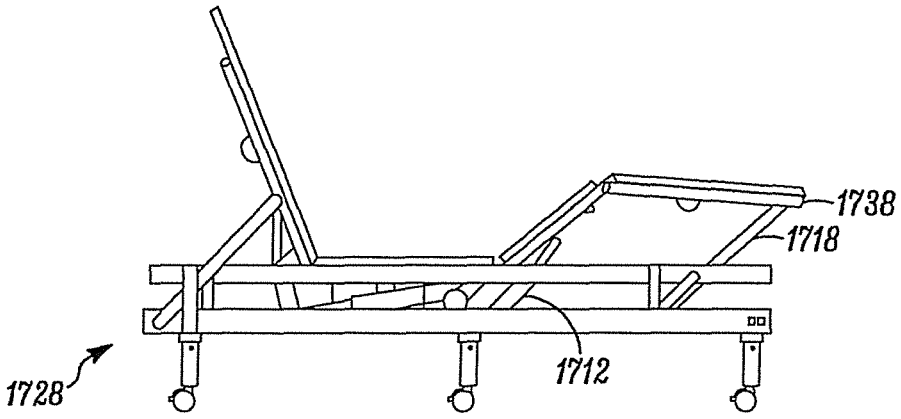
Figure 17F:
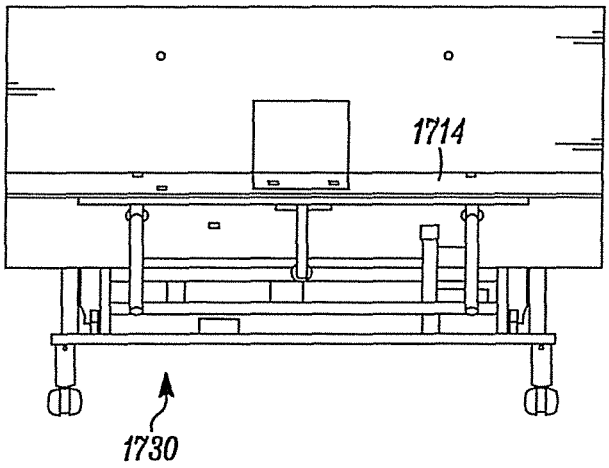

FIGS. 17A, 17B, 17C, 17D, 17E, and 17F show exemplary depictions of various orthogonal views of an embodiment of an adjustable bed that may be an adaptation of the adjustable bed depicted in FIGS. 16A, 16B, 16C, 16D, and 16E. The adjustable bed frame assembly 1500 may be fitted with substantially parallel and co-planar separated mattress platform panels including a head panel 1702, as shown in FIG. 17A, that may be attached to the head frame 1518, a seat panel 1704, as shown in FIG. 17B, that may be attached to the center frame 1502, and two leg panels 1708 and 1710 that may be pivotably attached together along an edge. Leg panel 1708 may be pivotably attached along an edge that is opposite to the edge along which it is attached to leg panel 1710 to the center frame 1502 and in close proximity to the seat panel 1704. Additionally leg panel 1708 may be driven by an actuator 1712, shown in FIG. 17E, that is attached at one end to the center frame 1502 and at the other end to a leg frame 1714, shown in FIG. 17F. Leg panel 1710 may also be pivotably connected to leg panel riser members 1718 close to the edge that is opposite the edge to which leg panel 1708 is connected. The actuator 1712 and leg panel riser members 1718 operate cooperatively to enable the leg panels to rise up to form a shape that allows the legs of a user of the adjustable bed to be elevated while keeping the user's knees bent. The result is the leg panels 1708 and 1710 support a user's legs between the hip and knee at a greater vertical incline than the user's legs between the knee and foot. In operation, actuator 1712 may extend, causing leg panel 1708 to pivot around the connection to center frame 1502 resulting in the leg panel 1708 forming an angle with seat panel 1704 less than 180 degrees. Pivotal connections between leg panel 1708 and 1710 work cooperatively with the pivotably connected leg panel riser member 1718 to cause leg panel 1710 to elevate in response to leg panel 1708 pivoting. In elevation, leg panel 1710 may remain close to horizontal with the edge that connects to leg panel 1708 being slightly more elevated than the opposite edge. In the embodiment of the adjustable bed of FIGS. 17A-F, the elements depicted and described for the adjustable bed of FIGS. 16 A-E may apply with the exception of the flexible mattress 1602 and the fixed skirt panels 1604. FIG. 17C includes a bottom view 1720. FIG. 17B includes a top view 1722. FIG. 17D includes a head view 1724. FIG. 17E includes a side view 1728. FIG. 17F includes a foot view 1730.

Leg frame 1714 may include thigh tube 1734 to which actuator 1712 is connected through a drive arm. Thigh tube 1734 extends laterally across the bed to connect opposing parallel longitudinal leg frame 1714 members. Extending longitudinally from thigh tube 1734 to lateral leg frame member 1738 are two foot support members 1732.

Figure 18A:
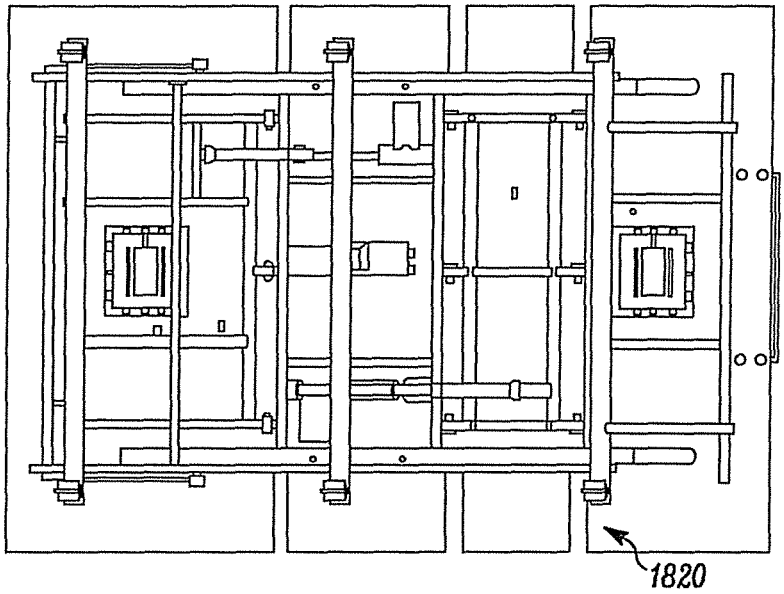
FIGS. 18A, 18B, 18C, 18D, 18E, and 18F show the bed of FIGS. 17A-F in a horizontal position.
Figure 18B:
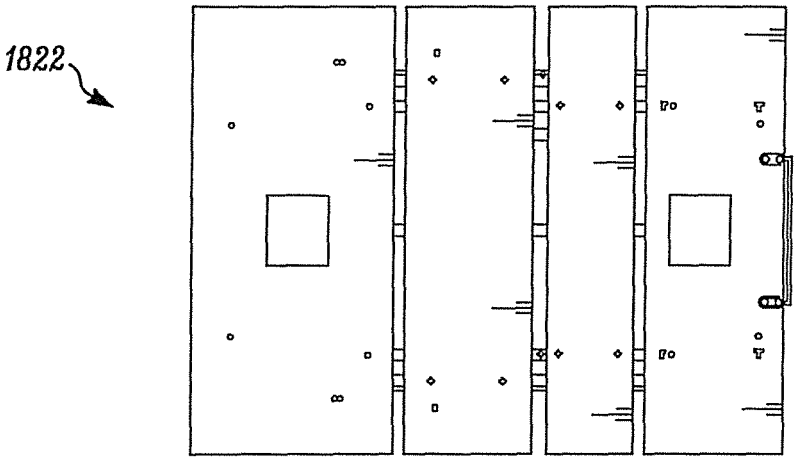
Figure 18C:
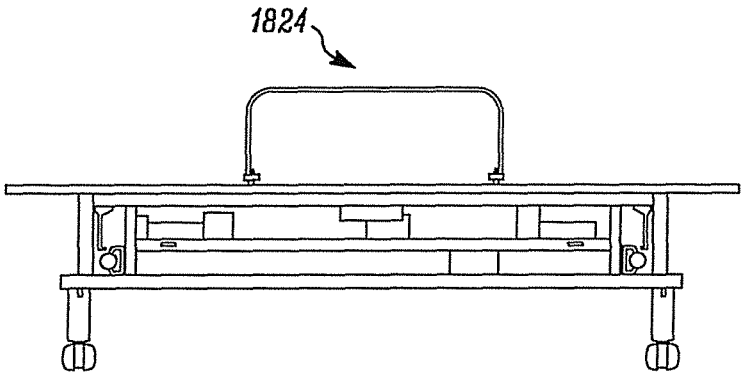
Figure 18D:
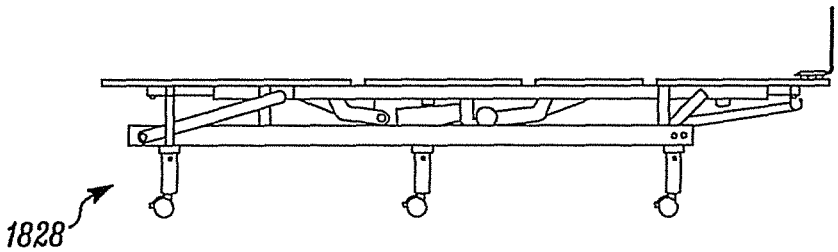
Figure 18E:
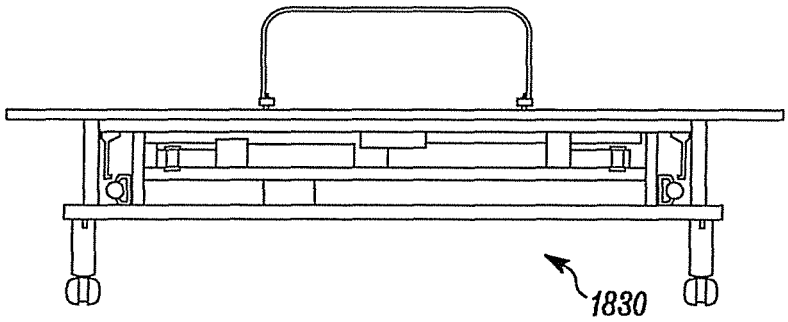
Figure 18F:
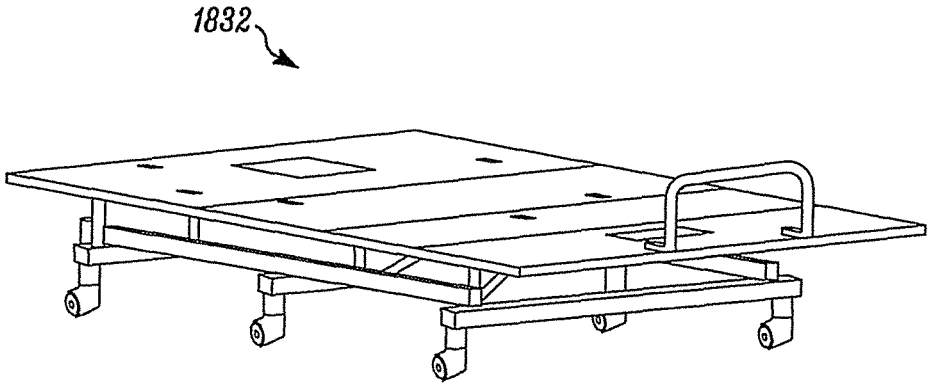

FIGS. 18A-F depicts the adjustable bed of FIGS. 17A-F with head, seat, and leg panels in a substantially horizontal common plane. This may be accomplished by extending actuator 1524 and retracting actuator 1712. FIG. 18A includes a bottom view 1820. FIG. 18B includes a top view 1822. FIG. 18C includes a head view 1824. FIG. 18D includes a side view 1828. FIG. 18E includes a foot view 1830. FIG. 18F includes a raised angular view 1832.

Figure 19A:
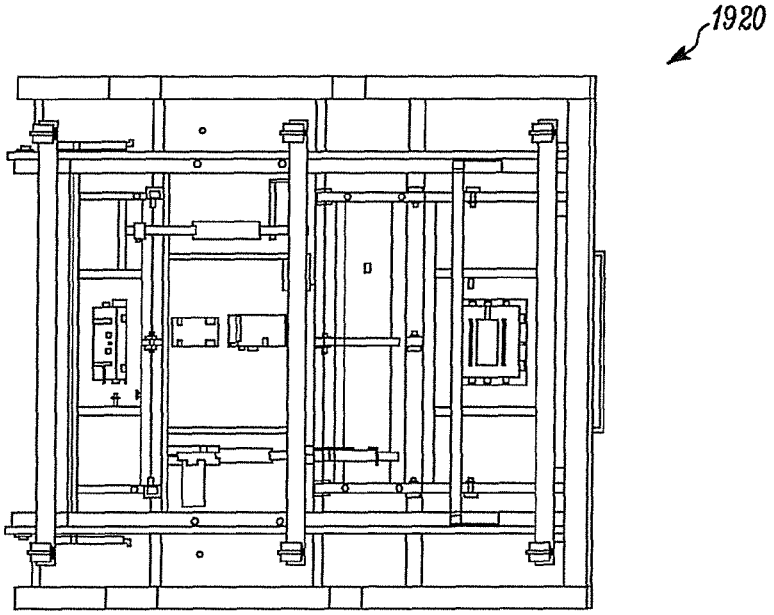
FIGS. 19A, 19B, 19C, 19D, 19E, and 19F show the bed of FIG. 17 with skirt panels.
Figure 19B:
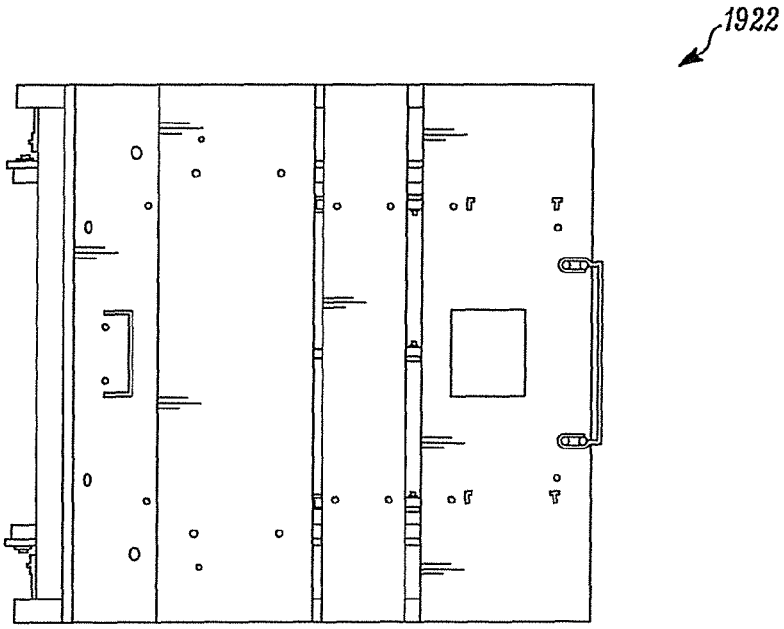
Figure 19C:
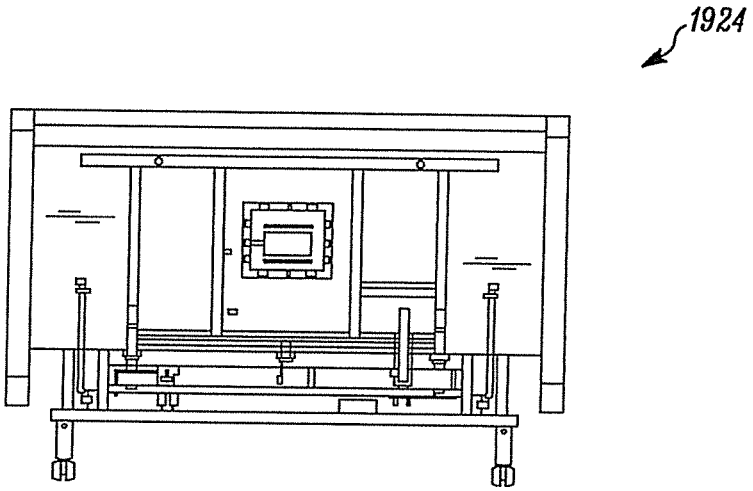
Figure 19D:
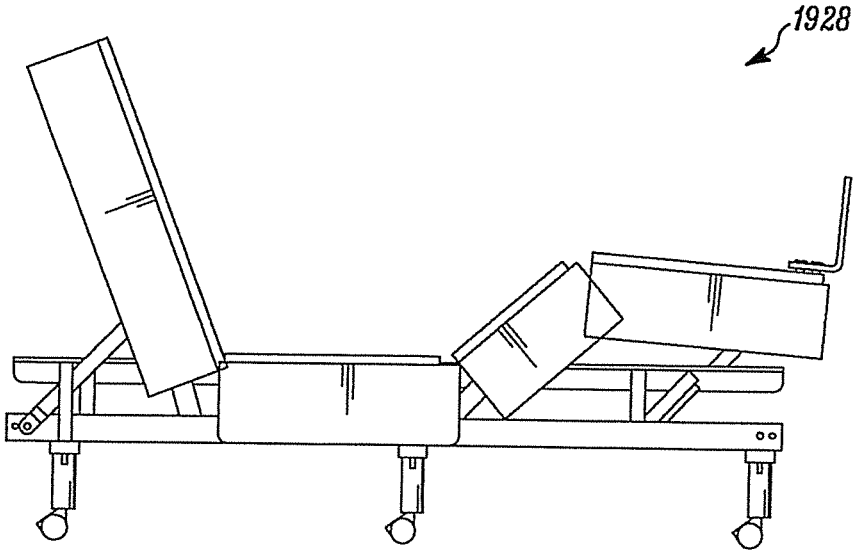
Figure 19E:
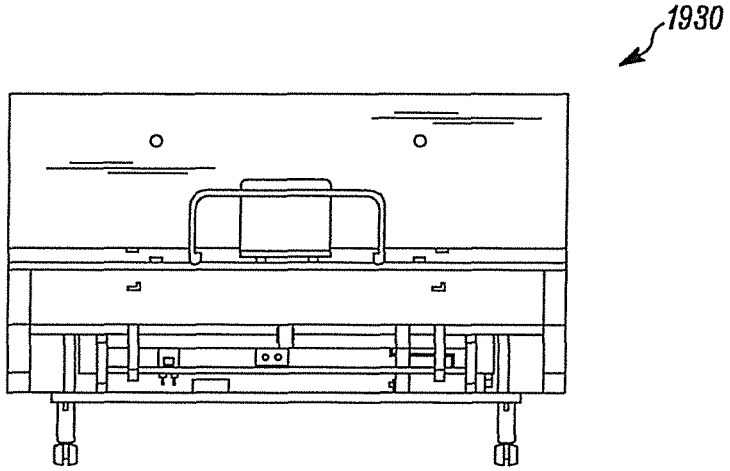
Figure 19F:
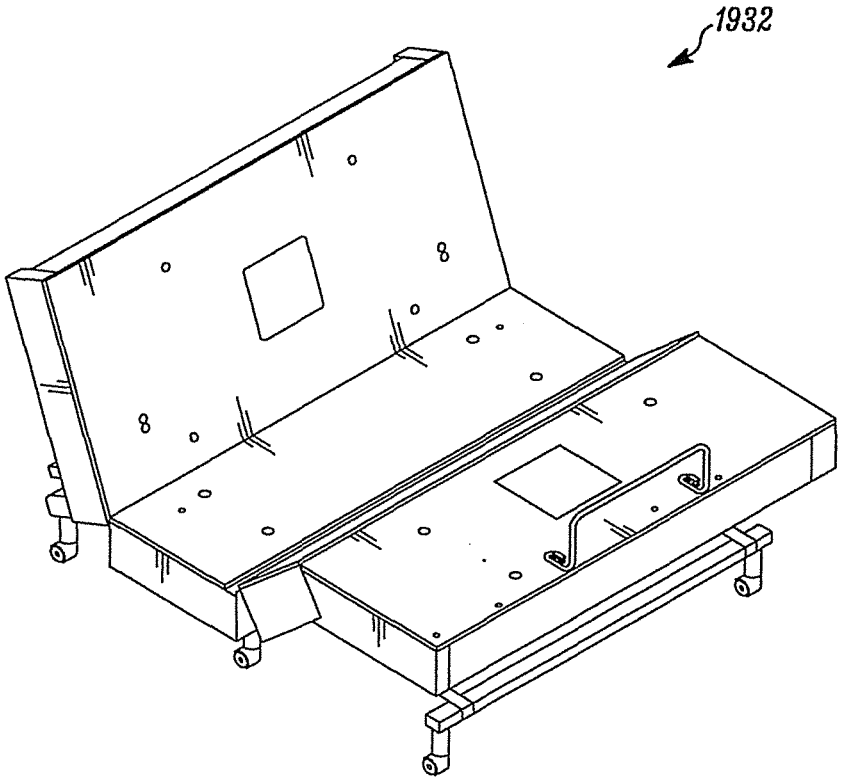

FIGS. 19A-F depict the adjustable bed of FIGS. 17A-F with skirt panels attached to outer edges of the head panel 1702, seat panel 1704, and leg panels 1708 and 1710. The skirt panels, as depicted, may enhance visual appearance and provide a barrier to the user from easily accessing the frame members and actuators. FIG. 19A includes a bottom view 1920. FIG. 19B includes a top view 1922. FIG. 19C includes a head view 1924. FIG. 19D includes a side view 1928. FIG. 19E includes a foot view 1930. FIG. 19F includes a raised angular view 1932.

Figure 20:
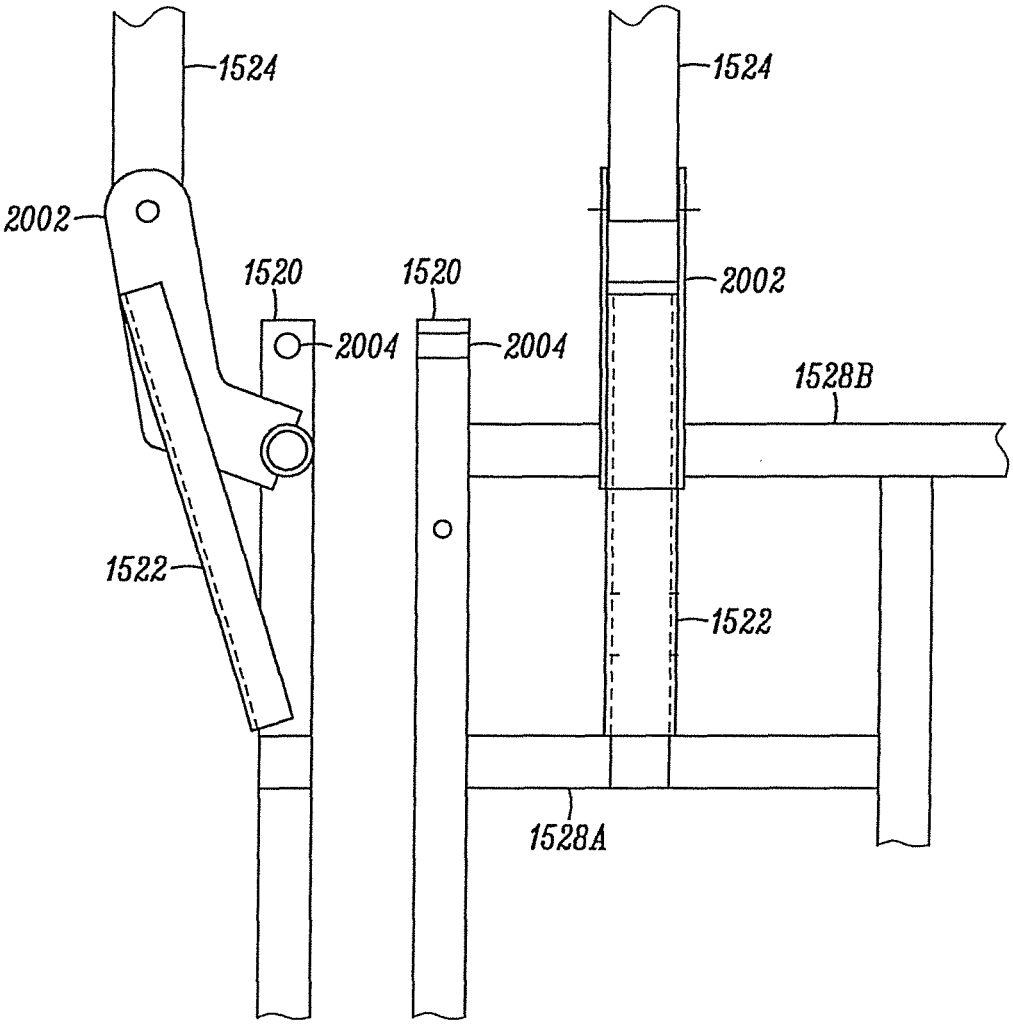
FIG. 20 shows a detail of a drive bracket assembly.

FIG. 20 depicts a detail of a portion of the bed frame 1500 that facilitates movement of either the head frame 1518 or the leg frame 1714 when the actuator is operated. Although the embodiment of FIG. 20 includes references for a head frame 1518 use, the same configuration can be used for facilitating movement of the leg frame 1714. In particular, an actuator bracket 2002 is connected to frame connector bracket 1528B. Downwardly facing extension frame member 1522 is rigidly connected to frame connector bracket 1528A at one end and the actuator bracket 2002 at the other. As actuator 1524 extends, actuator bracket 2002 applies a force to connector frame bracket 1527B and to downwardly facing extension frame member 1522 that transfers the force to connector frame bracket 1528A resulting in head frame 1518 rotating around the pivotable connection 2004 made by parallel side frame members 1520 and forward connector frame member 1508A.

Figure 21:
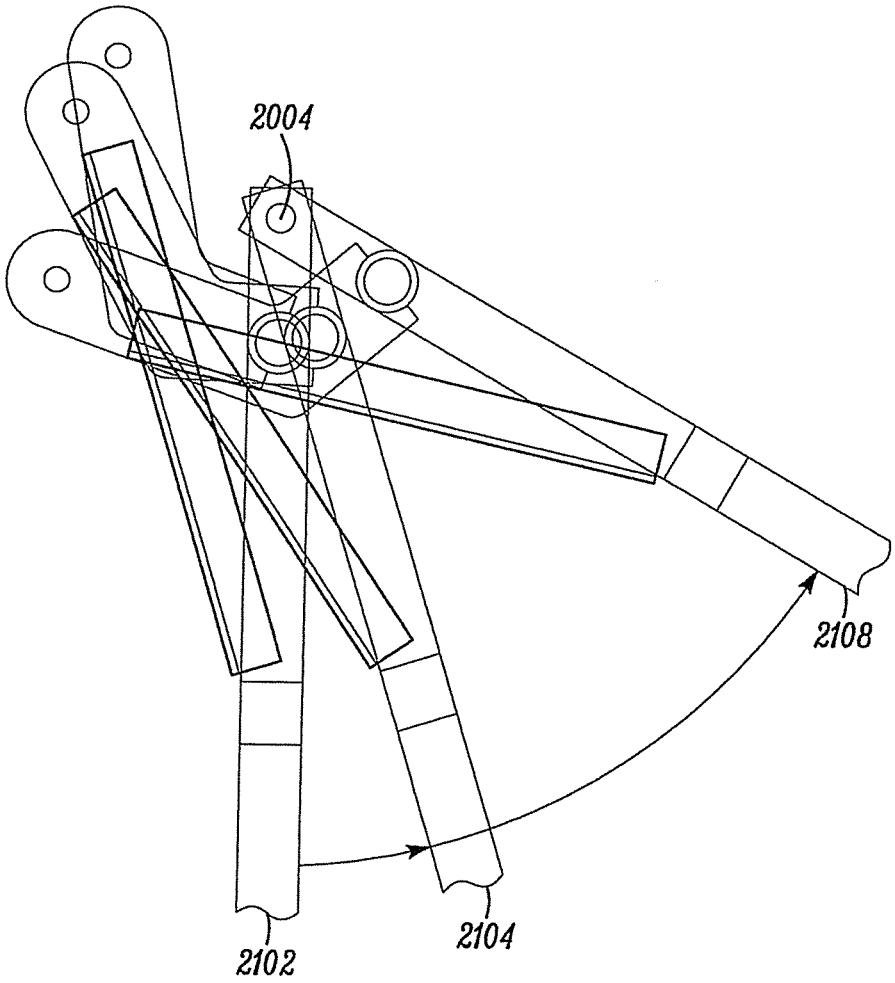
FIG. 21 shows various rotated positions of the drive bracket assembly of FIG. 20.

FIG. 21 depicts the operation of bracket 2002 through various extension positions of actuator 1524. Based on extension position of actuator 1524, head frame 1518 may be positioned in any position. Three representative positions 2102, 2104, and 2108 are depicted in FIG. 21.

Figure 22:
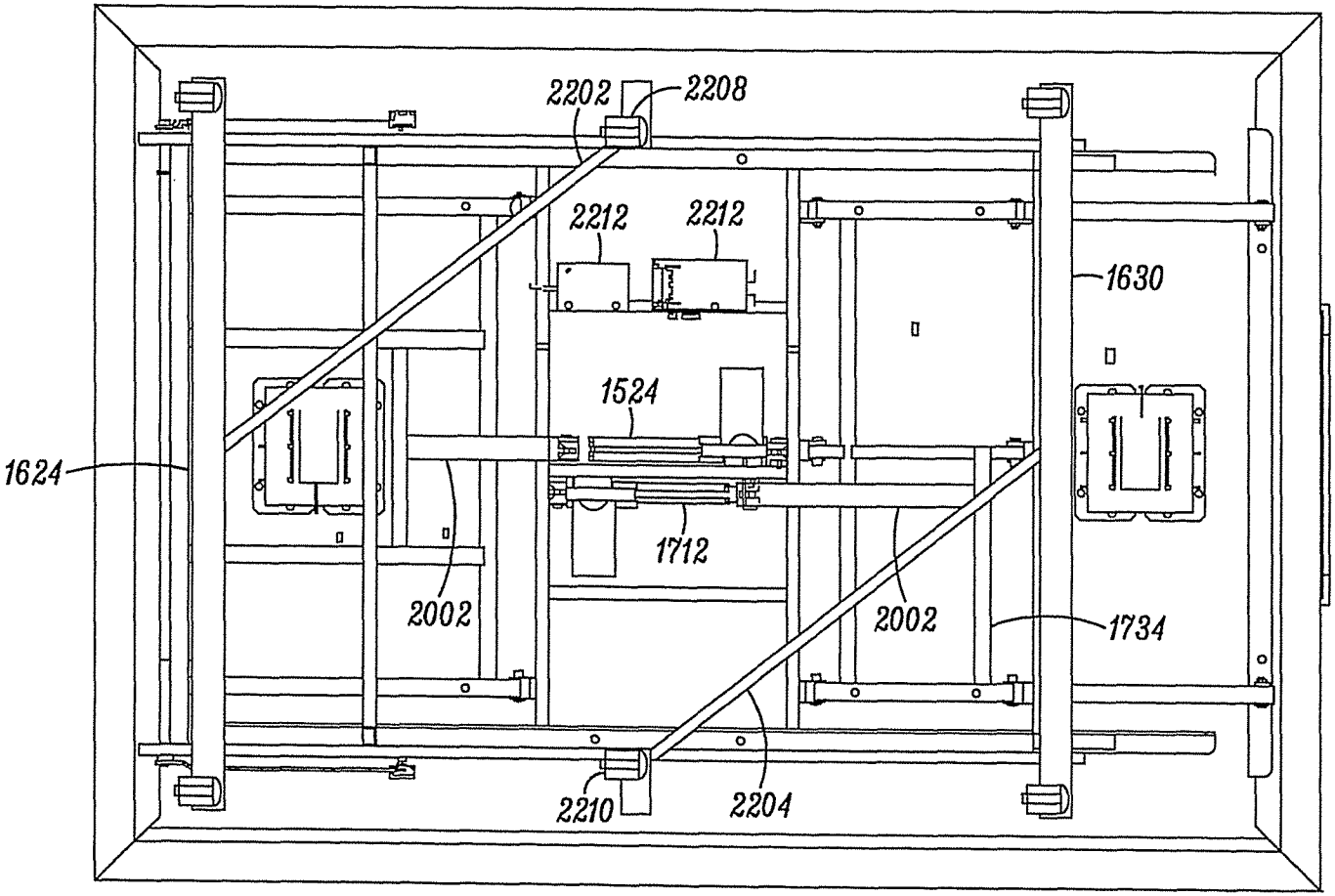
FIG. 22 shows an alternate embodiment of an adjustable bed frame that incorporates many elements from FIGS. 15-21.

FIG. 22 depicts an alternate embodiment of the adjustable bed fame assembly that incorporates many of the frame elements of FIGS. 15-21 wherein center lateral member 1628 is removed and diagonal support members 2202 and 2204 are added. Diagonal support member 2202 is connected at one end to a first side rail of base frame 1510 midway between lateral supports 1624 and 1630 and is connected at an opposite end to approximately the center of lateral support member 1624. Diagonal support member 2204 is connected at one end midway between lateral supports 1624 and 1630 to a second side rail of the base frame 1510 that is opposite the first side rail and at the opposite end to approximately the center of lateral support member 1630. Castors 2208 and 2210 are positioned approximately below the connection of each diagonal support member and each side rail of the base frame. The embodiment of FIG. 22 further includes actuator bracket 2002 assembled as described with respect to FIGS. 20 and 21.

FIG. 22 also shows actuators 1524 and 1712 positioned close to a center line of the bed to at least reduce the potential for rotational torque applied to an extending actuator. The centerline position of the actuators also enables control electronics 2212 to be positioned away from the center of the bed, thereby improving serviceability. In addition to eliminating center lateral support 1628, the adjustable bed frame of FIG. 22 also has a simplified foot frame 1714 that eliminates both foot support members 1732 and reduces the length of lateral thigh tube 1734 by approximately one-half.

FIG. 23A, FIG. 23B, FIG. 24, FIG. 25, FIG. 26, FIG. 27, FIG. 28, FIG. 29, FIG. 30, FIG. 31, FIG. 32A, FIG. 32B, FIG. 32C, FIG. 32D, FIG. 32E, FIG. 32F, and FIG. 32G all depict embodiments of an adjustable bed where only the head portion articulates. In certain embodiments described with respect to these figures, a truss is included for reinforcing the structure, however, embodiments of the adjustable bed where only the head portion articulates may not require a truss for stability, such as in FIG. 25. The adjustable bed in these embodiments resembles a flat foundation, however, in this case, a head board portion of the base frame can pivot when commanded to do so to raise a head portion of a mattress placed on top of the adjustable bed. The head board portion may pivot along a pivot point that may be in a top one-third of the base frame. In other embodiments, the head board portion may pivot along a pivot point that may be in a center one-third of the base frame. The base frame may form a box that completely encloses the adjustable mechanism for the bed including the center frame, head frame, actuator, and the like. In embodiments, the base frame may be made from wood. The base frame may be covered with fabric. Additionally, the head board portion of the base frame may also be covered with fabric. In its articulated position, fabric may conceal all of the inner workings of the adjustable bed, as shown in FIG. 28. In embodiments, foam may be disposed along the perimeter of the head board portion to cushion the interface of the head board with the surface of the base frame. In embodiments, the actuator may be a push-only motor to elevate the head board portion. In order to return to a flat position, the user may need to exert a pressure on the head board.

FIG. 23 depicts an alternate embodiment of the adjustable bed fame assembly with a truss-reinforced structure. In an embodiment, a steel skeleton may be disposed under the head and center of the adjustable bed facility 102. In an embodiment, the adjustable bed facility 102 may comprise a truss. The truss may be formed from at least two truss members that may be crossed to for an X shape. The truss may be disposed between the upper frame 2310 of the adjustable bed facility and the lower frame 2312 of the adjustable bed facility 102. For example, the truss may connect to the steel skeleton 114 and the foundation materials, such as oriented strand board (OSB), plywood, and the like, of the adjustable bed frame, which may comprise a bed deck 2304, head board 2318, upper frame 2310, lower frame 2312, and middle section 2314 (also known as center frame elsewhere). The truss members may be fastened together in the center of the X to give it more strength. The truss may box in a key area of the adjustable bed facility 102 and enable the adjustable bed facility 102 to support large amounts of weight.

In an embodiment, the adjustable bed facility 102 frame could be built with legs or without legs on the corners. If the adjustable bed facility 102 lacks legs, it can rest on a standard steel foundation 2308. Some steel foundations provide more support than others depending on where the crossbars are located, but the adjustable bed facility 102 may be operable with most steel foundations.

In an aspect, an adjustable bed facility 102 may comprise standard flat foundation materials. For example, the adjustable bed facility 102 may comprise wood strapping and 2×4s. In an alternative embodiment, the adjustable bed facility 102 may be made from any material, such as metal, steel, plastic, wood, fiberglass, and the like.

Figure 23A:
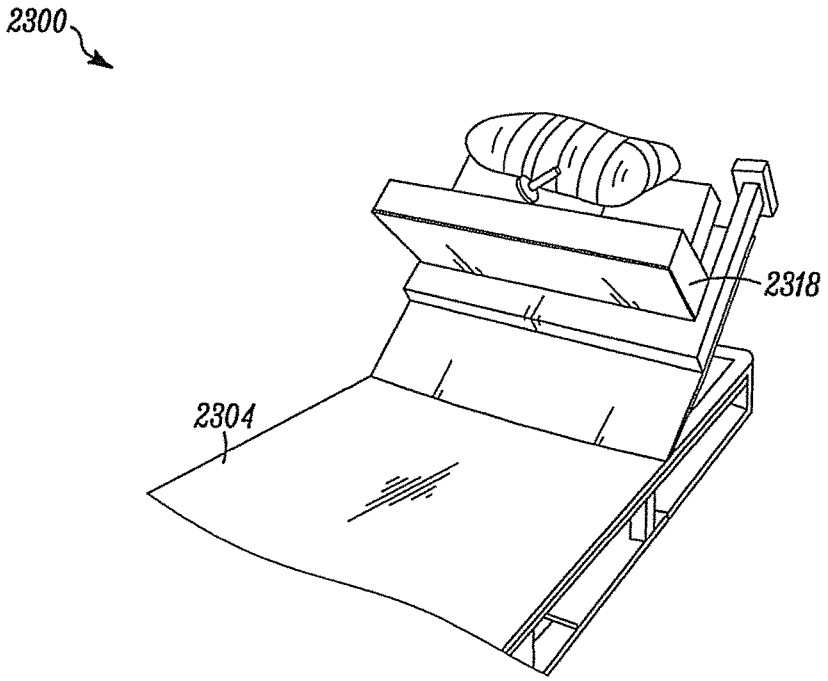
FIG. 23A depicts the adjustable bed facility supporting a weight on the head board and FIG. 23B depicts the adjustable bed facility supporting a weight on the head board and bed deck.
Figure 23B:
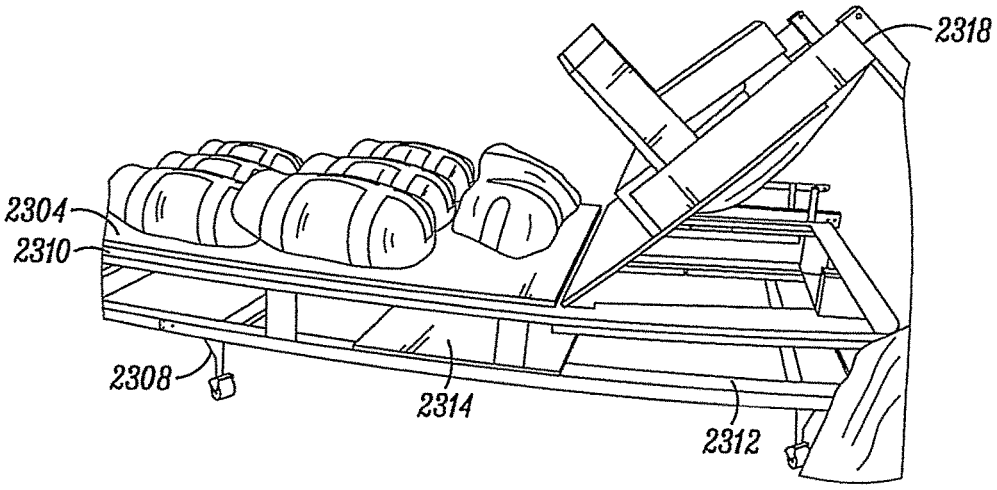

The adjustable bed facility 102 may support considerable weight. For example, in FIG. 23A, the head board 2318 is supporting 400 pounds of weight and in FIG. 23B, the head board 2318 of the adjustable bed facility 102 is supporting 400 pounds of weight and the bed deck 2304 is supporting 350 pounds. As can be seen in FIG. 23B, the adjustable bed facility 102 rests on and is supported on a standard steel foundation 2308. The truss 2402 may be disposed in the middle section 2314 between the lower frame 2312 and the upper frame 2310/bed deck 2304. The truss may be oriented such that the X shape formed by the truss is oriented along the length of the adjustable bed facility 102. In some embodiments, the truss 2402 may be oriented along the width of the adjustable bed facility 102. In some embodiments, the truss 2402 may be disposed anywhere along the bed deck 2304 portion of the adjustable bed facility 102. The truss 2402 may be connected to the skeleton 114, the bed deck 2304, the upper frame 2310, lower frame 2312, middle section 2314, or any combination thereof. In some embodiments, the actuator 104 may also be connected to the truss 2402.

In operation, when the adjustable bed facility is fully extended, the head board 2318 rests on the upper fame 2310 of the adjustable bed facility. When the adjustable bed facility 102 is operated, the head board 2318 may lift away from the upper frame 2310. For example, the head board 2318 and bed deck 2304 may be hinged or otherwise connected such that the head board 2318 is pivotally connected to the bed deck 2304. In some embodiments, the upper frame 2310, lower frame 2312, and bed deck 2304 may remain motionless. In other embodiments, the bed deck 2304 may be divided into a center frame and a leg frame portion so that there may be additional motions possible for the adjustable bed facility 102. In an embodiment, when the skeleton 114 is connected to the truss 2402, the weight of a user against the head board 2318 and bed deck 2304, either in the fully extended or head board-lifted positions, are more supported than if no truss 2402 were present.

Figure 24:
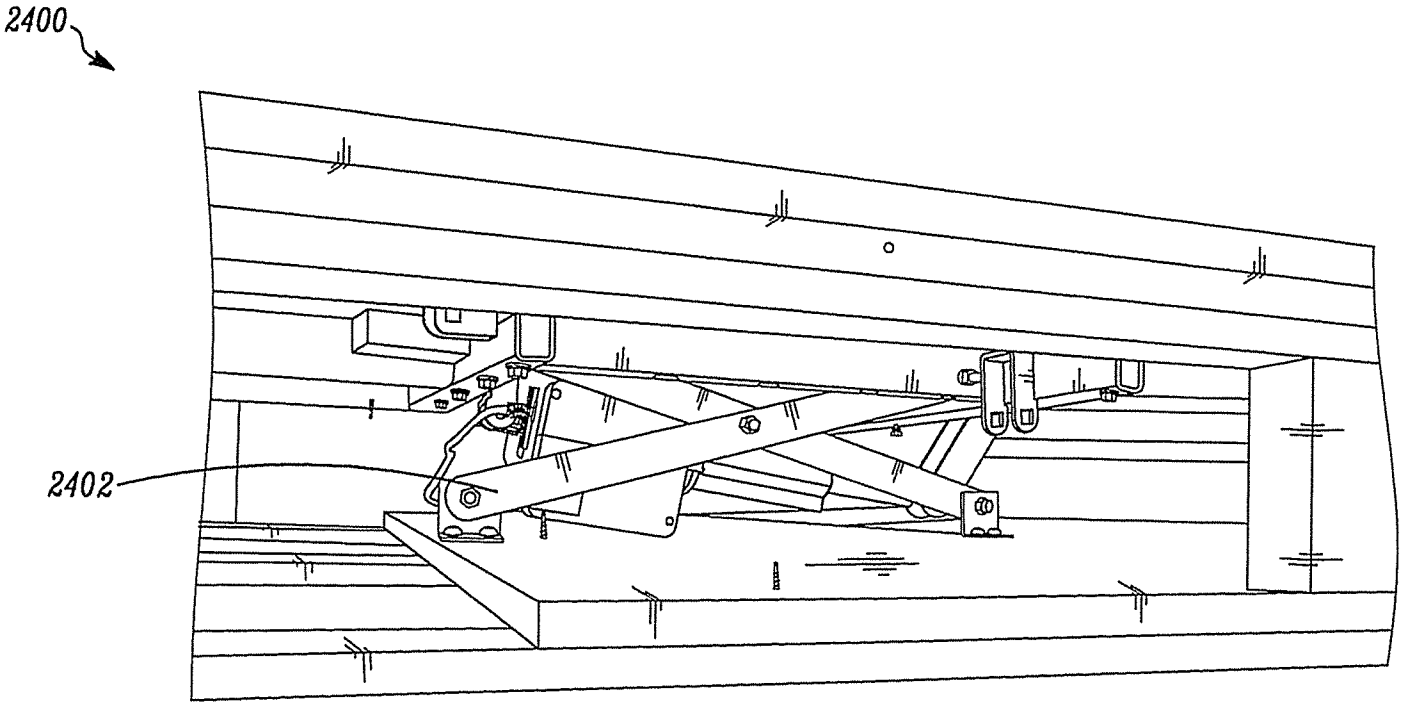
FIG. 24 depicts the truss structure of the adjustable bed facility.

Referring to FIG. 24, the truss 2402 is disposed between the upper frame 2310 and lower frame 2312 of the adjustable bed facility. In an embodiment, the truss is secured to both the upper frame 2310 and lower frame 2312 using a fastener, such as a screw, nail, bolt, staple, and the like. In some embodiments, the truss 2402 is secured to the bed deck 2304 as well.

Figure 25:
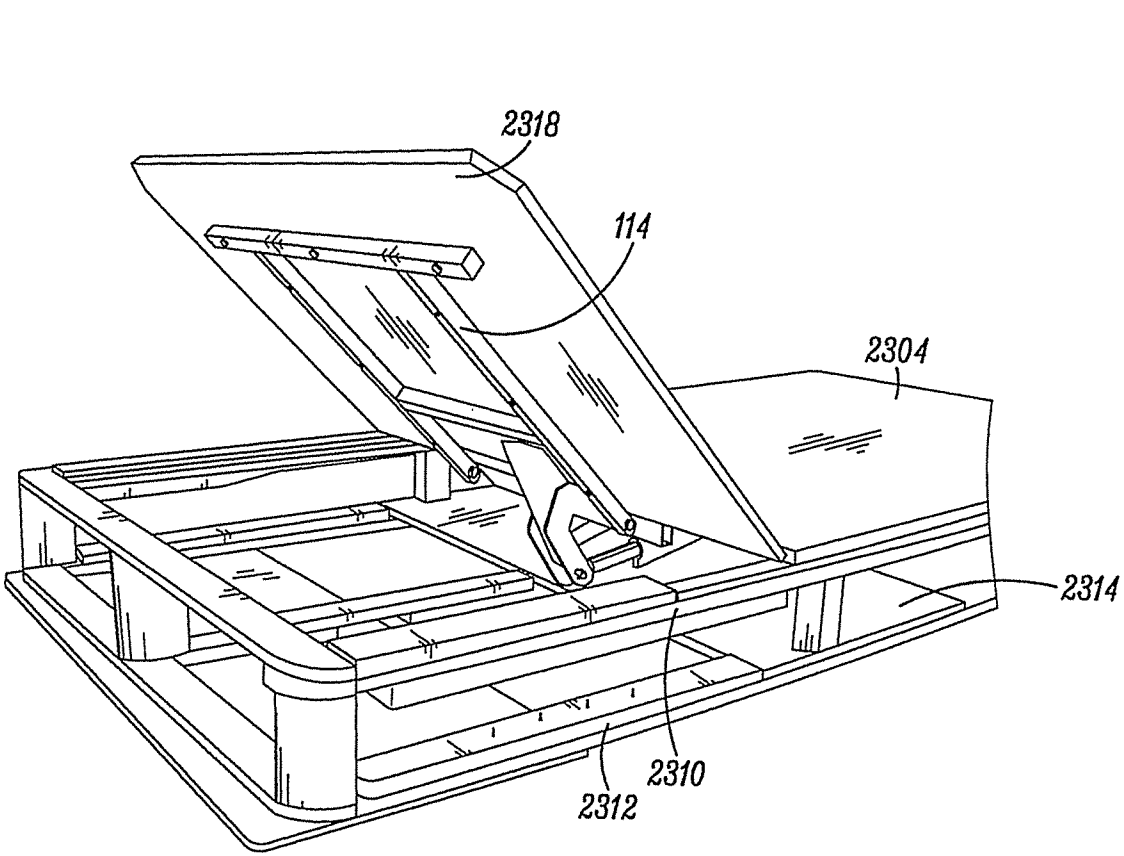
FIG. 25 depicts the steel skeleton of the adjustable bed facility.
Figure 26:
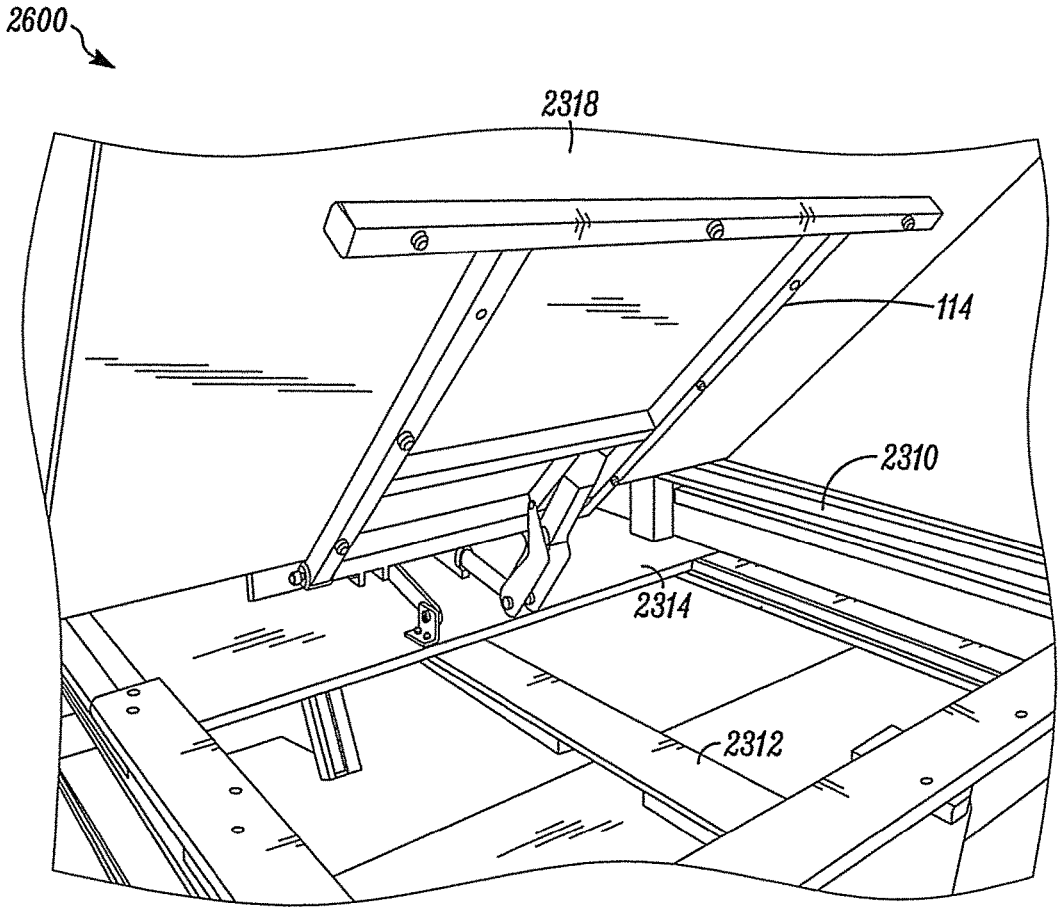
FIG. 26 depicts an alternate view of the steel skeleton of the adjustable bed facility.

Referring to FIG. 25, the adjustable bed facility 102 may comprise a skeleton 114. The skeleton 114 may provide structural support for the adjustable bed facility 102 and the physical connection between the head board 2318 and the lift facility (not shown). The skeleton 114 may be secured to the head board 2318 through certain attachment points, and secured to the middle section 2314, bed deck 2304, upper frame 2310 and/or lower frame 2312 using a fastener, such as a screw, nail, bolt, staple, and the like. The truss 2402 may be part of the skeleton 114. In FIG. 25, the adjustable bed facility 102 is shown in the lifted position, with the skeleton 114 attached to at least the head board 2318 and the middle section 2314. FIG. 26 shows an alternate angle of the adjustable bed facility 102 in a lifted position. The head frame portion of the skeleton attached to the head board 2318 includes parallel side frame members 2604 and a connecting frame member 2602. The head frame portion of the skeleton 114 may be pivotally connected 2608 to the skeleton 114 in a center portion of the bed. In embodiments, the connecting frame member 2602 may extend the width of the head board 2318.

Figure 27A:
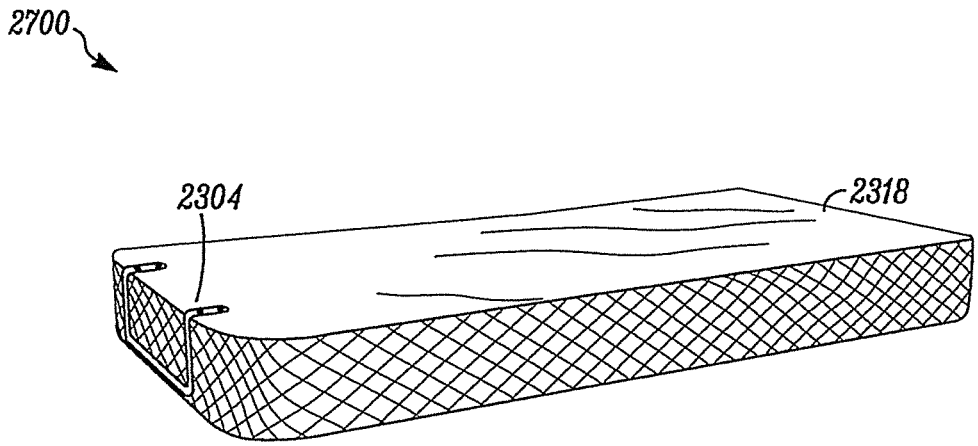
FIGS. 27A and 27B depict a covered adjustable bed facility in the A) fully extended and B) head board lifted positions.
Figure 27B:
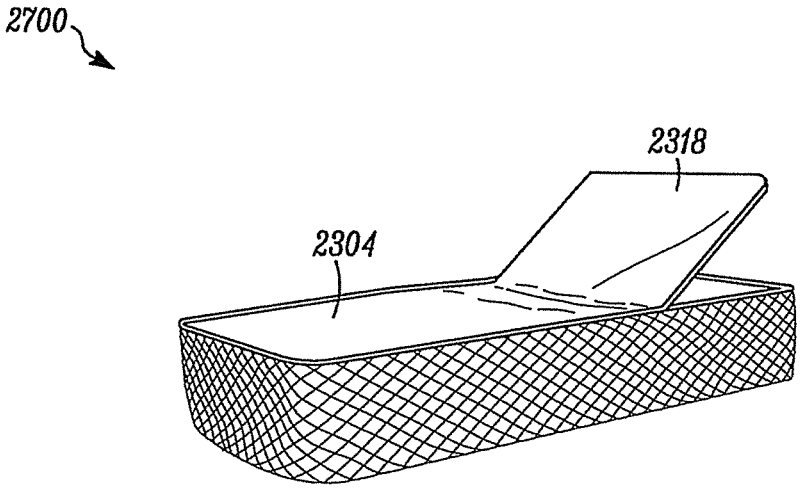
Figure 28:
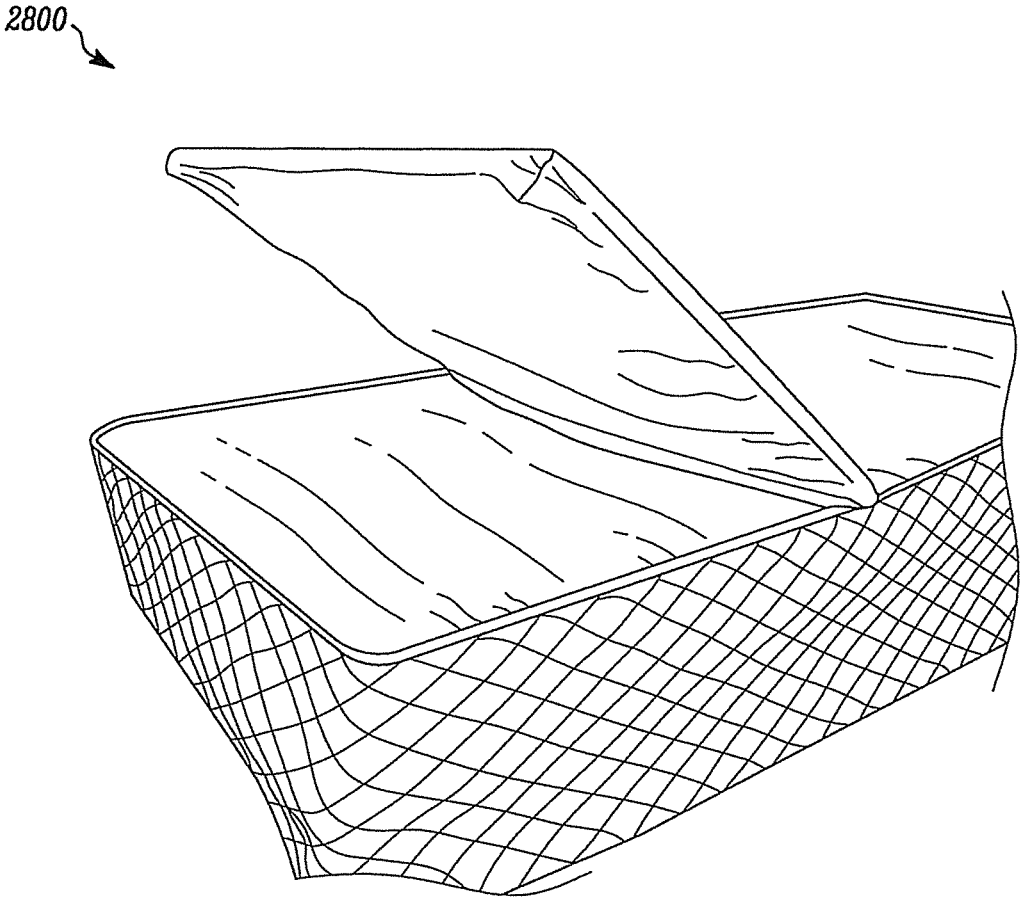
FIG. 28 depicts a covered adjustable bed facility in the head board lifted position.

Referring to FIG. 27, the truss-reinforced adjustable bed facility 102 is shown with a mattress cover. The adjustable bed frame is covered with a mattress fabric. Additionally, the bed deck 2304 and head board 2318 may be additionally covered in a mattress cushioning for the user's comfort. In FIG. 27A, the head board 2318 is fully extended. In FIG. 27B, the head board 2318 has been lifted, as has been described herein. The head board 2318 lifts away from the upper frame 2310. For example, the head board 2318 and bed deck 2304 may be hinged such that the head board 2318 rotates around the axis of the hinges while the upper frame 2310, lower frame 2312, and bed deck 2304 remain motionless. In FIG. 27, the head board 2318 has its own covering so that when it lifts, the portion of the adjustable bed facility 102 that remains motionless is also covered. This may also be seen in an alternate view of the head board 2318 lifted position in FIG. 28.

The truss reinforced adjustable bed facility 102 may comprise any number of components described herein, such as actuators 104, springs 108, mattresses 110, a sub-frame 112, a skeleton structure 114, vibration motors 118, supports 120, safety brackets 122, an electronic facility 124, an air purification facility 144, a remote 148, a memory facility 150, a memory connection 160, a network connection 162, and the like. In an embodiment, the electronic facility 124 may include a wire harness 128, a receiver 130, modular controls 132, a control box 134, power outlets 138, a power connection 142, and the like. In an embodiment, the memory facility 150 may include a receiver learn facility 152, bed memory 154, a backup battery 158, and the like. In an embodiment, the receiver learn facility 152, bed memory 154, and backup battery 158 may not be part of the memory facility 150, but may be combined into other facilities or devices, be stand-alone devices, or the like. In an embodiment, the physical aspects of the truss-reinforced adjustable bed facility 102 that provide support for the user may include the actuators 104, springs 108, mattresses 110, a sub-frame 112, a skeleton structure 114, vibration motors 118, supports 120, and safety brackets 122.

Figure 29:
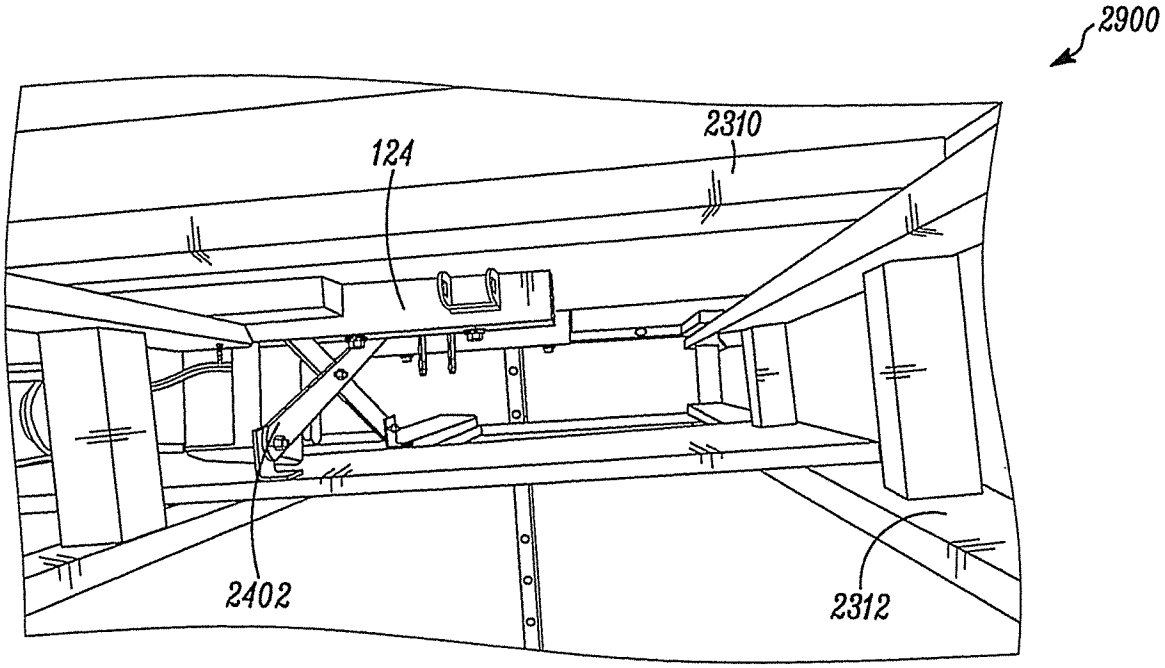
FIG. 29 depicts a view of the truss down the length of the adjustable bed frame.

Referring to FIG. 29, a view of the truss 2402 is shown looking down the center of the adjustable bed frame lengthwise. The truss 2402 is attached to the middle section 2314, between the lower frame 2312 and the upper frame 2310/bed deck 2304.

Figure 30:
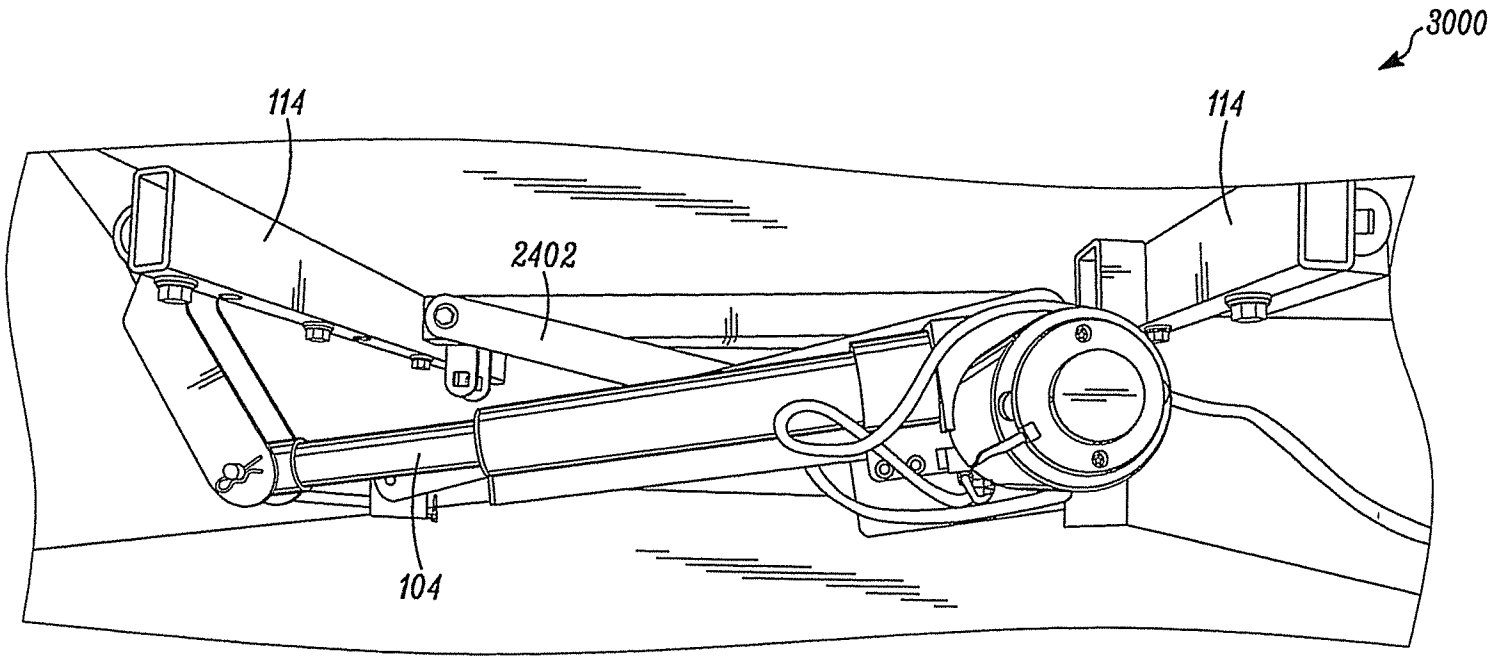
FIG. 30 depicts a view of the truss down the width of the adjustable bed frame.
Figure 31:
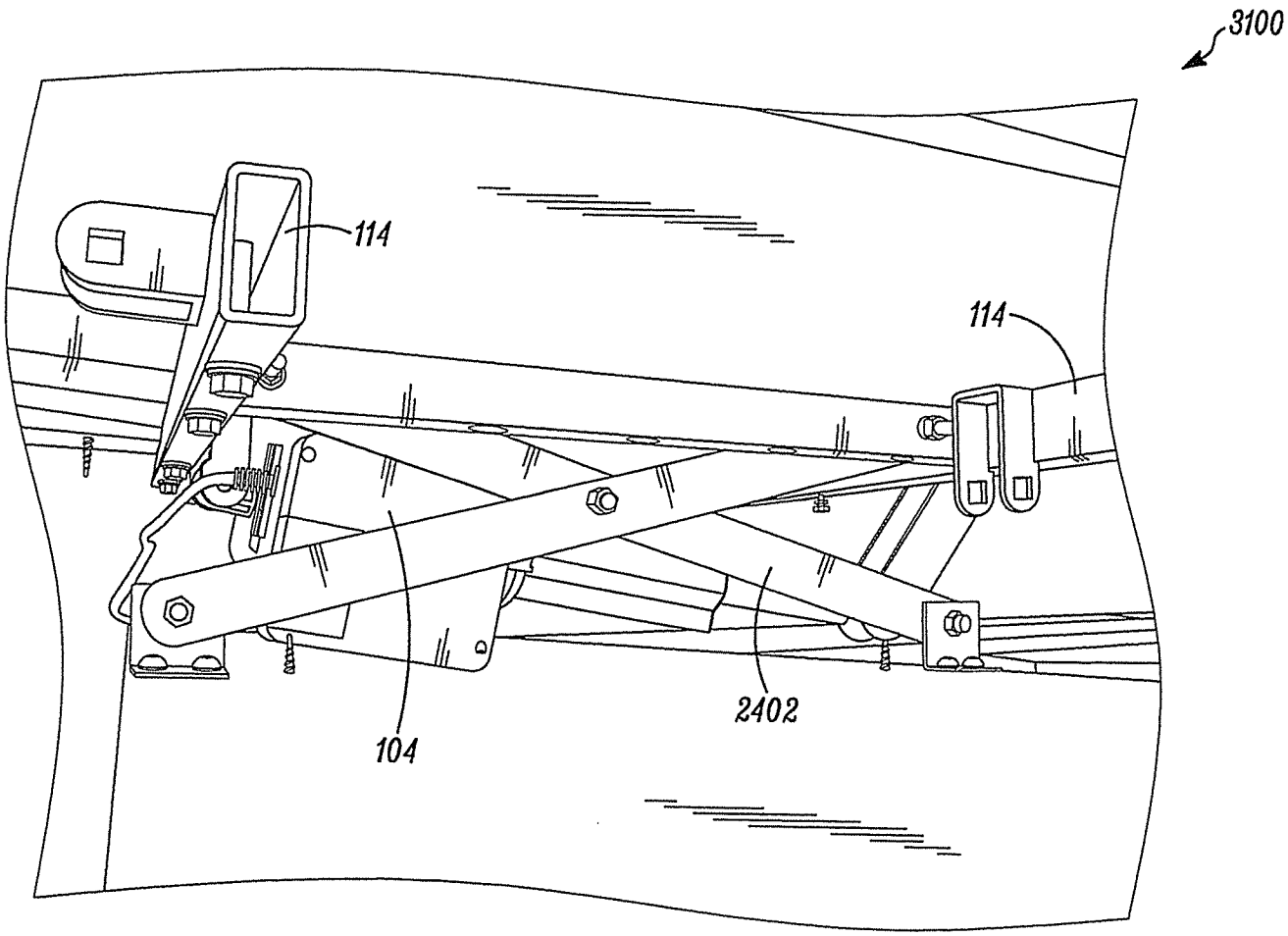
FIG. 31 depicts a view of the truss down the width of the adjustable bed frame.

Referring to FIG. 30, looking down the center of the adjustable bed frame width-wise, the truss 2402 is fastened to at least two places on the skeleton 114 and to the middle section 2314 of the adjustable bed frame. An actuator 104 is shown in the foreground, partially obstructing the view of the truss 2402. Referring to FIG. 31, the truss 2402 is now seen from the opposite side of the adjustable bed frame, still looking down the center width-wise. The fastener at the center of the X structure of the truss 2402 is clearly visible in this view.

Figure 32A:
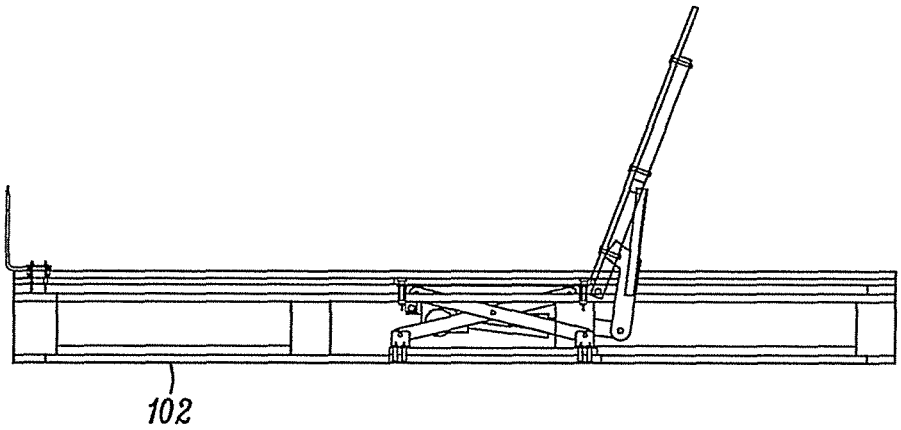
FIG. 32A, FIG. 32B, and FIG. 32C depict different structural views of the adjustable bed facility in accordance with an embodiment of the present invention.
Figure 32B:
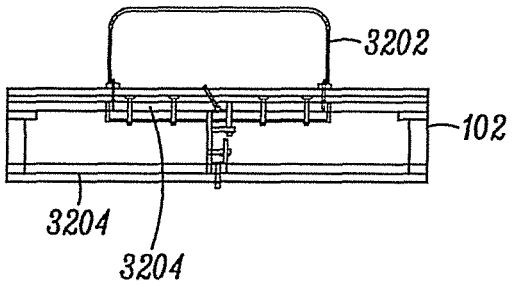
Figure 32C:
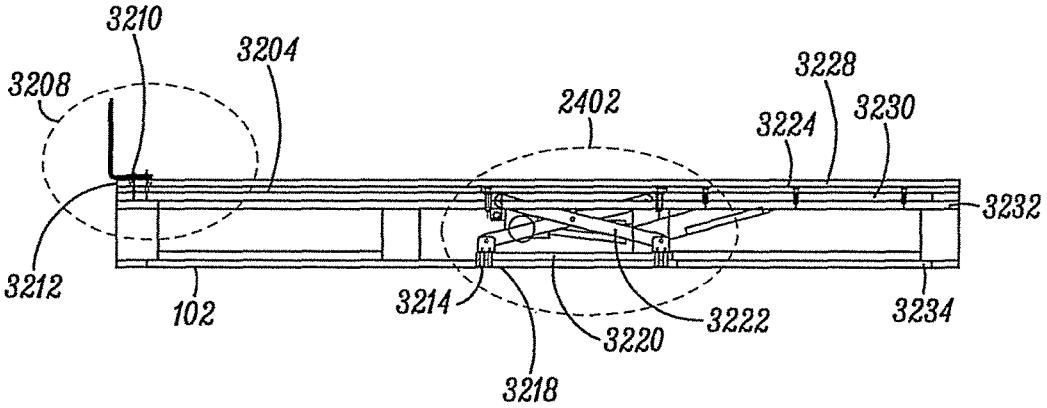

In embodiments, referring to FIG. 32A and FIG. 32B, structural views of the adjustable bed facility 102 may be provided. The adjustable bed facility may have a mattress support section 3208 and a truss 2402. As shown in FIG. 32C, the mattress support section may have a screw 3210 to tighten/loosen the mattress retained by bar 3202. In embodiments, the screw may be a wooden screw 3212. In addition, a foot and back deck 3204 is also represented in the FIG. 32C. Moreover, FIG. 32C represents a rail 3230, rail 3232, foam 3228, cross bars 3234, decks 3224, and the like. In embodiments, the rail 3230 may have a 19 mm*32.5 mm as its dimensions. In embodiments, the rail 3232 may have 19 mm*65 mm as its dimensions. These structural elements may support the adjustable bed facility 102. The deck 3224 may be made up of wood, plastic, and the like.

Figure 32D:
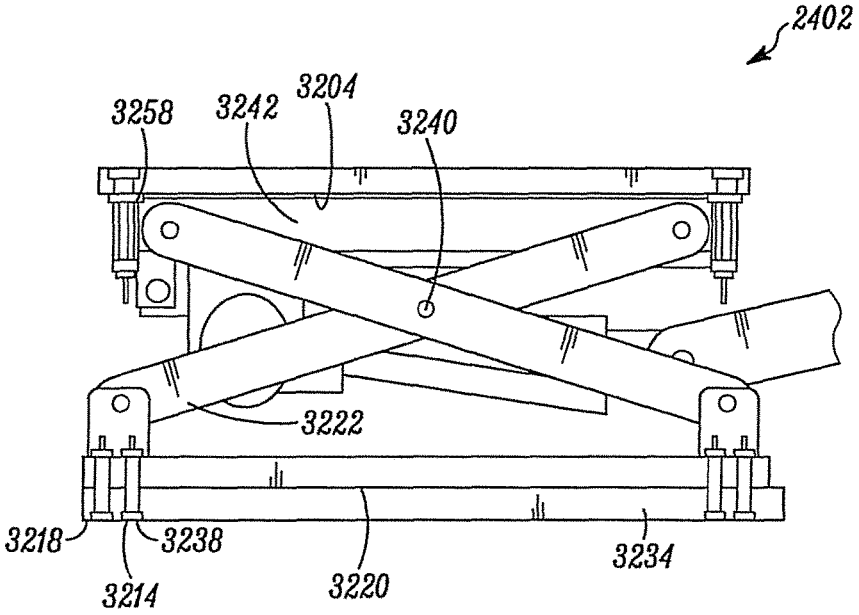
FIG. 32D and FIG. 32E depict the different structural views of the truss of the adjustable bed facility in accordance with an embodiment of the present invention.
Figure 32E:
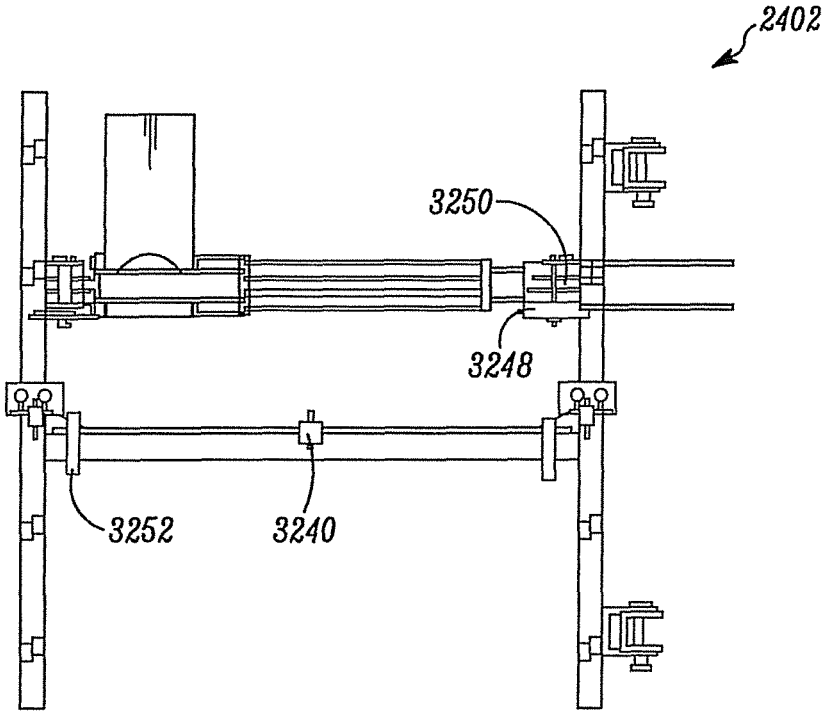

In embodiments, as shown in FIG. 32C, FIG. 32D, and FIG. 32E, the truss 2402 may include lower deck 3220, stabilizing bar 3222, an bracket 3218, a screw 3214, a tee nut 3238, a shoulder screw 3240, a vertical bar 3242, a bottom rail 3234, cross bars 3258, a plastic washer 325, an 'R' clip 3248, a motor pin 3250, and the like. In embodiments, as shown in FIG. 32E, the stabilizing bars 3222 may be connected to the bottom rail 3234 using the tee nut 3238, 'L-bracket' 3238, and the screw 3214. The stabilizing bars 3222 may be crossly connected to each other by using the shoulder screw 3234. The foot and back deck 3204 and the vertical bar 3242 may support the stabilizing bars 3222. In embodiments, the stabilizing bars 3222 may support the adjustable bed facility 102. For example, the user may put a heavy load on the adjustable bed facility 102. The stabilizing bar 3222 and the cross bars 3258 may absorb the pressure of the heavy load and may stabilize the adjustable bed facility 102. In embodiments, as explained above, the truss 2402 may help the bed to attain the position in the FIG. 32A from the FIG. 32D.

Figure 32F:
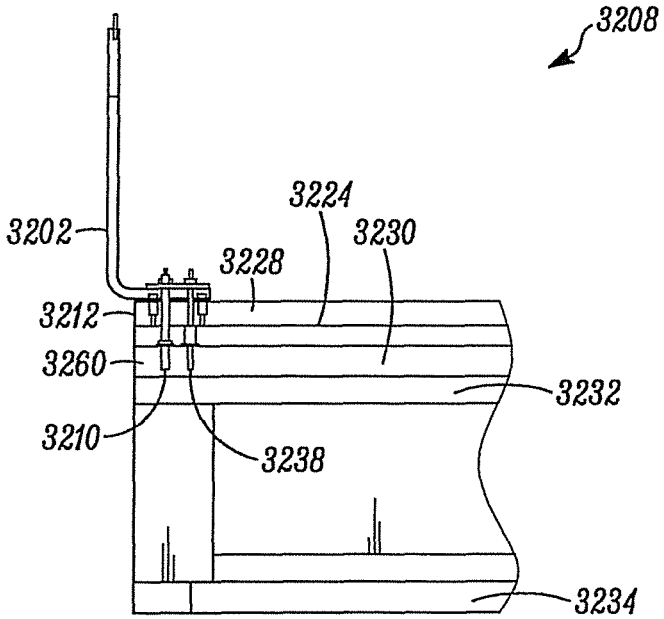
FIG. 32F depicts a side view of the adjustable bed facility in accordance with an embodiment of the present invention.

In embodiments, as shown in FIG. 32F, the mattress support section 3208 may include the mattress retained bar 3202, wood screw 3212, an end rail 3260, the screw 3210, a tee nut 3238, a foam 3228, decking 3224, the rail 3230, the rail 3232, a bottom rail 3234, and the like. It may be noted that the mattress support section may be shown to have only the above stated structural components. Those skilled in the art, however, may appreciate that the mattress support section may have lesser or more number of structural components.

In embodiments, the decking 3228 may be placed on the rail 3230. The mattress retained bar 3202 may support the mattress on the adjustable bed facility 102. The screw 3210 and the tee nut 3238 may hold the rail 3230, the rail 3232, and the end rail 3260. On loosening the screw 3210 and the tee nut 3238, the rails may be adjusted as per requirement.

Figure 32G:
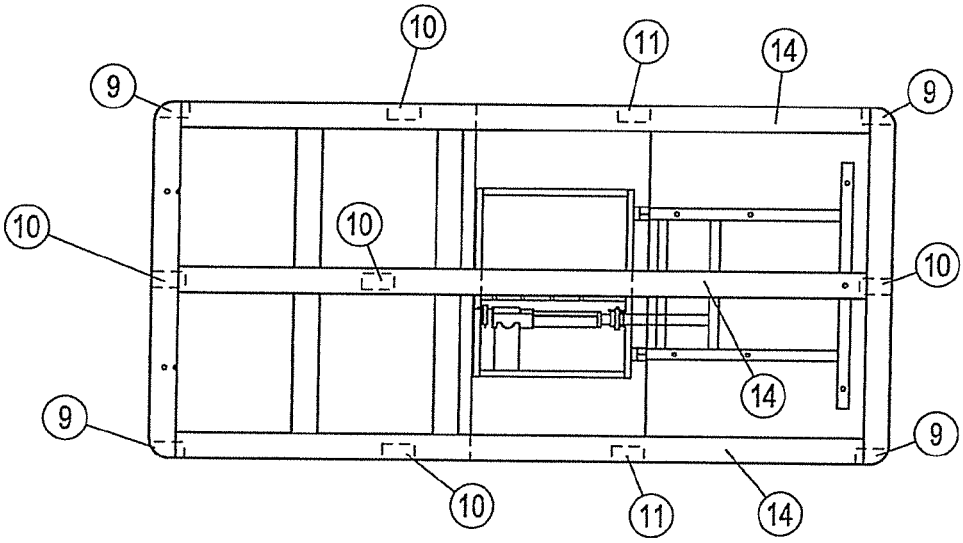
FIG. 32G depicts a top view of the adjustable bed facility in accordance with an embodiment of the present invention.

In embodiments, a top view of the adjustable bed facility 102 may be provided in FIG. 32G.

Figure 33:
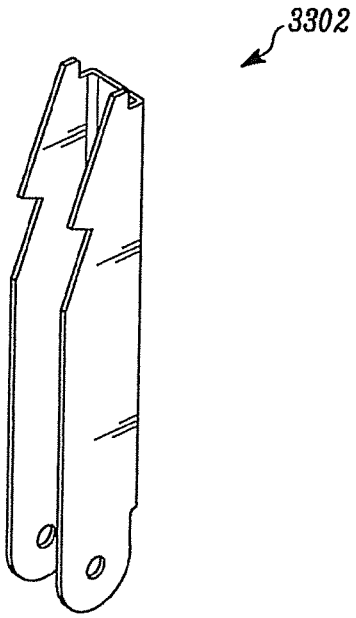
FIG. 33 depicts a motor connection.

In an embodiment, the adjustable bed facility 102 may have a motor mechanism connection that includes an extra tube for support. The support tube may be welded to the motor connection bracket and the steel skeleton for added support. FIGS. 34-39 depict an adjustable bed facility 102 including the support tube. Additionally, the adjustable bed facility 102 in these figures does not include wall-hugging capability or massage motors, however, it should be understood that the support tube may be included in any adjustable bed facility 102 described herein or not described herein. FIG. 33 depicts a motor connection bracket 3302. The motor connection bracket 3302 may be connected on an end to the motor and on another end to the headboard or a lever arm associated with the headboard.

Figure 34:
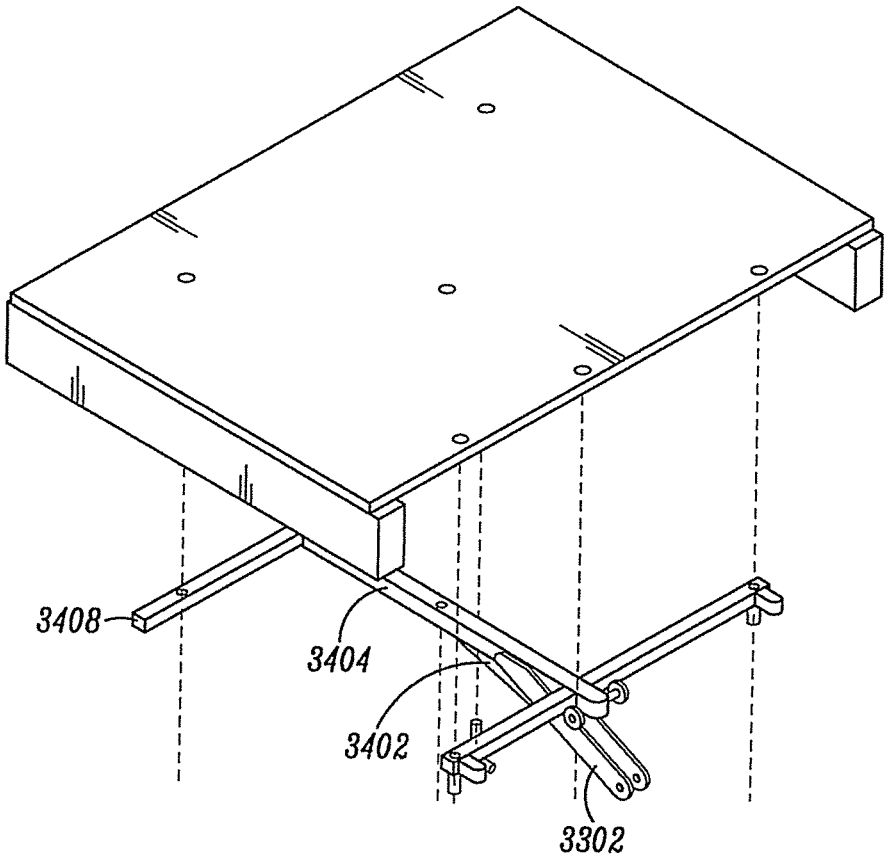
FIG. 34 depicts the connections to a head board of the bed assembly.

FIG. 34 depicts how the head board of the adjustable bed facility connects to the motor. The motor connection bracket 3302 is shown along with the support tube 3402. The support tube 3402 connects on one end to the motor connection bracket 3302 and on another end to a vertical skeleton structure 3404. In this embodiment, only one vertical skeleton structure is shown but it should be understood that multiple vertical skeleton structures connected to the head board are possible and within the scope of this disclosure. The vertical skeleton structure may be connected to a horizontal skeleton structure 3408. The support tube 3402 provides additional support for the motor connection bracket 3302. As the motor operates and pushes the end of the motor connection bracket 3302 to rotate it, the headboard is also rotated to a vertical position. The support tube 3402 provides additional support to the motor connection bracket 3302 as pressure is transmitted through it by the rotation of the end connected to the motor.

Figure 35A:
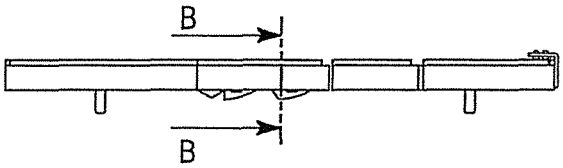
FIG. 35A depicts a side view of the bed with the support tube.
Figure 35B:
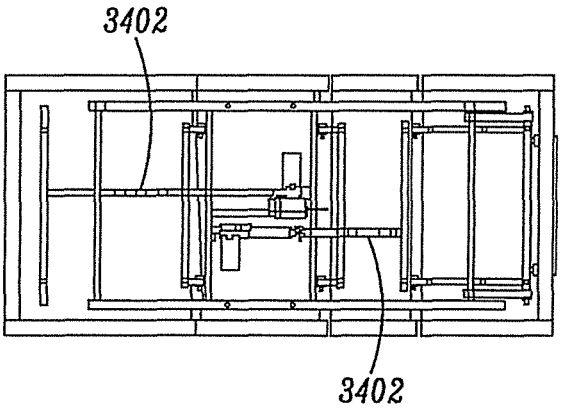
FIG. 35B depicts an underside view of the bed with the support tube.
Figure 35C:
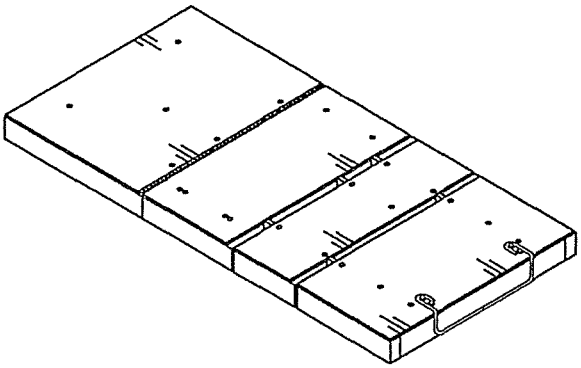
FIG. 35C depicts a top view of the bed with the support tube.
Figure 36:
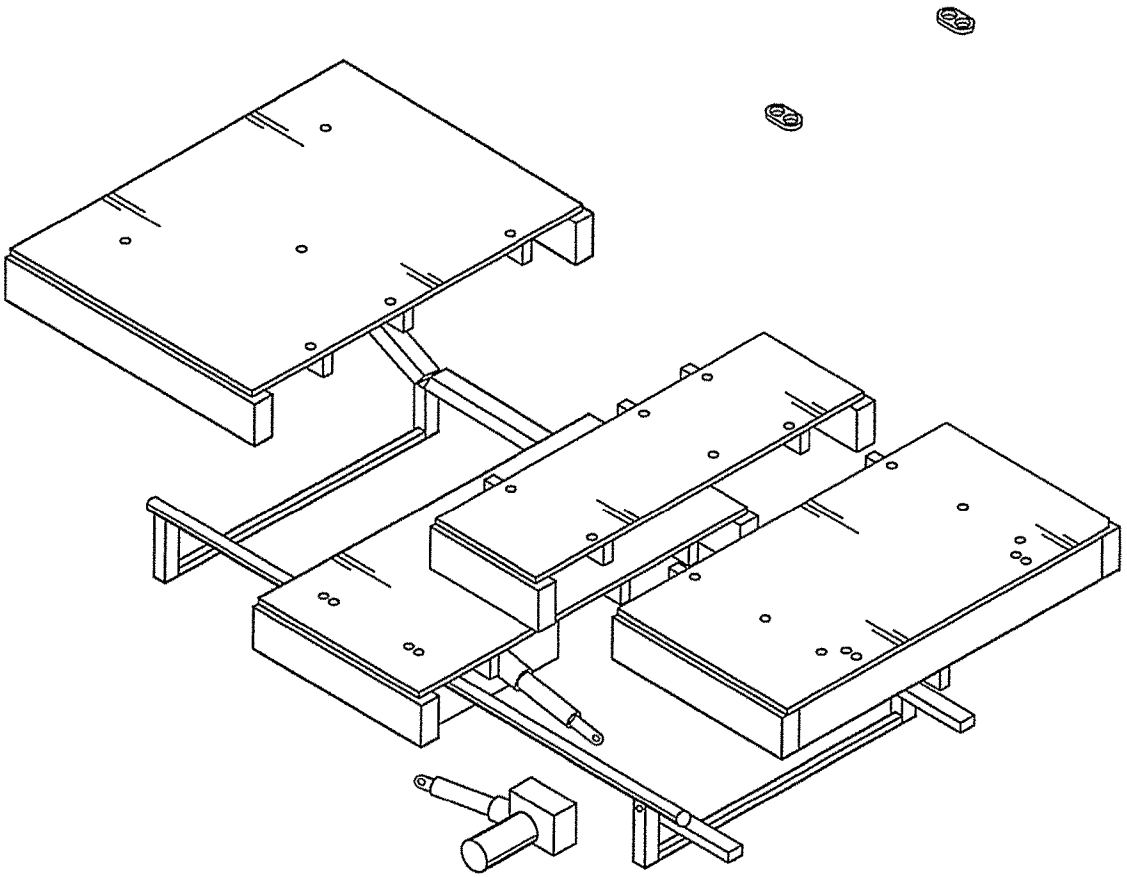
FIG. 36 depicts an exploded view of the bed with support tube.
Figure 37:
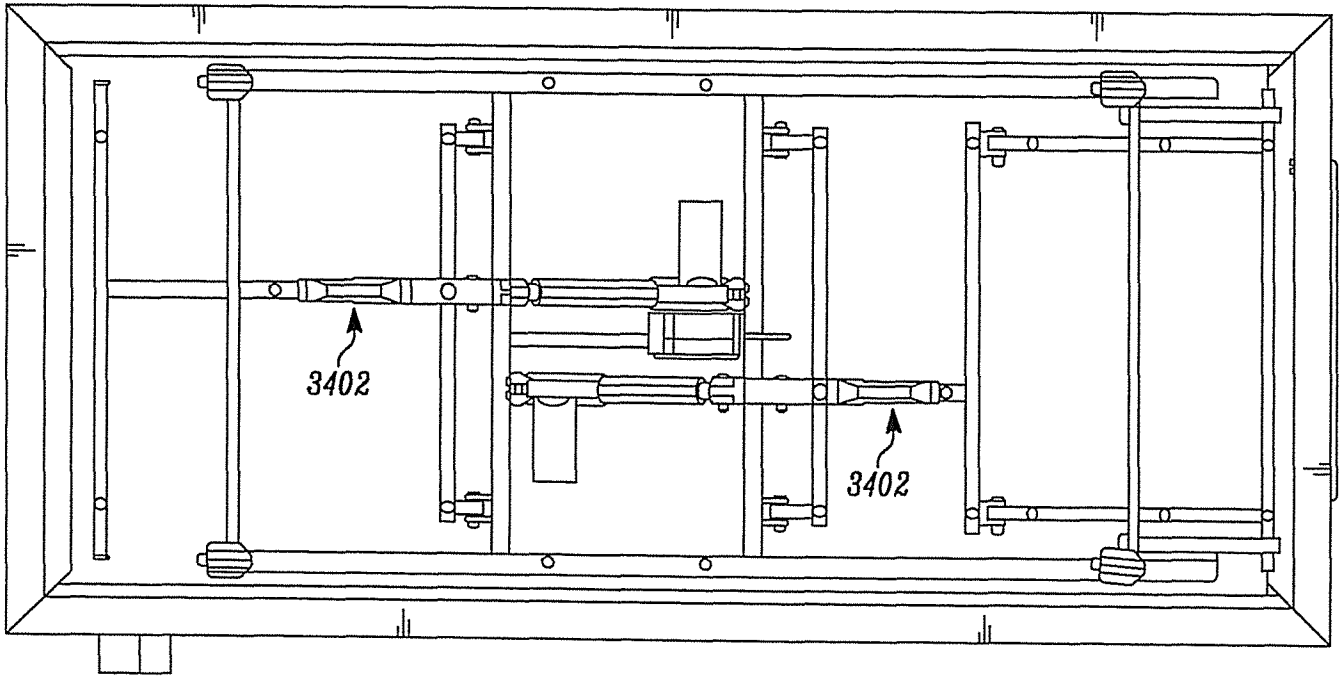
FIG. 37 depicts an underside view of the bed assembly with support tube.
Figure 38A:
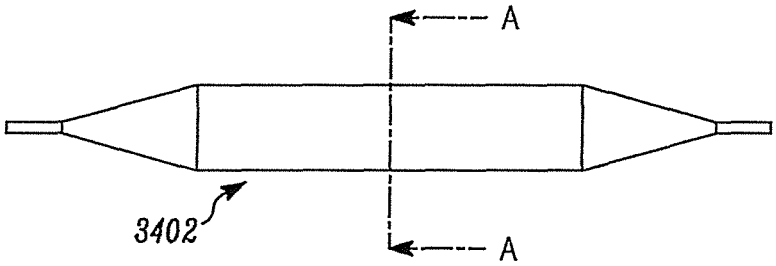
FIG. 38A depicts a side view of the support tube.
Figure 38B:
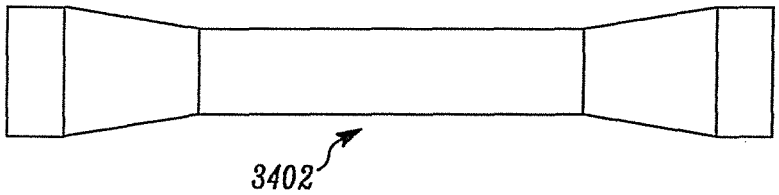
FIG. 38B depicts a top view of the support tube.
Figure 38C:
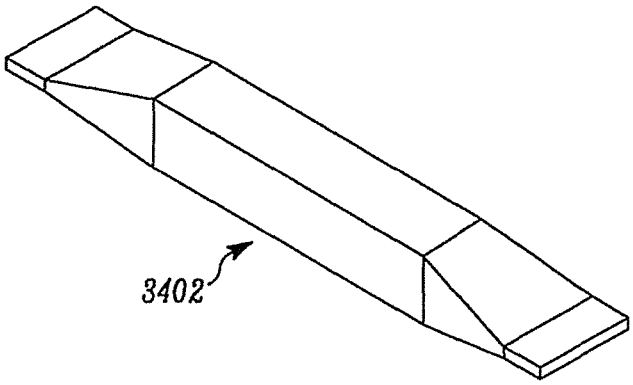
FIG. 38C depicts an alternate view of the support tube.
Figure 39:
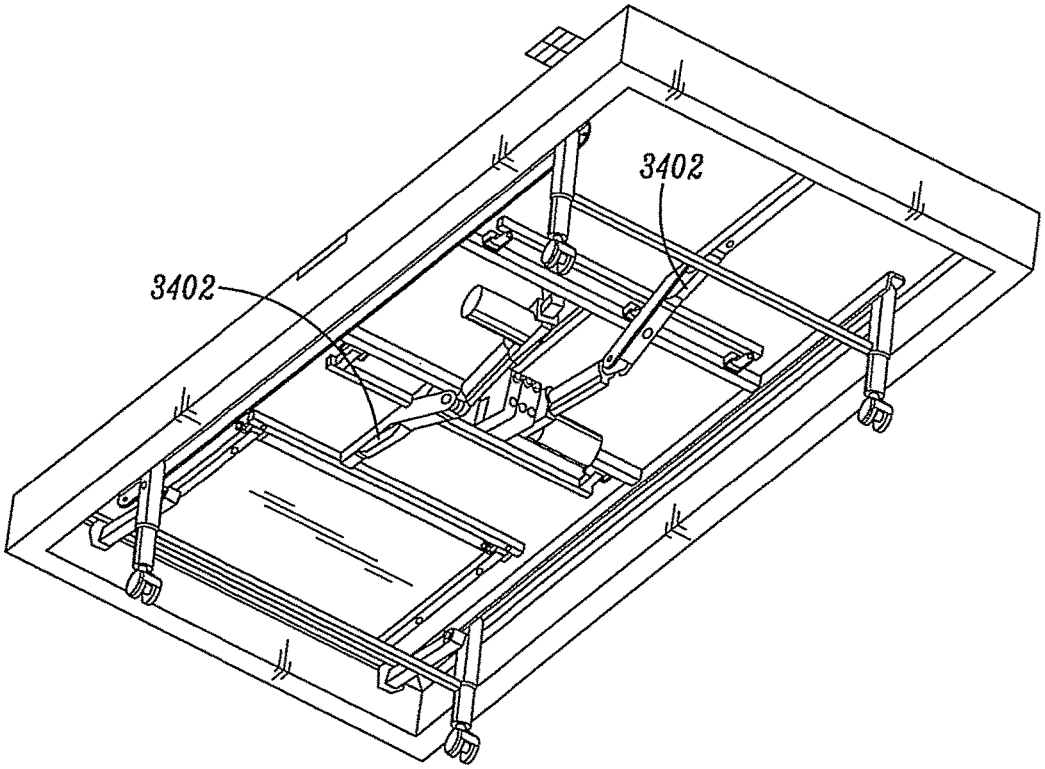
FIG. 39 depicts an underside view of the bed assembly with support tube.

FIG. 35A depicts a side view of the adjustable bed facility with the support tube. FIG. 35B depicts an underside view of the adjustable bed facility with the support tube 3402. FIG. 35C depicts a top view of the adjustable bed facility with the support tube. FIG. 36 depicts an exploded view of the adjustable bed facility connections with support tube. FIG. 37 depicts an underside view of the bed assembly with support tube 3402. FIG. 38A depicts a side view of the support tube 3402. FIG. 38B depicts a top view of the support tube 3402. FIG. 38C depicts an alternate view of the support tube 3402. FIG. 39 depicts an underside view of the bed assembly with support tube 3402.

Figure 40A:
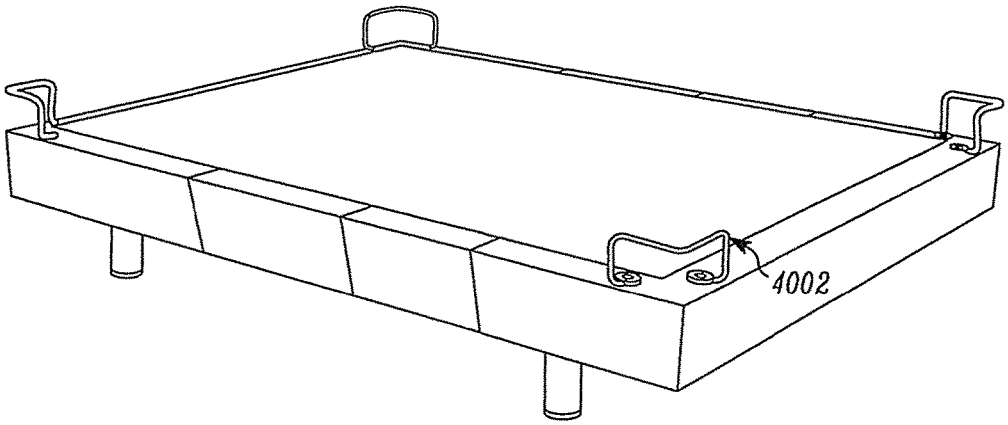
FIG. 40A depicts an adjustable bed facility with four retainer bars.
Figure 40B:
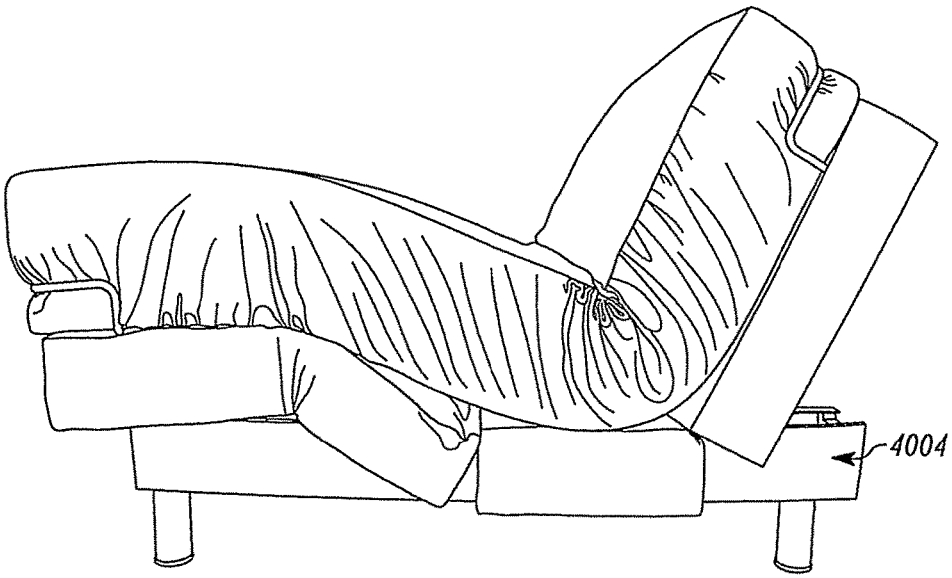
FIG. 40B depicts an adjustable bed facility with a mattress held by four retainer bars.

In embodiments and referring to FIG. 40A, there may be a retaining bracket 402 on more than one side or corner of the adjustable bed facility, at various desired positions, wherein the adjustable bed is a wallhugger or a non-wallhugger. In an embodiment, there may be four retainer brackets 4002, with or without covers, each of which may be attached to the mattress platform. Referring to FIG. 40B, having retainer brackets 4002 on all four sides of the adjustable bed facility 102 may prevent the mattress 110 from shifting side by side and top to bottom such that it conforms to the adjustable bed facility 102 in various positions. In embodiments, there may be two retainer brackets 4002 disposed diagonally from one another on the mattress platform such to prevent side-to-side movement of the mattress 110. In embodiments, the brackets 4002 may be only at the head end of the mattress platform or only at the foot end of the platform. Placement of four retaining brackets as described above may be more stable and achieve greater conformity of the mattress to the adjustable bed facility 102 then using fewer retaining brackets 4002. One or more of the corner retainer bars may have covers on them so they blend in with the rest of the bed. The cover may be a fabric tubing or sleeve that slips right over the retainer bars like a sock. In embodiments, the fabric covering attaches to at least a portion of the mattress retaining bracket via one or more of a hook and loop fastener, a snap, a zipper, an adhesive, a hook and eye fastener, a sewn edge, and a staple. The fabric covering may be a sleeve that fits over the entire mattress retaining bracket. The mattress retaining bracket may be secured on one end to a first side of the mattress platform and on the other end to a second side of the mattress platform. The plurality of mattress retaining brackets may be secured on diagonally opposite corners of the mattress platform. The plurality of mattress retaining brackets may be secured on both corners of a single side of the mattress platform. The plurality of mattress retaining brackets may be secured on each corner of the mattress platform. When shipping the adjustable bed frame assembly, the plurality of mattress retaining brackets are first secured to the mattress platform in a shipment orientation and may then be re-secured in a mattress securing orientation.

Figure 41A:
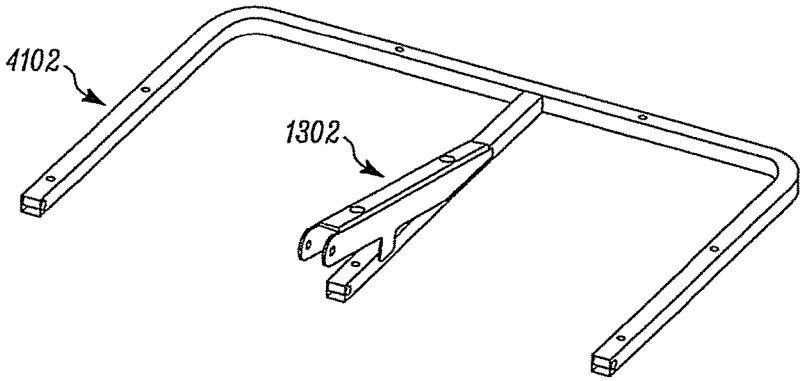
FIG. 41A depicts a drive arm for the adjustable bed facility.
Figure 41B:
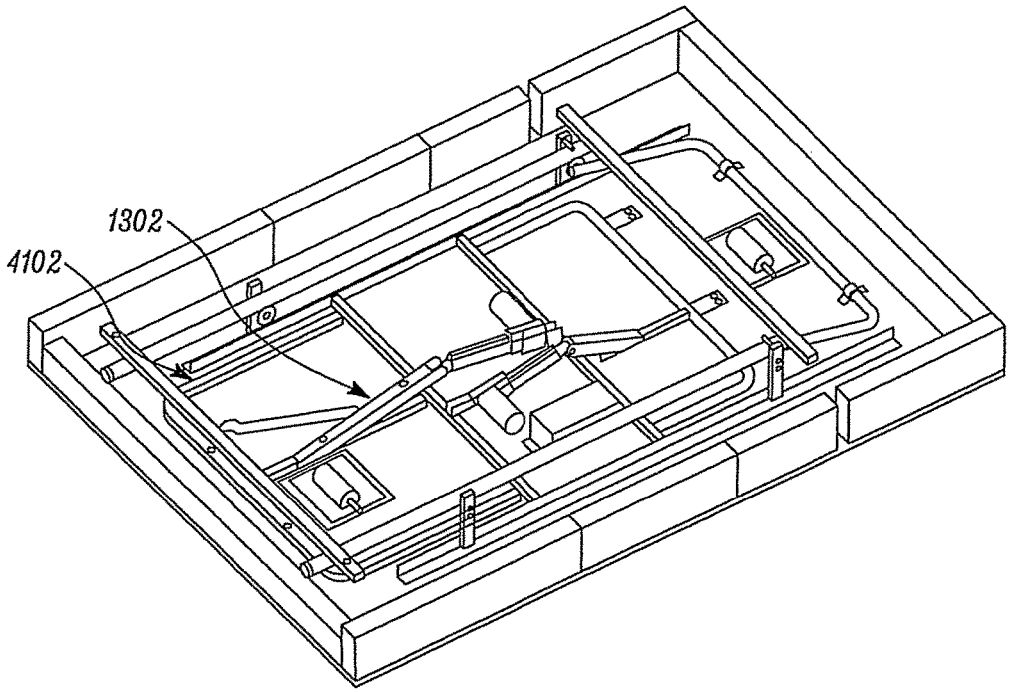
FIG. 41B depicts the underside of the adjustable bed facility.

In embodiments and referring to FIG. 41A, the strength and lift capacity of the drive arm or gusset 1302 may be increased. In embodiments, a piece of sheet metal or the like may be folded in a long triangle and handle style shape. Further, an end of the metal may extend from the end of the actuator to the massage motor location as shown in FIG. 41B which shows the underside of the adjustable bed facility. The gusset 1302 may attach to the wood closer to the head half of the head wood section than the foot half of the head wood section. The attachment may be attached within the upper ⅓ of head wood section, optionally to a curved frame member 4102. The gusset 1302 attachment point may be as close to the head as the edge of the massage motor mount. By extending the gusset in such a manner, the contact point of the mechanism may be further towards the head of the bed. Such an arrangement may result in greater lift capacity and such an increase may be as much or more than 20-30% more lift capacity. Providing a contact point further towards the head of the bed may provide a better leverage point. In embodiments, the triangle and handle shape may be made of one piece of folded sheet metal or the like. In embodiments, there may be a hole or opening in the folded sheet metal, or other material, such that the material may be folded more easily.

Figure 42:
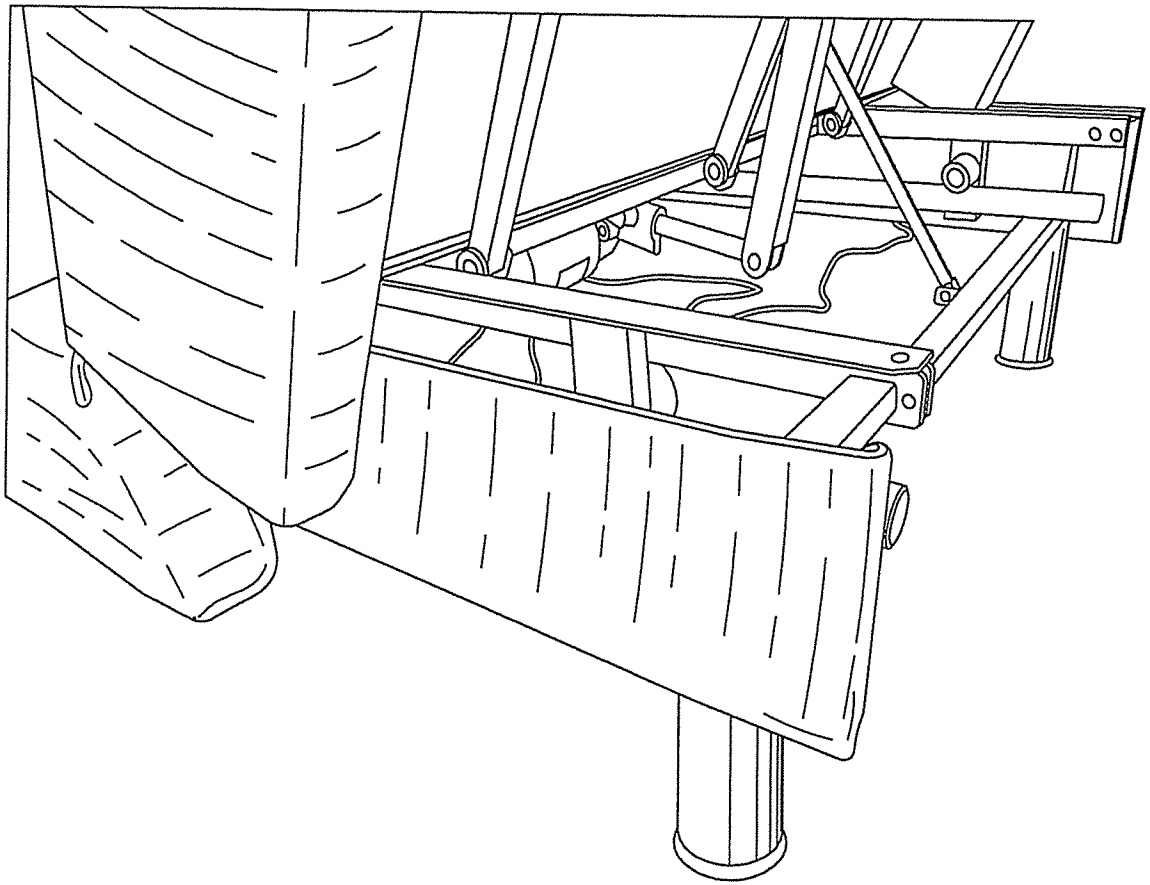
FIG. 42 depicts an inner fabric skirt for the base frame.

In embodiments and referring to FIG. 42 and FIG. 40B, fabric may be attached to the non-articulating frame to provide covering or visibility shielding of various segments of the adjustable bed facility, wherein the adjustable bed facility is a wallhugger or a non-wallhugger. For example a piece of fabric or other material, such as a resilient material or a decorative material, may be attached to the base frame of the adjustable bed facility to prevent the mechanics under the bed from being visible. Attaching fabric in such a manner may prevent items, people, animals, and the like from getting under the bed. Such covering may, therefore, reduce safety concerns. In embodiments, the fabric may be attached to the adjustable bed facility 102 in such a way as to prevent the mechanics from being visible when the head or other portion of the bed is raised, in an adjusted position or otherwise. The fabric may be attached to the frame using steel, wood and/or by other means. In embodiments, the fabric or other material may be attached in such a way that underneath the bed is not visible, and/or so that the space between the articulating frame and bottom/base frame is not visible when the bed is in a raised, lowered or other position. In embodiments, fabric may be wrapped around the back of the adjustable bed facility near the head portion. In embodiments, the fabric covering the articulating decking may cover the retainer brackets 4002 or it may include openings to accommodate the retainer brackets 4002 to be inserted through the openings or may be situated in such a way as to not cover the retainer brackets 4002.

In an embodiment, fabric, wood, or other decorative or concealing material, may be known as a concealing assembly 4004 and visible in FIG. 40B. In embodiments, the concealing assembly 4004 may be attached anywhere on the articulating frame, such as the skeleton, mattress platform, or both, at least at the head section such that as the head section articulates the concealing assembly 4004 is caused to articulate with the head section. Another piece of material, an inner skirt 4602, may be located at or within the boundary of the concealing assembly 4004 but may be connected to the head section of the base frame on a bracket 4604, 5704 such that as at least the head articulates the concealing assembly 4004 does not articulate but nonetheless remains connected to the articulating frame. Yet another foot section inner skirt may be located at or within the boundary of the concealing assembly 4004 but may be connected to the foot section of the articulating frame or the center frame such that as at least the head articulates, the concealing assembly 4004 and foot section inner skirt move with the articulating frame. Thus, one embodiment may include a concealing assembly 4004 attached to a center frame of the bed that articulates with the bed, an inner skirt 4602 attached to the head section of the base frame and within the concealing assembly 4004 boundary that conceals an area but does not articulate, and a foot section inner skirt attached to the foot section of the articulating frame or the center frame that is also within the concealing assembly 4004 boundary and moves when the articulating frame moves. In embodiments, the concealing assembly 4004 may be attached on at least two sides anywhere on the articulating frame such that as at least when the head section articulates the concealing assembly 4004 moves along with the articulating frame. In embodiments, the bed may be a wallhugger where there is a connection between the articulating frame and base frame such that as the head of the articulating frame articulates, the articulating frame is caused to move towards the head section of the bed. The concealing assembly 4004 may be fitted with a mechanism to allow for bending such that as the articulating frame moves towards the head of the bed the concealing assembly 4004 may bend in some direction to allow the articulating frame to continue moving towards the wall.

In other embodiments, the concealing assembly 4004 may be attached anywhere on the base frame. The concealing assembly 4004 may be attached on at least two sides such that when the head section articulates, the concealing assembly 4004 does not articulate with the head section. An inner skirt may be located at or within the boundary of the concealing assembly 4004 but connected to the head portion of the base frame and may be fixed. Yet another inner skirt may be located at or within the boundary of the concealing assembly 4004 but connected to the foot portion of the base frame and may also be fixed.

Figure 43A:
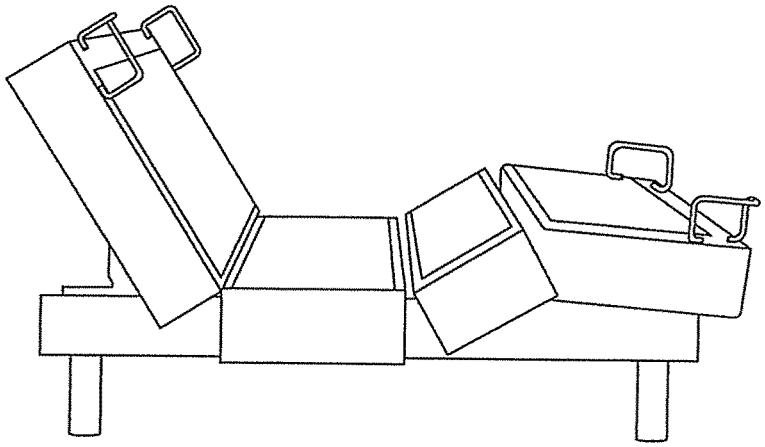
FIG. 43A-FIG. 43C depict different embodiments of a side rail design.
Figure 43B:
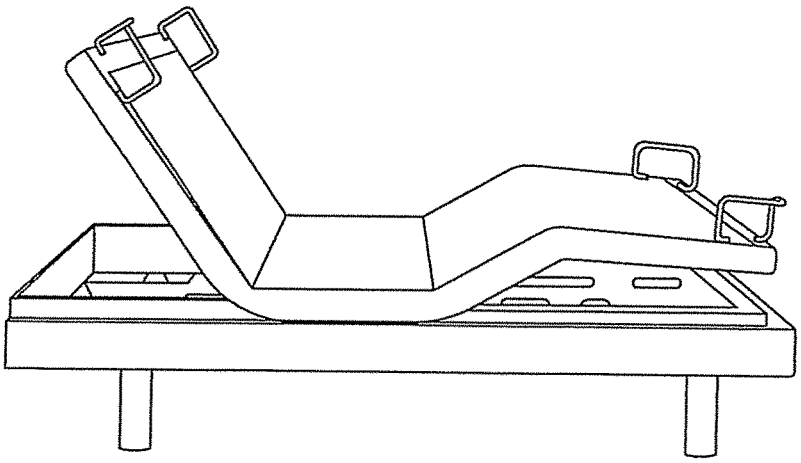

In embodiments, and referring to FIG. 40B, the decking portion of the articulating frame may be fitted with fabric that allows for bending such that as the top frame moves towards the head of the bed the fabric may bend in some direction to allow the top frame to continue moving towards the wall. In embodiments, there may be slits in the side rail and seams in the fabric where the bed articulates such that it relieves pressure on the foam and fabric, such as in FIG. 40B, FIG. 43A and FIG. 43C. Gaps created between the foam rail sections may be less noticeable or covered by fabric wrapped around or otherwise fastened to the adjustable bed facility 102. In FIG. 43A, each section has its own fabric wrap while the bed in FIG. 43C has all of the bed sections wrapped continuously. Such slits and seams in the side rail and fabric may prevent wrinkles from being created on the foam and fabric. In FIG. 43B, a different design enables the entire upper frame to appear as one continuous platform for articulation.

In embodiments, front and or corner retainer brackets 402 may be covered with fabric or other material. In embodiments, the fabric or other material may wrap around the entire bracket or may only cover the steel.

Figure 43C:
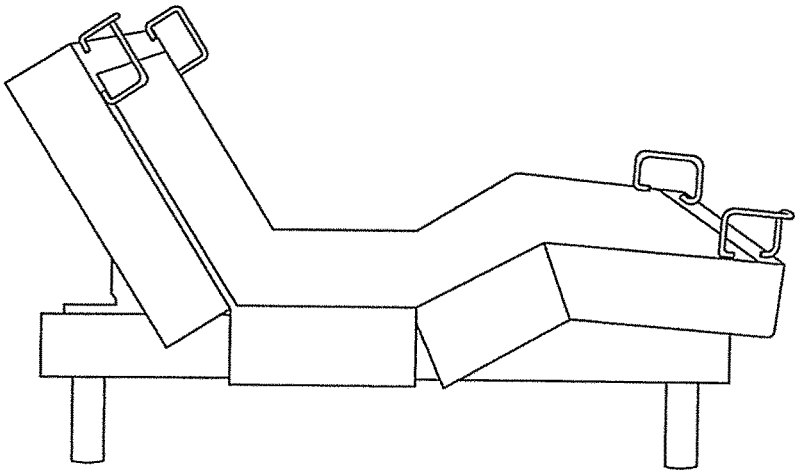

In embodiments there may be slits in the side rail and seams in the fabric where the bed articulates such that it relieves pressure on the foam and fabric, such as in FIG. 43A and FIG. 43C. Gaps created between the foam rail sections may be less noticeable or covered by fabric wrapped around or otherwise fastened to the adjustable bed facility 102. In FIG. 43A, each section has its own fabric wrap while the bed in FIG. 43C has all of the bed sections wrapped continuously. Such slits and seams in the side rail and fabric may prevent wrinkles from being created on the foam and fabric. In FIG. 43B, a different design enables the entire upper frame to appear as one continuous platform for articulation, which may be known as a deck-on-deck embodiment. In this embodiment, the base frame is concealed by a material that is attached either to the upper frame or the base frame. For example, the material may be wood panels attached the bed assembly in such a way that they are disposed just beneath the upper frame, thus providing the deck-on-deck appearance.

In embodiments, front and or corner retainer brackets 4002 may be covered with fabric or other material.

Figure 44:
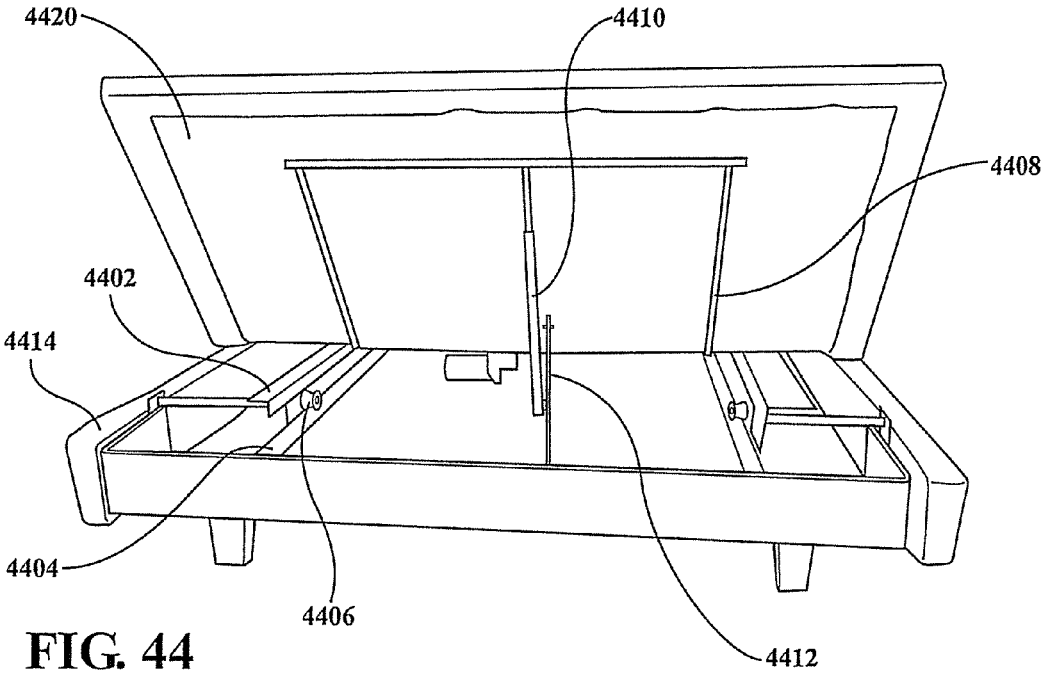
FIG. 44 depicts the underside of an articulating bed.
Figure 45:
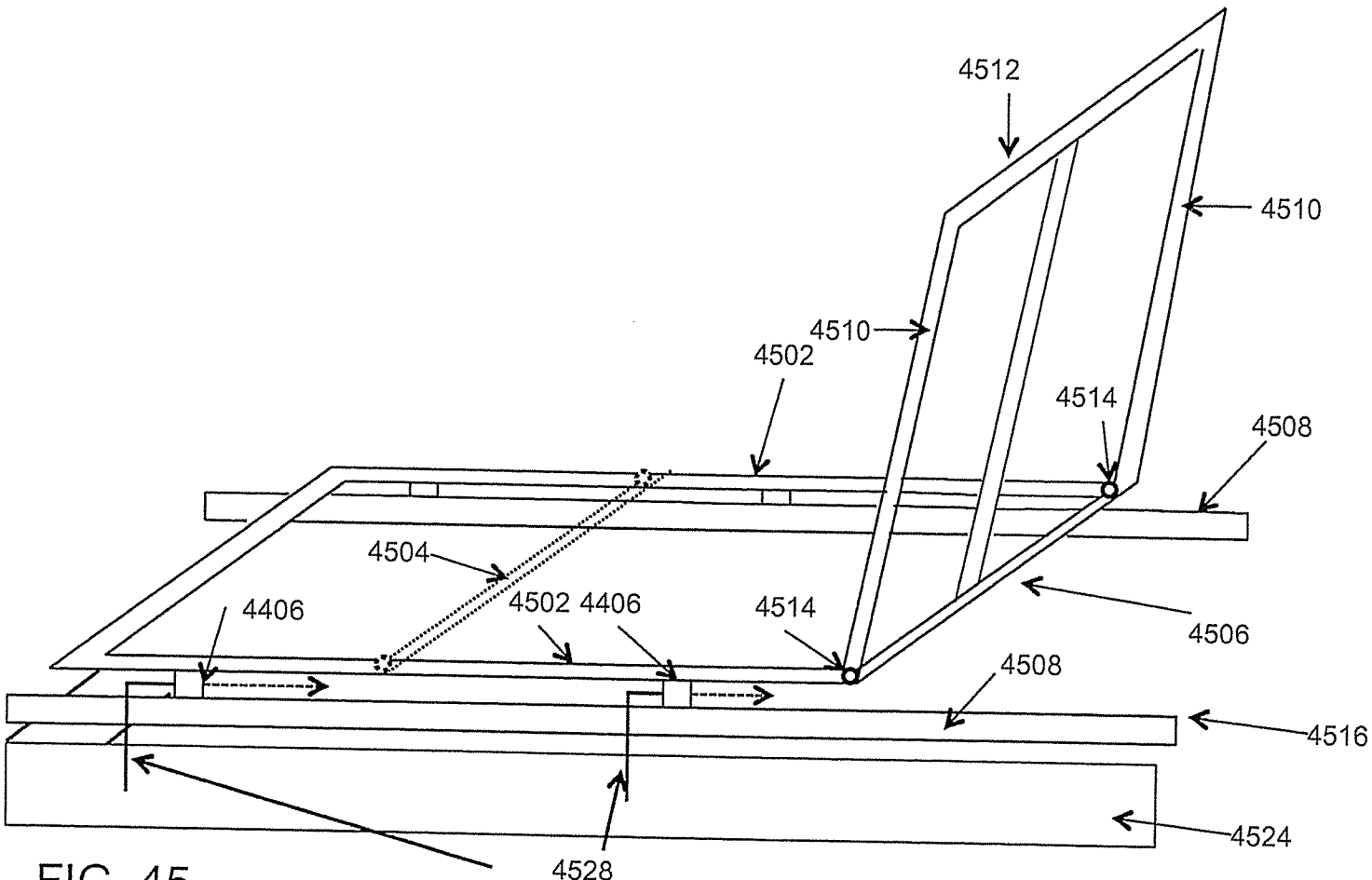
FIG. 45 depicts a model of an articulating bed.

In embodiments and referring to FIG. 44 and FIG. 45, the methods and systems disclosed herein may be implemented as an adjustable bed frame where the frame is a wallhugger with a rail concealing a base frame and where the rail moves rearwardly with the center frame of the bed. In embodiments, the wallhugger frame includes a center frame 4402 that is movably affixed to a stationary base frame 4404. The center frame 4402 comprises two substantially parallel side frame members 4502 connected by both a forward connector 4506 frame member and a rear connector frame member 4504 (shown as a dashed line). The shape of the center frame 4402 may be altered in order to best accommodate bed design, such as, but not limited to, size and shape, or the materials used in the construction of the frame. Larger frames may require additional connecting frame members in order to support the load from a larger mattress. Likewise, depending on the materials the frame is made from, additional connecting frame members may be required for stability.

The stationary base frame 4404 may also include two substantially parallel side base frame members 4508 in order for the center frame to move effectively along the base frame. Those skilled in the art may recognize that other shapes of a base frame are possible, but may require additional mechanical components in order to accomplish the movement of the center frame 4402 along the base frame 4404. The center frame may be movably affixed to the base frame using one of many methods known to the art, including using assemblies disclosed herein, such as, but not limited to, connecting the center frame 4402 to the base frame 4404 using an assembly with concave wheels rolling on a stationary base frame comprising tubular members. In embodiments, multiple points of the center frame 4402 may be movably affixed to the base frame 4404. Other methods may exist in the art to movably affix the center frame 4402 to the base frame 4404 and may be implemented when desirable, such as, but not limited to, for aesthetic purposes, economic purposes, or to save space.

In embodiments, the center frame 4402 may be attached pivotally to a head frame 4408. The head frame 4408 may comprise two substantially parallel side frame members 4510 and is connected by at least one connecting frame members 4512. Additional connecting frame members may also be used if desirable. Placement of the connecting frame members 4512 between the two side frame members may vary depending on a number of factors, such as, but not limited to, strength of the materials or the aesthetics of the assembly. The lower ends of the head frame's parallel side frame members may be pivotally attached to the forward connector frame member 4506 of the center frame 4402. This pivotal attachment 4514 may use any one of the mechanical pivoting assemblies known to the art. In embodiments, the head frame connecting frame 4512 or connecting frames may have a downward facing extension frame member attached. The head frame connecting frame 4512 or connecting frames may also have more than one downwardly facing extension frame member 4410 if desired. In embodiments, the downwardly facing extension 4410 frame member may serve multiple purposes. A stabilizer arm 4412 may serve as a supporting frame member for the load which the assembly bears when the assembly is being used. The stabilizer arm 4412 may connect on one end to the mattress platform 4420 and on the other end to the base frame 4404.

The extension frame 4410 may also serve as a connecting platform for an actuator which may be deployed in the assembly in order to raise and lower the head frame and or the foot frame. One end of the actuator may be pivotally connected to the head frame's extension frame member 4410 while the opposing end of the actuator is connected to the base frame 4404. The actuator may serve to pivot the head frame 4408 upward. Multiple actuators may be deployed if desirable, such as, but not limited, embodiments comprising more than one head frame extension frame member.

In embodiments, the assembly may comprise a mattress platform 4420 affixed to a top side of the articulating frame. The mattress platform 4420 may serve as a supporting assembly for a mattress placed on top of the assembly. The mattress platform 4420 may be assembled using any material or method known to the art.

In embodiments, the assembly may comprise a concealing assembly 4414, which is attached to the center frame 4402. In FIG. 45, the concealing assembly 4524 is shown attached to the wheels 4406 of the center frame 4502 through side rail brackets 4528. However, the side rail brackets 4528 may also be directly connected to the center frame 4502. The concealing assembly may be situated below the mattress platform 4420. The concealing 4414 assembly may act to conceal the base frame as the center frame 4402 moves along the base frame 4404. In embodiments, the concealing assembly 4414 may extend outward from the center frame 4402 and be placed over the base frame 4404. The concealing assembly 4414 may be manufactured in any one of many methods that may be desirable.

Figure 46:
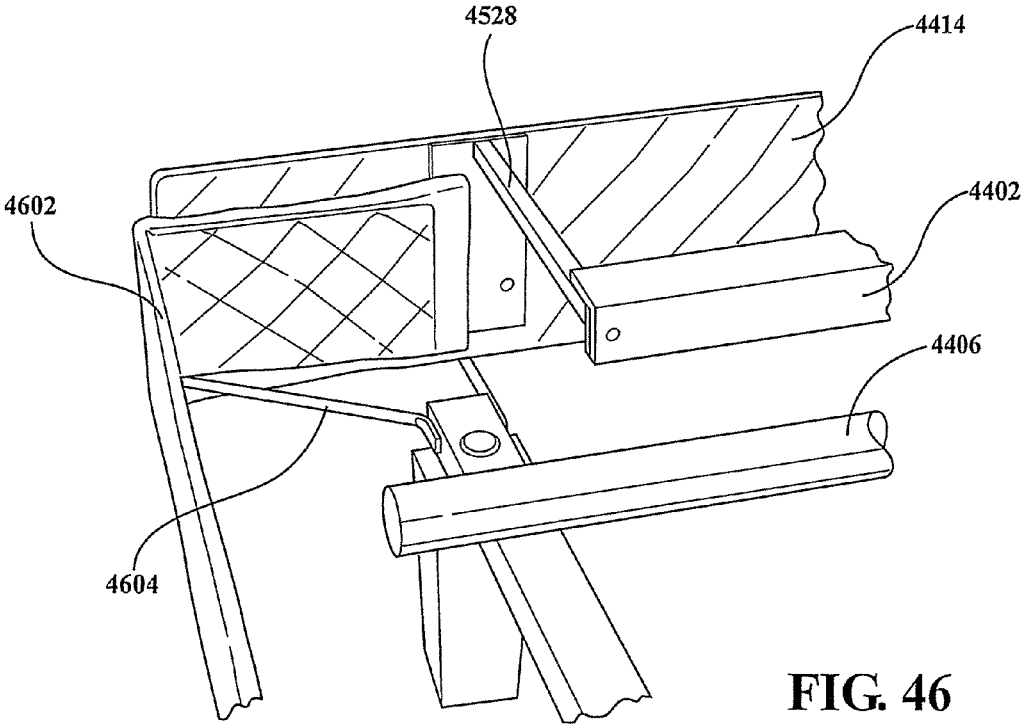
FIG. 46 depicts a concealing assembly for an articulating bed.
Figure 47:
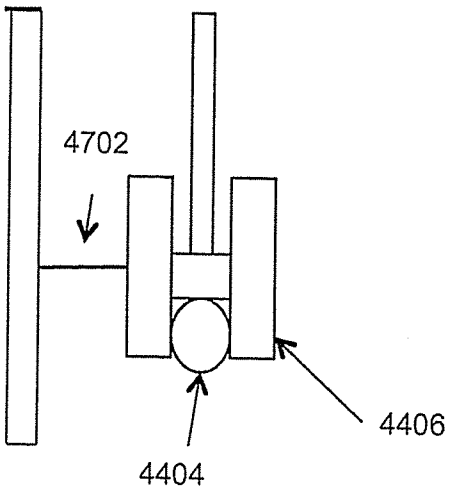
FIG. 47 depicts a view of a concealing assembly attachment to an articulating bed.

In a non-limiting example and referring to FIG. 46 and FIG. 47, the concealing assembly 4414 may simply be an extension from the center frame which protrudes out past the base frame 4404. In FIG. 47, the view is a head-on view down the long axis of the center frame. A fabric or other concealing material on the concealing assembly may conceal the base frame 4404. The use, manufacture, and design of the concealing assembly are not limited to these examples or purposes, as other methods of concealing the base assembly may be desirable in various circumstances.

Figure 48:
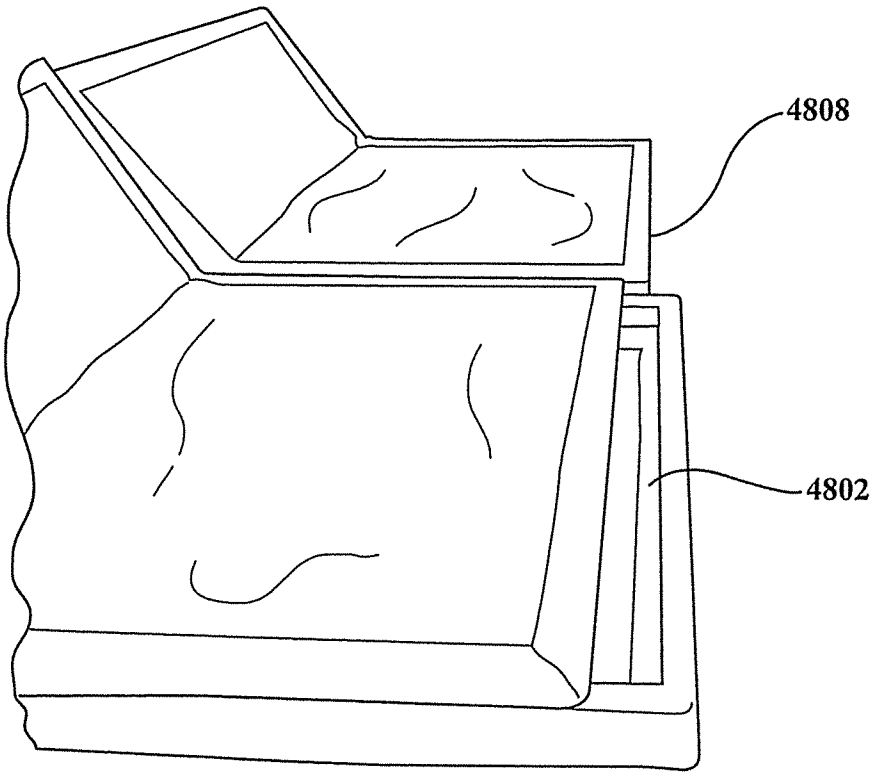
FIG. 48 depicts a comparison of a bed with a concealing assembly to one without.

In embodiments, the actuator connected to the head frame 4408 may pivot the head frame 4408 upward. As the actuator pivots the head frame 4408, the center frame 4402 and concealing assembly 4414 may move toward the head end 4516 of the adjustable bed frame along the stationary base frame 4404. The embodiments may be implemented as a more aesthetically pleasing method of deploying a wallhugger bed assembly. The embodiments may also result in a safer implementation of a wallhugger bed assembly, as the movement of the center frame 4402 and concealing assembly 4414 along with the actuation of the head frame 4408 may reduce or eliminate the space 4808 between at the bottom end of the bed between the concealing assembly and the mattress platform. FIG. 48 shows a comparison of two beds where the one with no space 4808 is a bed with a concealing assembly that moves along with the center frame whereas the bed with space 4802 does not have a concealing assembly that moves along with the center frame. Too much distance 4802 between the bottom end of the center frame 4402 and the base frame 4404 may not be aesthetically pleasing and could cause frustration for a user when arranging their adjustable bed, such as items dropped into the space, bedding materials becoming entangled in the mechanical components of the assembly, or even limbs getting caught, to name a few. Movement of the center frame 4402 along with the concealing assembly 4414 along the stationary base frame 4404 may decrease those risks, resulting in a more enjoyable and safer experience for a user.

In embodiments, the center frame may be constructed using any materials known to the art that may be desirable. Materials such as wood or steel, but not limited to these materials, may be used in order to construct a center frame, a head frame, mattress platform, or any of the other components which comprise the assembly. Combinations of materials may also be used when desirable. In a non-limiting example, the center frame may be constructed out of steel, but the mattress platform on which the mattress is placed may be constructed out of wood. Manufacturers as well as those skilled in the art may recognize that various combinations of materials can serve as distinguishing factors when constructing different product lines. Assemblies made from higher quality materials or with mechanically sturdier construction (i.e. with more supporting frame connectors) may be priced higher than others.

In embodiments, the concealing assembly 4414 may be omitted in either wallhugger or non-wallhugger type bed assemblies. Thus, in embodiments of wallhugger bed assemblies, though the center frame is movably affixed to the stationary base frame and moves toward the head end of the bed frame assembly with respect to the stationary base frame, the movement of the center frame may be visible to users. Likewise, in embodiments of non-wallhugger bed assemblies, there may nonetheless still be a concealing assembly present despite the bed's inability to rearwardly move during articulation. In these embodiments, there may still exist a center frame affixed to a stationary base frame with a pivotally connected head frame which may move up and down; however, these embodiments may lack the mechanics to move the center frame toward the head of the bed frame assembly as the actuator moves the head frame up and down. Those skilled in the art will recognize that both wallhugger and non-wallhugger beds may thus be implemented in the same bed frame, just with certain functions disabled or enabled.

The benefits to embodiments where wallhugger functionality can be added or omitted in the same structural assembly are readily apparent. Manufacturers may be able to produce large amounts of similar bed assemblies without having to first predict the number of wallhugger or non-wallhuggers that consumers may order. Consumers who choose to enable wallhugger functionality can simply indicate their decision and a manufacturer can very easily install wallhugger enabled machinery into the existing structural bed assembly. Likewise, manufacturers and merchants may be able to offer various quality "tiers" of beds to consumers. In a non-limiting example, an adjustable bed merchant may offer its lowest quality lines of articulating beds lacking the movement mechanism attached to the center frame to enable the wallhugging functionality—this embodiment may or may not also include a concealing assembly. The merchant may then offer the exact same bed at a higher price only with a concealing assembly, which may be easily added on or even purchased separately by the consumer. Furthermore, a merchant may then offer its "premier" line of adjustable beds, with both wallhugger functionality and an optional concealing assembly. In versions of this premier, wallhugger-style bed, the design may be either deck-on-deck as shown in FIG. 43B, or non-deck-on-deck, as shown in FIG. 43A and FIG. 43C. Thus, manufacturers and merchants of these beds gain access to valuable marketing strategies, as consumers gain the opportunity to personalize their beds, or at least choose from a variety of different bed options. Though the ability to create different types of beds exists independently of the methods and systems disclosed herein, nonetheless, the methods and systems disclosed herein allow manufacturers to cut down production and design costs significantly by providing an adjustable bed frame assembly which can easily be adapted to fit the needs of consumers.

In embodiments, the methods and systems described herein may be deployed as a kit for constructing an adjustable bed frame assembly, also known as a "knock-down" kit. In the current state of the art, manufacturers of bed frames may wish to obtain their materials or assembly parts from overseas. Due to the cost of shipping and limited space, it may be desirable for manufacturers to be able to receive all of the necessary parts for construction of an adjustable bed frame prior to their assembly of the adjustable bed frame, with as much of the adjustable bed preassembled, while conserving space. In embodiments, the knock-down kit may include several parts and materials for construction of an adjustable bed assembly. In embodiments, the kit may be customized in accordance with the "tiers" of bed described above. Having common components among the various tiers of beds may facilitate assembling kits of beds. For example, all articulating wallhugger kits may include the same base frame, however, the articulating frame may be different in a kit for a deck-on-deck bed versus a non-deck-on-deck bed.

In embodiments, certain connections in the bed do not have to be welded. These may include: motor mechanism (where the motor mounts to the head and to the foot and pushes on bed), steel pieces that drop down from the center frame and connect to the wheels, foot support bar (attaches to foot wood and center steel frame), all headboard brackets, crossbar and substantially tubular steel, and other connections not specifically called out here.

Figure 49:
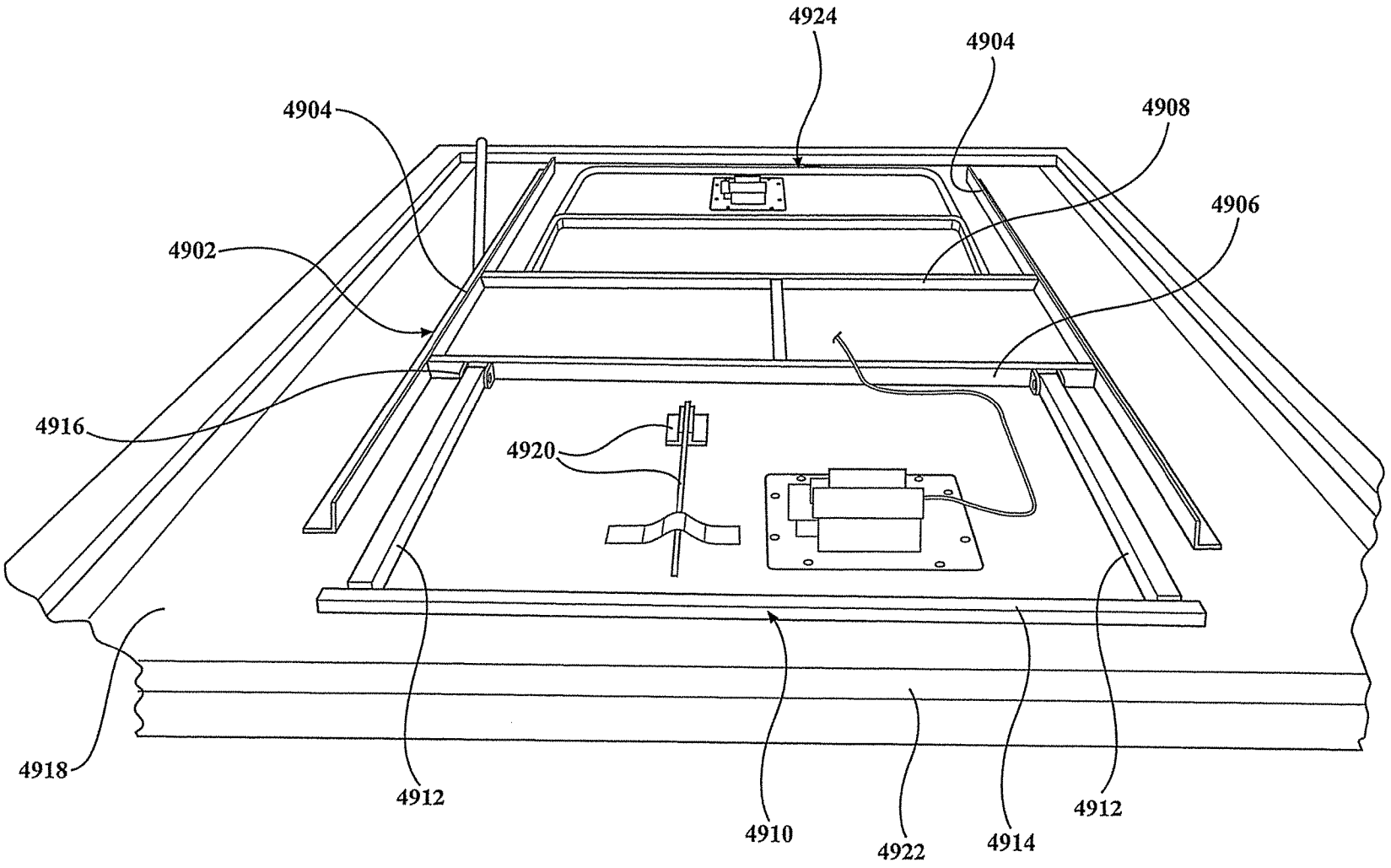
FIG. 49 depicts a portion of a kit for an articulating bed.

As shown in FIG. 49, in embodiments, the kit may comprise a center frame 4902. The center frame 4902 may comprise two substantially parallel side center frame members 4904 connected by two connector frame members, a forward center connector frame 4906 member a rear center connector 4908 frame member. The kit may additionally comprise a head frame 4910. The head frame 4910 may include two substantially parallel side head frame members 4912 connected by at least one head frame connector member 4914. The lower ends of the head frame's parallel side frame members may be pivotally attached to the forward connector frame member of the center frame. The pivotal attachment 4916 may be implemented using bolts or any other method known to the art.

Additionally, the kit may comprise a mattress platform 4918 in order to provide support for a mattress. The mattress platform may be affixed to the center 4902, head frame 4910, and/or foot frame 4924 using any of the methods known to the art, such as, but not limited to, gluing, welding, bolting, or affixing a brace and using bolts to connect the brace to the mattress platform 4918. The mattress platform 4918 may be constructed out of wood, but is not limited to this material, and may be constructed using any material known to the art that may be desirable. As a non-limiting example, a wood mattress platform may be cheap, while a plastic mattress platform may be lighter for shipping purposes. Furthermore, in embodiments, the mattress platform 4918 may be divided into multiple sections, such as, but not limited to, dividing the mattress platform into a head, torso, leg, and foot section in order to accommodate consumer desires or bed designs. In embodiments, the mattress platform may have a fabric covering either on the top or the bottom, which may be implemented for a variety of reasons, such as, but not limited to, aesthetic purposes or protection. Likewise, the mattress platform may have cushioning on the top of the mattress in addition to a fabric layer. The cushioning may be constructed from foam, or any other material known to the art that may be desirable for a manufacturer or consumer. In embodiments, the mattress platform 4918 may have additional cushioning along the sides 4922 of the mattress platform 4918, in order to further protect the mattress platform 4918 or any other reason for added cushioning. This cushioning may be constructed from the same material as the cushioning used for the top of the mattress platform 4918, or a different material. The kit may also comprise a stabilizing bar 4920, which may be connected to the mattress platform 4918 using bolts and which may stabilize the head frame when in an articulate position.

Figure 50A:
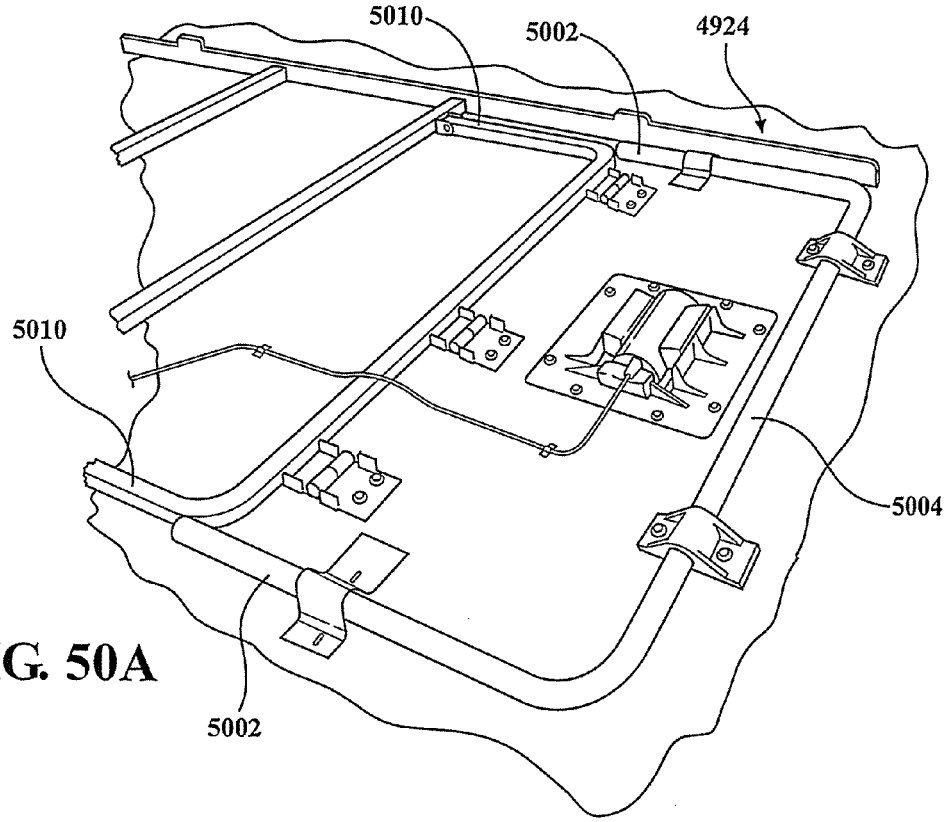
FIG. 50A and FIG. 50B depict a portion of a kit for an articulating bed.
Figure 50B:
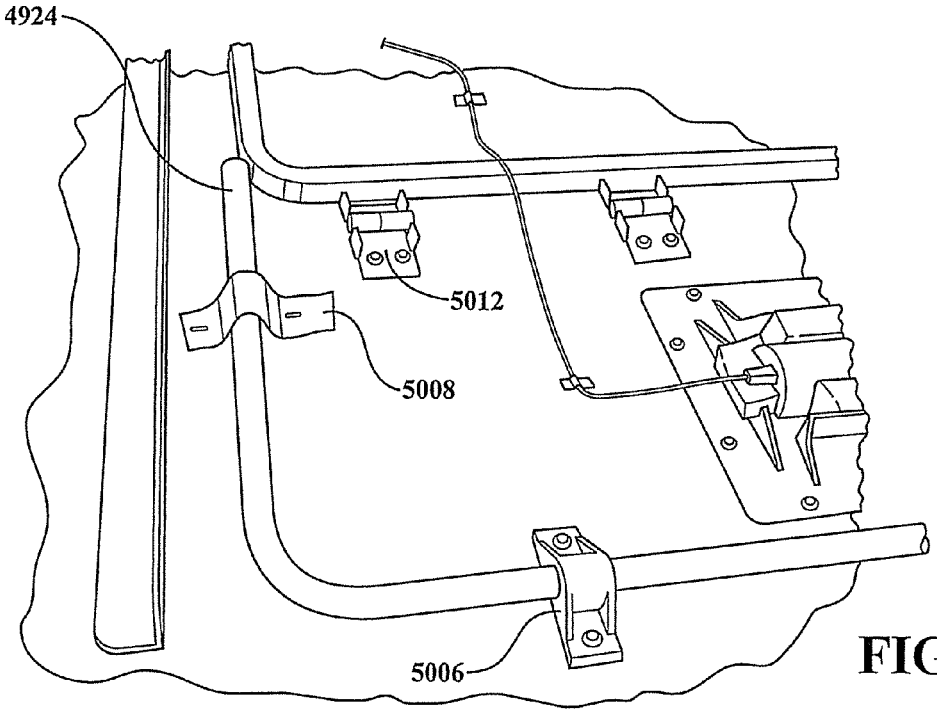

In embodiments, the kit may comprise a foot frame 4924, a close up of which is demonstrated in a non-limiting embodiment in FIG. 50A and FIG. 50B. The foot frame 4924 may comprise two substantially parallel side foot frame members 5002 connected by at least one foot frame connector frame 5004. Also depicted is a thigh frame 5010. In embodiments, the foot frame 4924 and thigh frame 5010 may be affixed to the mattress platform 4918, using a variety of methods, such as, but not limited to, welding, glue, or bolts. In embodiments the foot frame 4924 and thigh frame 5010 may be substantially tubular and shaped to resemble a "U" or "C". In embodiments, the foot frame 4924 or thigh frame 5010 may be affixed to the mattress platforms 4918 via a bracket 5006, hinge 5012, or the like. In embodiments, the foot frame 4924 or thigh frame may be affixed to the mattress platform 4918 in such a manner so that the foot frame may move pivotally. In embodiments, the foot frame 4924 may be secured during transportation of the frame using a fastener 5008, such as, but not limited to, a piece of fabric stapled to the mattress platform 4918. In embodiments, these fasteners 5008 may secure the foot frame 4924 so that there is no movement of the foot frame 4924 during transportation, preventing damage to the frame and also preventing possible injury arising from handling the assembly.

Figure 51:
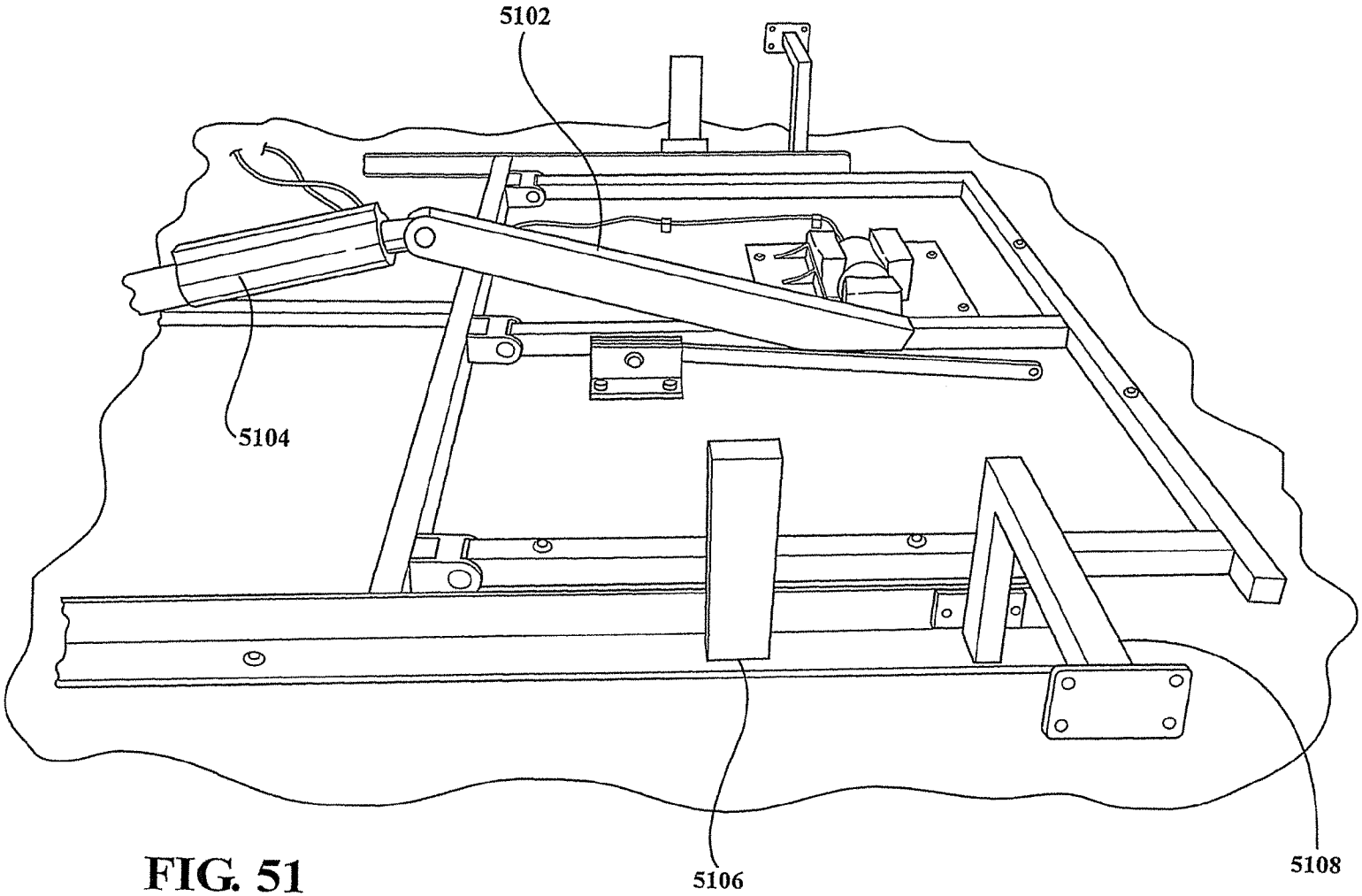
FIG. 51 depicts a portion of a kit for an articulating bed.

As seen in FIG. 51, in embodiments, the kit may comprise at least one extension frame members 5102. These extension frame members 5102 may be coupled with actuators 5104 in order to extend certain frames of the adjustable bed assembly upward or downward. In embodiments, the kit may comprise at least one actuator 5104. Actuators 5104 may be attached to extension frame members 5102 using, but not limited to, bolts or welding and may be pivotally attached for increased range of motion. In embodiments, multiple extension frame members or actuators may be used. In a non-limiting example, adjustable bed assemblies for which the head frame is the only frame to move upwardly or downwardly may only have a single extension frame members 5102 connected to the head frame 4910. In this same example, a single actuator 5104, may have one end pivotally affixed to the extension frame member 5102 and another end affixed to the mattress platform 4918 using methods such as, but not limited to, welding or bolts.

The kit may comprise a plurality of roller brackets 5106, which may be used to support the wheel designed to move the frame of the adjustable bed assembly horizontally. As demonstrated in FIGS. 52A and 52B, in embodiments, the kit may comprise a plurality of concave wheels 5202, or other movement mechanisms such as slides, which are affixed to the roller bracket 5106. It should be understood that this kit may also be constructed with a base frame that includes a C-channel and a center frame that includes wheels that fit into or along the C-channel, as described herein. These concave wheels 5202 may serve to move the frame assembly along a track, providing freedom of movement for wallhugger functionality. The wheels 5202 may be affixed to the roller bracket 5106 using removable bolts or other similar methods. In embodiments, the kit may comprise concave wheels 5202 included separately from the bolts that attach the concave wheels 5202 to the roller brackets 5106. In such embodiments, a wheel connecting member 5204 may be inserted through the center of the concave wheel 5202 and affixed to the roller bracket 5106. The roller bracket 5106 may be affixed to the center frame 4902, using one of many methods, including, but not limited to, bolts.

Figure 53A:
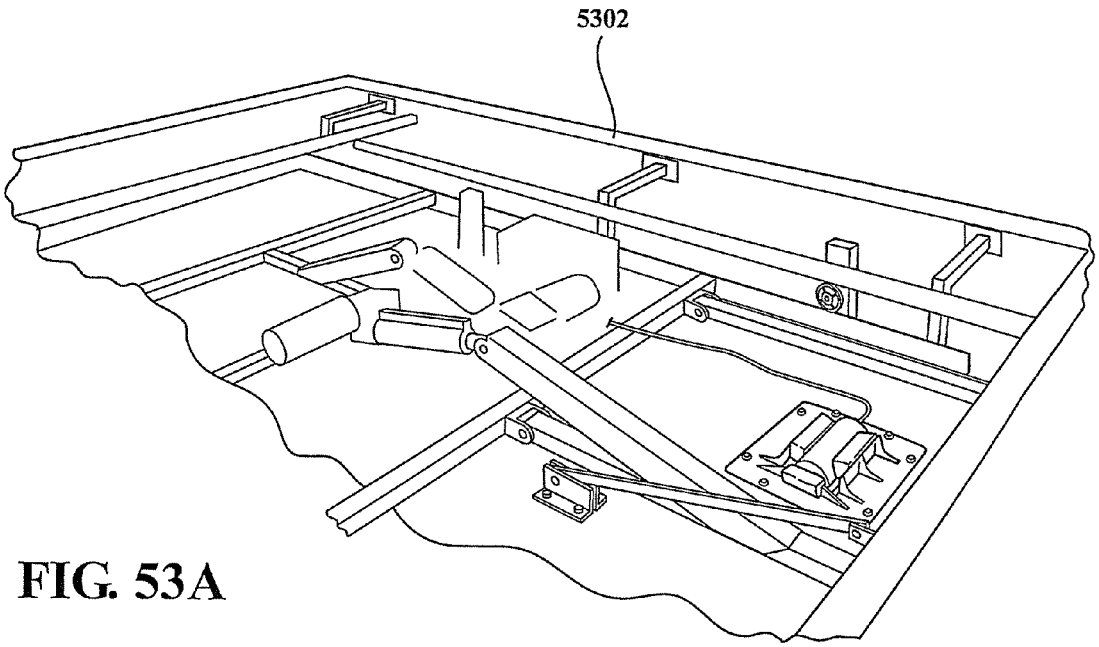
FIG. 53A and FIG. 53B depict portions of a kit for an articulating bed.
Figure 53B:
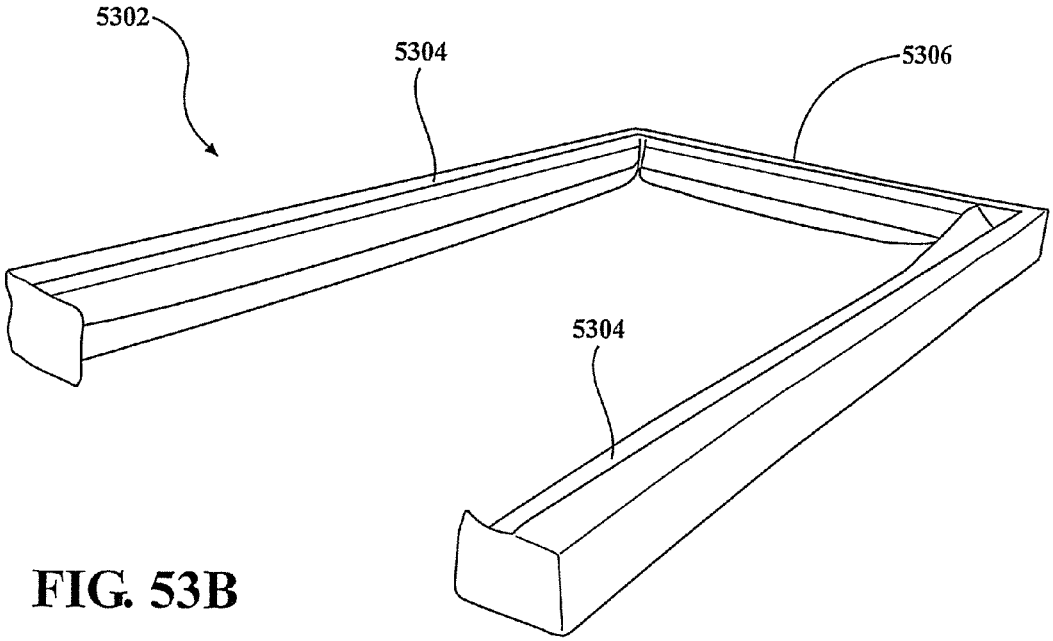

In embodiments, the kit may comprise a plurality of side rail brackets 5108. These brackets 5108 may be manufactured in the shape of an "L." The side rail brackets 5108 may be affixed to the center frame 4902 using a variety of methods, including, but not limited to, welding or bolts. As shown in FIGS. 53A and 53B, the side rail brackets 5108 may also be affixed to a concealing assembly including a concealing side rail 5302. The concealing side rail 5302 may serve to conceal the components of the adjustable bed assembly during frame movements, such as, but not limited to, when the bed is used for wallhugger capabilities. The concealing side rail 5302 may be affixed to the side rail brackets 5108 using methods such as, but not limited to, bolts or welding. The concealing side rail 5302 may comprise two substantially parallel concealing side members 5304 as well as a concealing connecting member 5306. The members of the concealing side rail 5302 may be covered with fabric. The members of the concealing side rail 5302 may also be covered with cushioning. The concealing side rail 5302 may be shipped fully constructed, with the parallel concealing side members 5304 and connector member 5306 already affixed to one another. The concealing side rail 5302 may be shipped with fabric and cushioning already assembled. The concealing side rail 5302 may also be shipped as each individual component, requiring additional assembly from either the consumer or an intermediary.

Figure 52A:
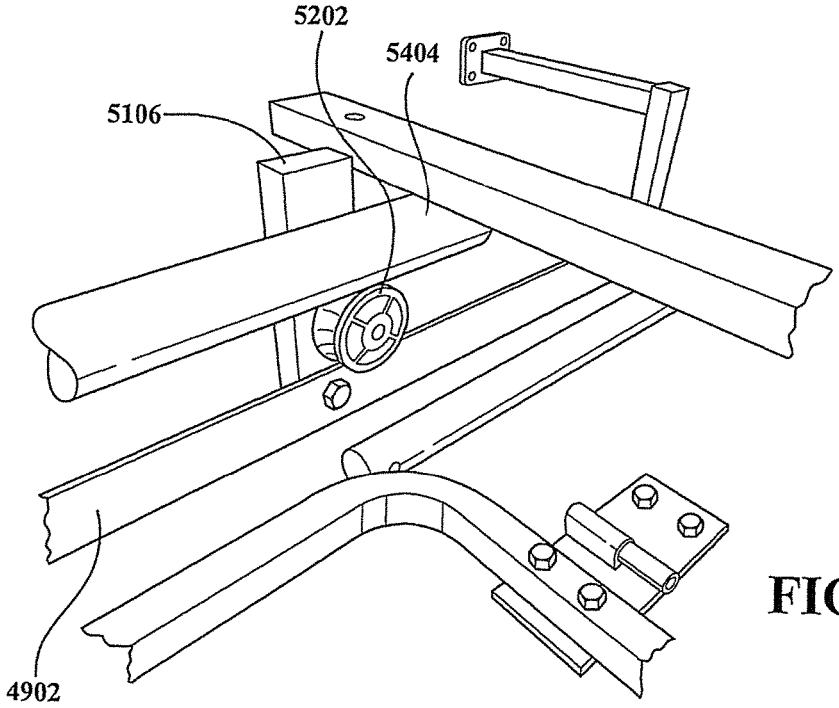
FIG. 52A and FIG. 52B depict portions of a kit for an articulating bed.
Figure 52B:
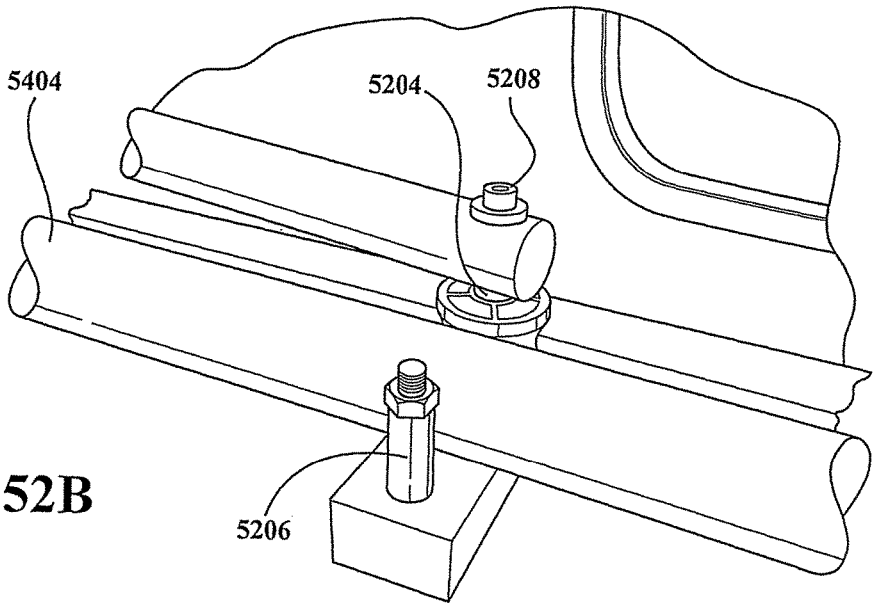
Figure 54:
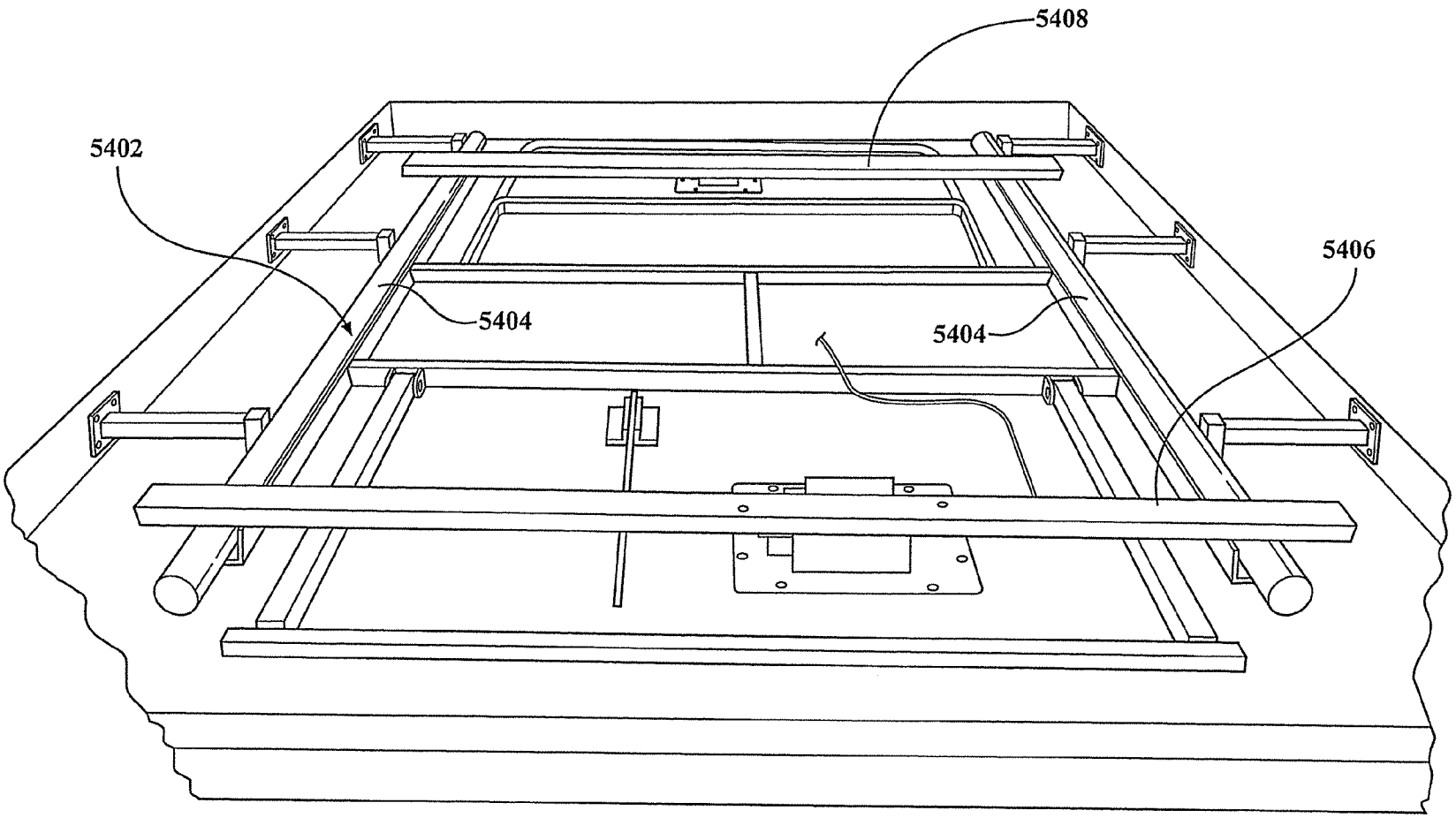
FIG. 54 depicts a portion of a kit for an articulating bed.
Figure 55:
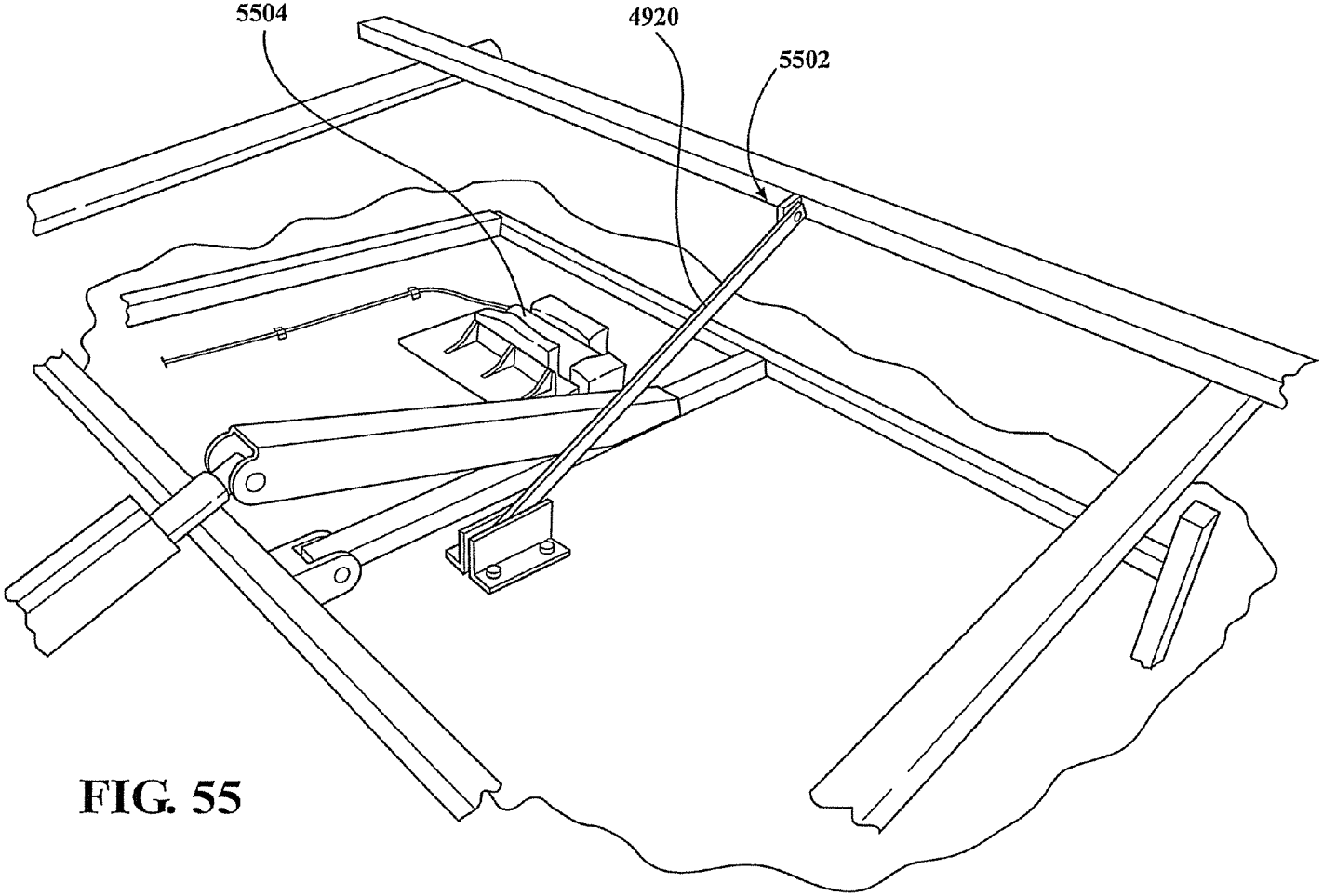
FIG. 55 depicts a portion of a kit for an articulating bed.

As shown in FIG. 54. in embodiments, the kit may include a base frame 5402. The base frame may include two substantially parallel side base frame members 5404, a forward base frame connector member 5406, and a rear base frame connector member 5408. The two substantially parallel side base frame members 5404 may be substantially tubular in shape. The side base frame members 5404 may be affixed to the base frame connector members 5406 5408 by any of the methods known to the art, such as, but not limited to, welding or bolts. The base frame 5402 may be preassembled or packaged as separate components depending on preference. As shown in FIGS. 52A and 52B, in embodiments the base frame 5402 may be affixed to the adjustable bed assembly by resting the substantially concave wheel 5202 affixed to a roller bracket 5106 on a side base frame member, using the base frame 5402 as a track for the wheels to travel on in order to implement the wallhugger feature. A roller frame securing mechanism 5206 may be affixed to the roller bracket 5106 so that the side base frame 5404 member rests in between the roller frame securing mechanism 5206 and the concave wheel 5202. In embodiments, the roller frame securing mechanism 5206 may function to prevent the base frame 5402 and the center frame 4902 from separating. In embodiments, the foot frame may be affixed to the wheel connecting member 5208, allowing the foot frame to move concurrently with the frame without the use of an additional actuator.

In embodiments, the stabilizing bar 4920 affixed to the mattress platform 4918 may also be affixed to the forward base frame member 5502. In embodiments, at least one massage motor 5504 may be affixed to the mattress platform.

Figure 56:
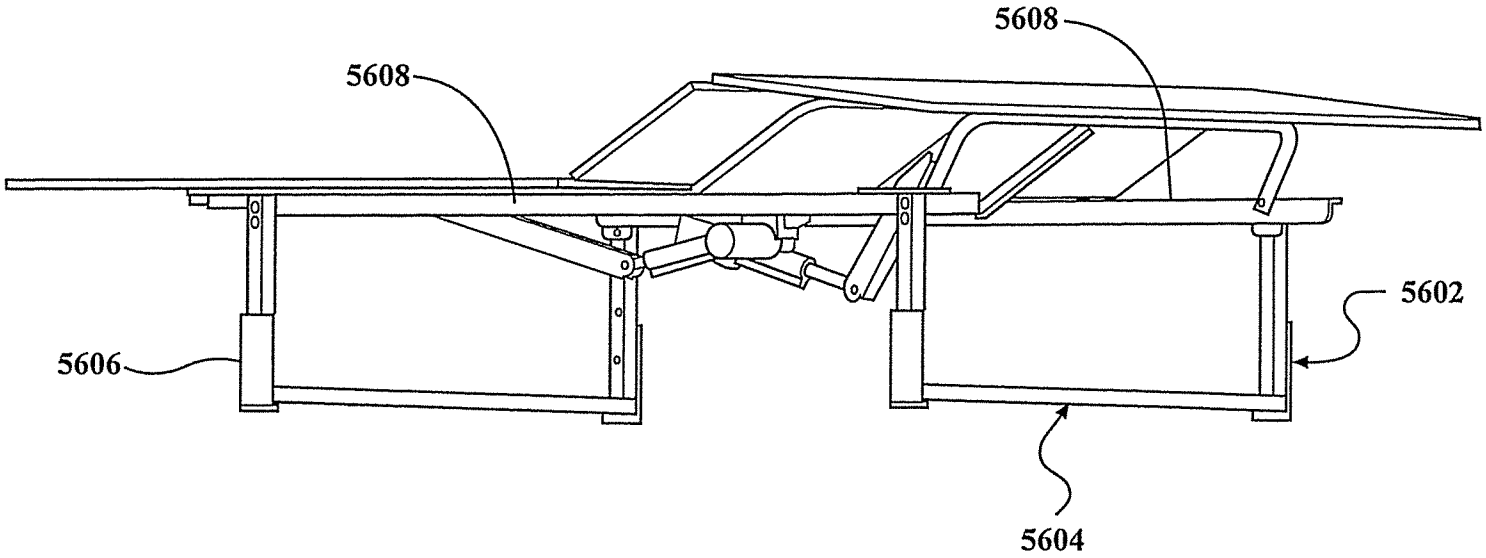
FIG. 56 depicts a model for a non-wallhugger articulating bed.
Figure 57A:
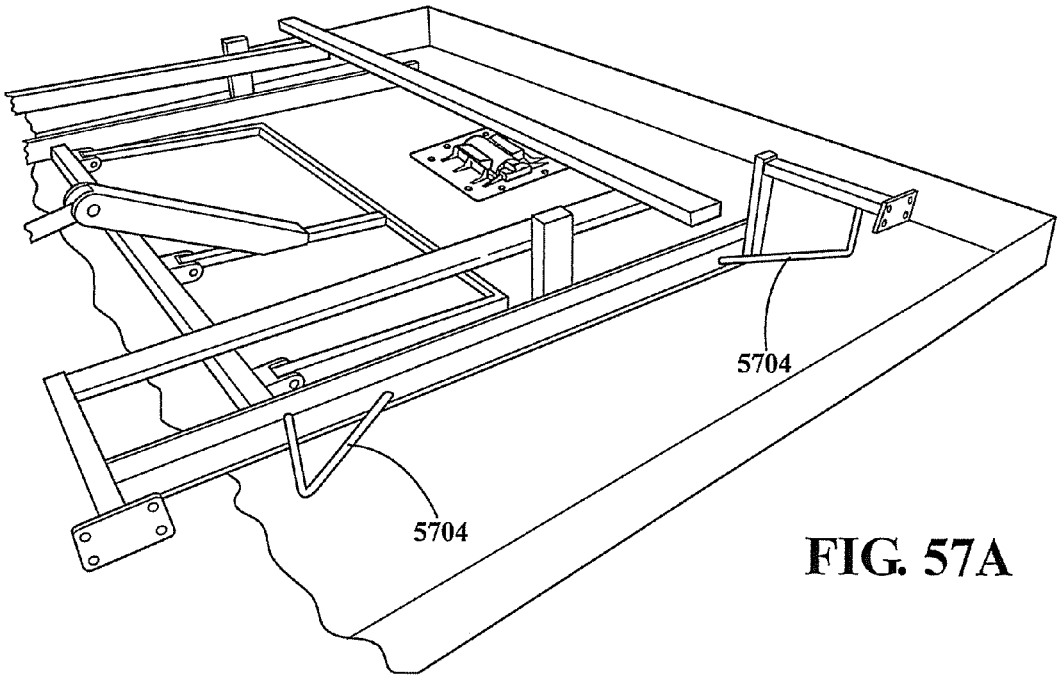
FIG. 57A and FIG. 57B depict portions of a kit for an articulating bed.
Figure 57B:
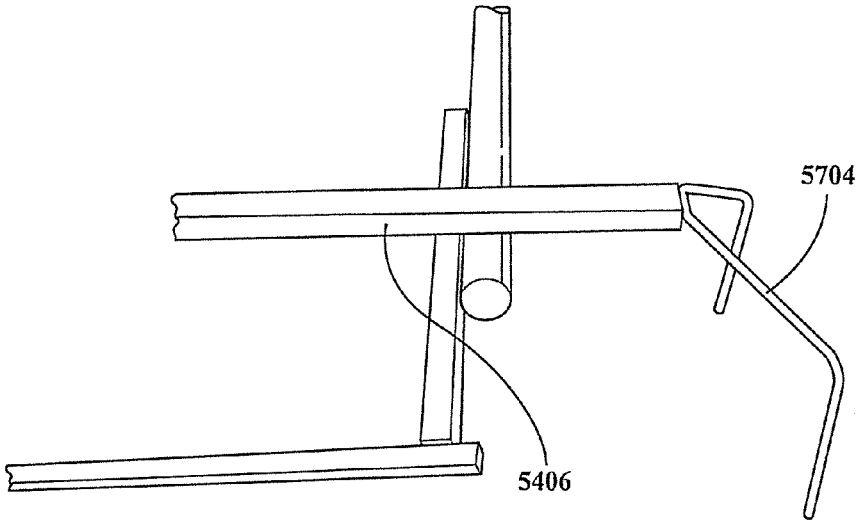

As shown in FIG. 56, in embodiments of a non-wallhugger bed, the kit may comprise a plurality of leg members 5602, to elevate the adjustable bed assembly from the ground, wherein the leg members 5602 may be affixed to the substantially parallel side center frame members 5608. The leg members 5602 may be connected with at least one leg connector 5604 frame member, so as to provide more support. The leg connector frame member 5604 may be placed anywhere in between leg members 5602. The leg connector frame member 5604 may be placed in a manner so that the leg connector frame member 5604 is perpendicular to the leg members 5602; however, the placement of the leg connector 5604 frame members is not limited to this embodiment. In embodiments, the kit may include a plurality of leg concealers 5606. These leg concealers 5606 may be cylindrical. The leg concealers 5606 may be constructed from, but not limited to, metal or plastic. The leg concealers 5606 may be affixed to the leg members 5602 by any method known to the art, including, but not limited to, snapping on, welding, or being bolted on.

Figure 58C:
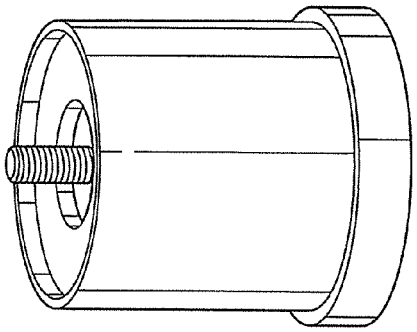
FIG. 58A, FIG. 58B, and FIG. 58C each show an embodiment of a threaded leg member.
Figure 58B:
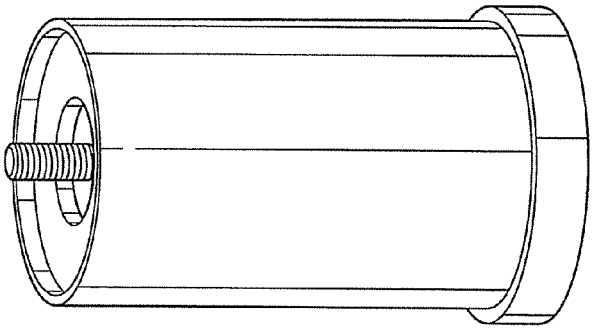
Figure 58A:
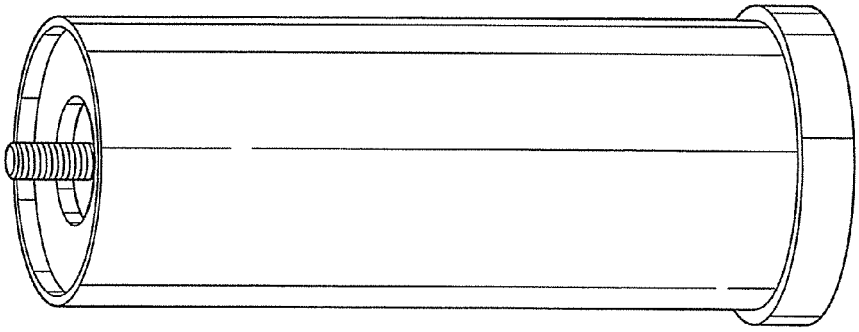

In embodiments, a modular leg construction using threaded members is depicted in FIG. 58A, FIG. 58B, and FIG. 58C. FIG. 58 C depicts a threaded leg member of one size, FIG. 58B depicts a threaded leg member of another size, and FIG. 58A depicts a combination leg formed from threading the threaded leg members depicted in FIGS. 58B and 58C together. For example, one threaded member may be three inches, as in FIG. 58C and another threaded member may be five inches, as in FIG. 58B. These two threaded members may be used individually to provide legs for the bed of a certain height. However, the legs may also be threaded together to provide a longer leg, such as the eight inch leg that is shown in FIG. 58A.

FIGS. 59-63 illustrate a modular leg assembly 6010 for use with a support frame such as a frame that forms part of one of the adjustable bed foundations described herein. However, the modular leg assembly is not limited to this use.

FIG. 59 shows first leg member 6012 and second leg member 6014 that may be connected individually or in combination to a support frame. As shown, the leg members 6012 and 6014 have different lengths such that three different leg heights may be provided. For example, use of the shorter leg member 6012 provides a short leg, longer leg member 6014 provides a medium length leg, and the combination of leg members 6012 and 6014, when connected together as in FIG. 60, provide a long leg length. In an alternative, a further third member is provided that may further lengthen the leg. Such a third member may be connected between the leg member 6012 and the support frame.

The first leg member 6012 has a body portion 6016 with a top end 6018 having a top surface 6020 and an opposite bottom end 6022 having a bottom surface 6024. The top end has a side-to-side width 6026 greater than a side-to-side width 6028 of the bottom end 6022. A tapered outer surface 6030 extends between the top surface 6020 and bottom surface 6024. The body portion 6016 of the first leg member 6012 has a first top-to-bottom length 6032 defined between the top surface 6020 and bottom surface 6024.

Likewise, the second leg member 6014 has a body portion 6036 with a top end 6038 having a top surface 6040 and an opposite bottom end 6042 having a bottom surface 6044. The top end 6038 has a side-to-side width 6046 greater than a side-to-side width 6048 of the bottom end 6042. A tapered outer surface 6050 extends between the top surface 6040 and bottom surface 6044. The body portion having a second top-to-bottom length 6052 defined between the top surface and bottom surface. As shown, the second top-to-bottom length is different than the first top-to-bottom length. In the illustrated version, the first length 6032 is less than the second length 6052. In one example, the first length 6032 is approximately 3 inches, the second length 6052 is approximately 5 inches and the combined length is approximately 8 inches.

As shown, the side-to-side width 6046 of the top end 6038 of the second leg member 6014 is approximately equal to the side-to-side width 6028 of the bottom end 6022 of the first leg member 6012 such that when the top end 6032 of the second leg member 6014 is connected to the bottom end 6022 of the first leg member 6012, the top surface 6040 of the second leg member 6014 is disposed against the bottom surface 6024 of the first leg member 6012 and the combined leg members have a generally continuously tapered outer surface. As shown, the leg members may be circular in side-to-side cross section.

In the illustrated embodiment, the leg members 6012 and 6014 each have a connecting element, 6060 and 6062 respectively, extending from the respective top surface. The connecting member connects the respective leg member to a support frame, or can interconnect the second leg member 6014 to the first leg member 6012. In this version, the connecting elements 6060 and 6062 are threaded elements.

Figure 61:
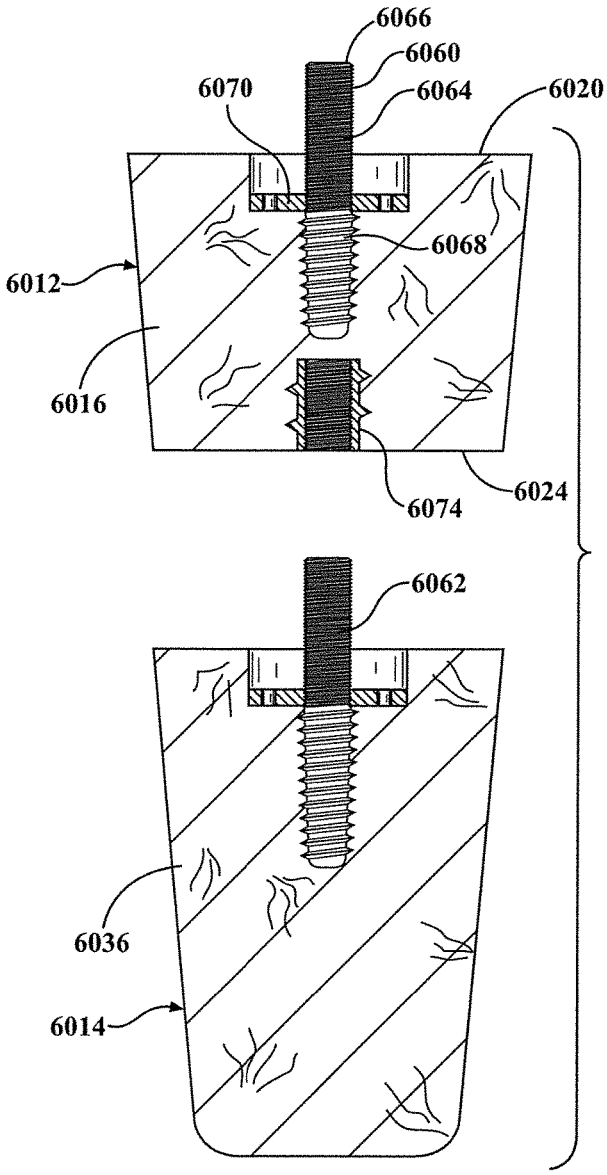
FIG. 61 is a cross sectional view of the leg members of FIG. 59.
Figure 62:
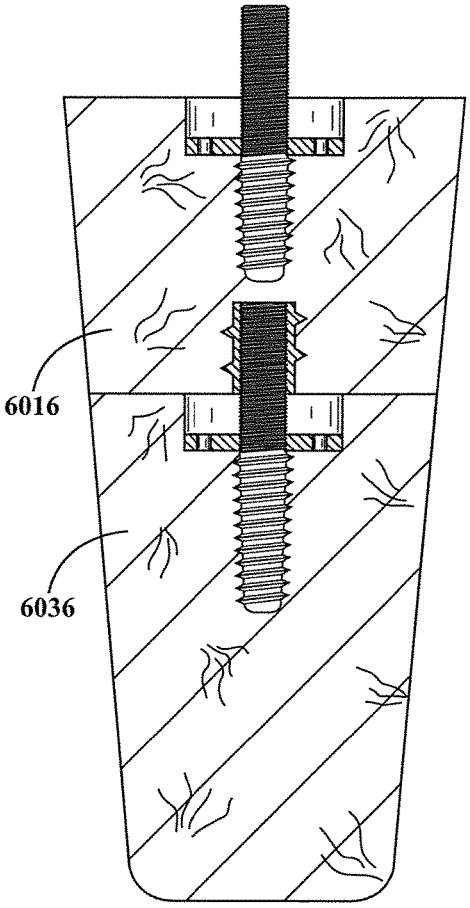
FIG. 62 is a cross sectional view similar to FIG. 61 but with the leg members connected together.
Figure 63:
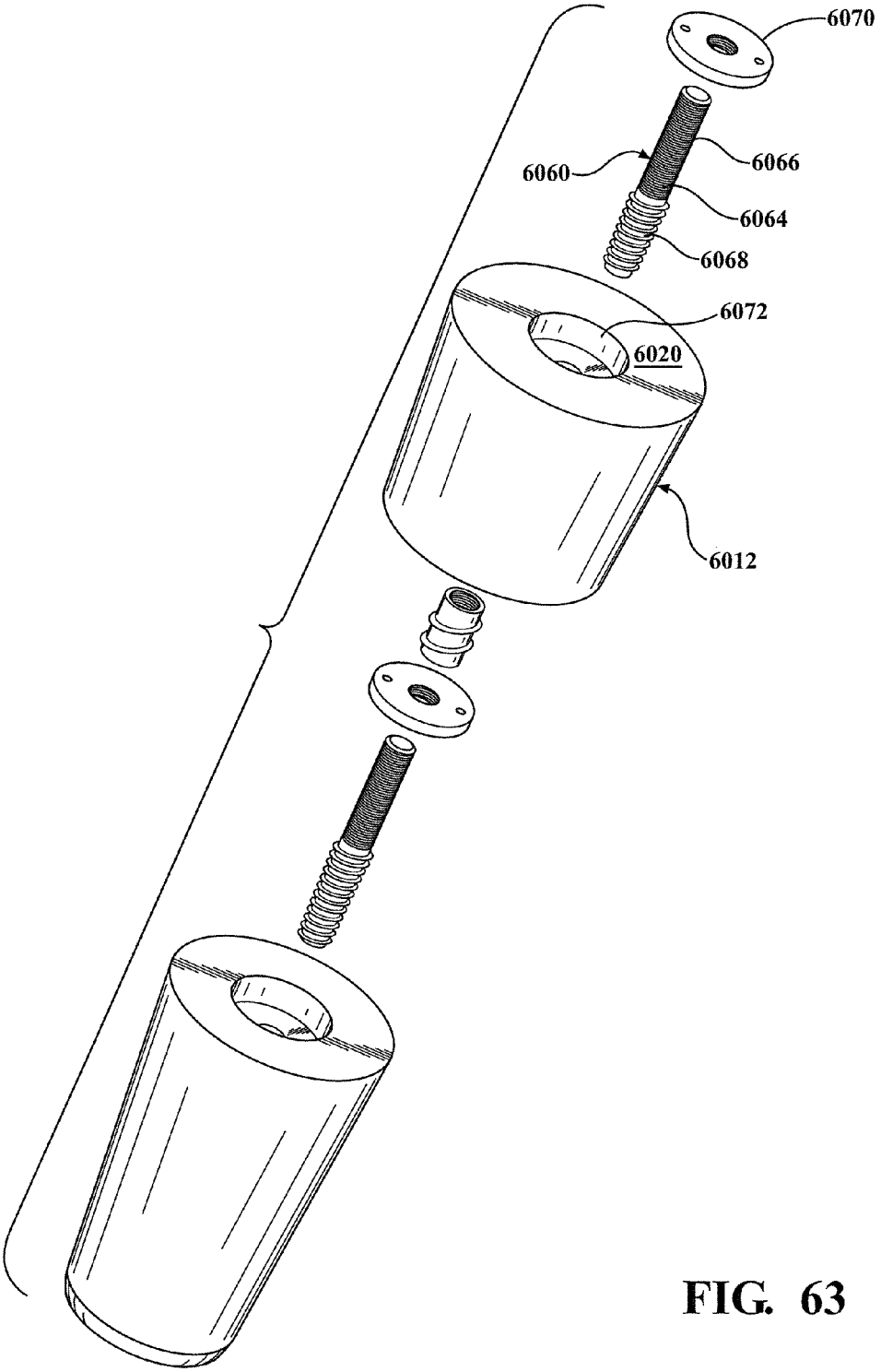
FIG. 63 is an exploded view of the leg members of FIG. 59 showing the component elements.

FIGS. 61-63 provide cross sectional and exploded views of certain versions of a leg assembly to illustrate one approach to constructing the leg members. Referring to FIGS. 61 and 62, the body portions 6016 and 6036 of the leg member are formed substantially of wood, though other materials may be used, and the connecting elements 6060 and 6062 are formed of metal. In the illustrated versions, the leg members are circular in side-to-side cross section and the connecting elements extend along an axis of the leg members.

The connecting elements may take a variety of forms. Connecting element 6060 will be described in more detail, with reference to FIGS. 61-63, with the understanding that the other connecting element 6062 is the same. The connecting element 6060 takes the form of a double-threaded member 6064 having a fine pitch upper portion 6066 and a course pitch lower portion 6068. A threaded collar 6070 threads onto fine pitch upper portion 6066 until it bottoms out, and is then used to drive the course pitch lower portion 6068 into the wood body portion 6016 of the leg member. A recess 6072, sized to receive the collar 6070, is defined in the upper surface 6020 of the leg member 6012. The connecting element 6060 is turned until the collar 6070 bottoms out. The first leg member 6012 also has a receiving element 6074 defining a receiving opening in the bottom surface 6024 for receiving the connecting member 6062 of the second leg member 6014. The second leg member 6014 does not have a receiving opening in the bottom surface.

Figure 64:
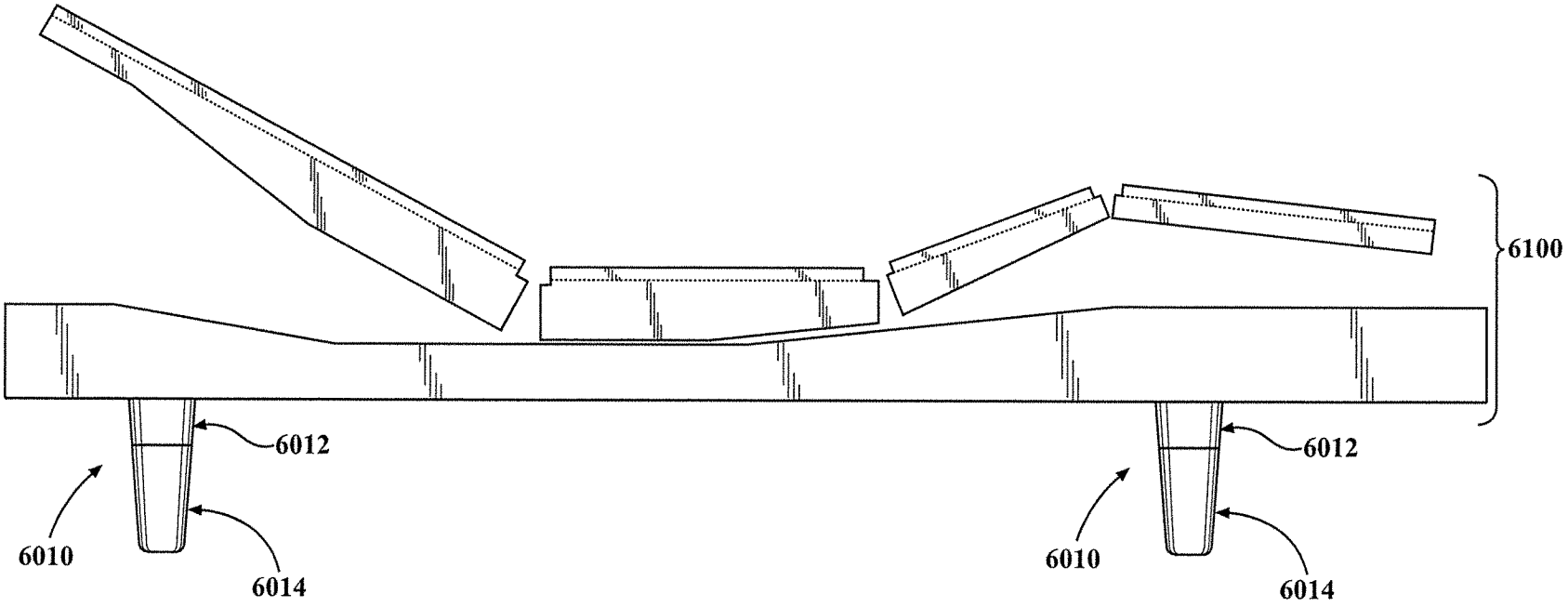
FIG. 64 is a side view of an adjustable bed foundation with leg assemblies supporting the foundation.

FIG. 64 illustrates a support system 6100 with a pair of leg assemblies 6010 connected thereto. In this example, the support system is a mattress support frame. Specifically, the support system is a support frame including a base frame and an articulating frame supported by the base frame, the leg members being adapted to connect to the base frame. The support system 6100 is shown with long leg assemblies each provided by an interconnected first leg member 6012 and second leg member 6014, but the support system may be supported at a lower height by using only one of the leg members for each leg assembly.

In embodiments, the kit may comprise a plurality of inner skirt supports 5704. These supports 5704 may be affixed to the forward base frame connector 5406. These supports 5704 may also be affixed to the rear base frame 5408 connector as well. The inner skirt 5704 supports may also be affixed to the roller bracket, center frame, side rail bracket, or any other component of the adjustable bed assembly. The inner skirt 5704 supports may be affixed using welding, bolts, or any other method known to the art.

In embodiments, the center frame, head frame, stabilizing bar, and foot frame may be affixed to the mattress platform in a preassembly, prior to construction of the adjustable bed frame assembly. Other components, such as, but not limited to, the extension frame members, the base frame, concave wheels, roller bracket, side rail bracket, and actuators, may be shipped in the same package as the preassembly, but may be deconstructed into individual components. In embodiments, a merchant or user receiving the kit sent by the manufacturer may construct the adjustable bed assembly by connecting the deconstructed individual components to the preassembly. In embodiments, construction materials such as bolts required to connect components to the preassembly may be included in the kit. In embodiments, the adjustable frame assembly components may be affixed to one another using a variety of methods, such as, but not limited to bolts, welding, gluing, or using brackets.

In embodiments, the systems and methods disclosed herein may comprise a method of constructing an adjustable bed assembly from a construction kit. The method may comprise adding foam or fabric in order to protect the assembly or provide aesthetic value. The foam and fabric may be affixed using stapling, gluing, or any other method known to the art. The method of constructing the kit may comprise affixing an extension frame member to the head frame. In embodiments, the method may comprise affixing an actuator to the mattress platform as well as affixing the actuator to an extension frame member. In embodiments, the method may comprise affixing an extension frame member to the rear center connector frame member. The method may comprise affixing an actuator to this extension frame member. The method may comprise affixing a roller bracket and a side rail bracket to a side center frame member. Additionally, the method may comprise affixing a substantially concave wheel to the roller bracket in order to provide movement for wallhugger functionality. In embodiments, the method may comprise affixing a foot extension frame member to the mattress platform. The method may comprise removal of fabric which may have been placed to prevent the foot frame from moving during shipping. The method may comprise constructing the base frame and setting the base side rails on the substantially concave wheels, which have been affixed to the roller bracket, so that the substantially concave wheels may roll along the base side frame members like a track. In embodiments, the method may comprise affixing a roller frame securing mechanism to the roller frame so that the base frame does not separate from the substantially concave wheels. The method may comprise affixing the foot frame may be affixed to the wheel connecting member by affixing a foot side frame member to a wheel connecting member. The method may further comprise affixing a plurality of inner skirt supports along the side center frame members. The method may further comprise affixing a plurality of inner skirt supports to the forward base frame connector member. In embodiments, the method may comprise constructing a concealing side rail. The method in which the concealing side rail is constructed may comprise affixing two substantially parallel side concealing frame members to a concealing connector frame member. In embodiments, the method of constructing the adjustable bed assembly may comprise affixing the concealing side rail to the plurality of side rail brackets. The method may comprise affixing the stabilizer bar, which is affixed on one end to the mattress platform, to the forward connector base frame member. The method may comprise affixing a massage motor to the mattress platform. The method may comprise affixing leg members to the side center frame members. The method may comprise affixing a leg connector frame member to the leg members. The method may comprise affixing leg concealers to the leg members.

In other embodiments and referring to FIG. 42, fabric or other resilient material, such as panels, rails or any other concealing assembly, may be attached to the center frame or the decking associated with the center frame or both of a wallhugger bed. As the top frame of the adjustable bed articulates causing the head section to raise and the center frame to translate towards the head end of the bed, the concealing assembly is caused to also move towards the head end of the bed along with the center frame.

The methods and systems described herein may be deployed in part or in whole through a machine that executes computer software, program codes, and/or instructions on a processor. The processor may be part of a server, client, network infrastructure, mobile computing platform, stationary computing platform, or other computing platform. A processor may be any kind of computational or processing device capable of executing program instructions, codes, binary instructions and the like. The processor may be or include a signal processor, digital processor, embedded processor, microprocessor or any variant such as a co-processor (math co-processor, graphic co-processor, communication co-processor and the like) and the like that may directly or indirectly facilitate execution of program code or program instructions stored thereon. In addition, the processor may enable execution of multiple programs, threads, and codes. The threads may be executed simultaneously to enhance the performance of the processor and to facilitate simultaneous operations of the application. By way of implementation, methods, program codes, program instructions and the like described herein may be implemented in one or more thread. The thread may spawn other threads that may have assigned priorities associated with them; the processor may execute these threads based on priority or any other order based on instructions provided in the program code. The processor may include memory that stores methods, codes, instructions and programs as described herein and elsewhere. The processor may access a storage medium through an interface that may store methods, codes, and instructions as described herein and elsewhere. The storage medium associated with the processor for storing methods, programs, codes, program instructions or other type of instructions capable of being executed by the computing or processing device may include but may not be limited to one or more of a CD-ROM, DVD, memory, hard disk, flash drive, RAM, ROM, cache and the like.

A processor may include one or more cores that may enhance speed and performance of a multiprocessor. In embodiments, the process may be a dual core processor, quad core processors, other chip-level multiprocessor and the like that combine two or more independent cores (called a die).

The methods and systems described herein may be deployed in part or in whole through a machine that executes computer software on a server, client, firewall, gateway, hub, router, or other such computer and/or networking hardware. The software program may be associated with a server that may include a file server, print server, domain server, internet server, intranet server and other variants such as secondary server, host server, distributed server and the like. The server may include one or more of memories, processors, computer readable media, storage media, ports (physical and virtual), communication devices, and interfaces capable of accessing other servers, clients, machines, and devices through a wired or a wireless medium, and the like. The methods, programs or codes as described herein and elsewhere may be executed by the server. In addition, other devices required for execution of methods as described in this application may be considered as a part of the infrastructure associated with the server.

The server may provide an interface to other devices including, without limitation, clients, other servers, printers, database servers, print servers, file servers, communication servers, distributed servers and the like. Additionally, this coupling and/or connection may facilitate remote execution of program across the network. The networking of some or all of these devices may facilitate parallel processing of a program or method at one or more location without deviating from the scope of the invention. In addition, any of the devices attached to the server through an interface may include at least one storage medium capable of storing methods, programs, code and/or instructions. A central repository may provide program instructions to be executed on different devices. In this implementation, the remote repository may act as a storage medium for program code, instructions, and programs.

The software program may be associated with a client that may include a file client, print client, domain client, internet client, intranet client and other variants such as secondary client, host client, distributed client and the like. The client may include one or more of memories, processors, computer readable media, storage media, ports (physical and virtual), communication devices, and interfaces capable of accessing other clients, servers, machines, and devices through a wired or a wireless medium, and the like. The methods, programs or codes as described herein and elsewhere may be executed by the client. In addition, other devices required for execution of methods as described in this application may be considered as a part of the infrastructure associated with the client.

The client may provide an interface to other devices including, without limitation, servers, other clients, printers, database servers, print servers, file servers, communication servers, distributed servers and the like. Additionally, this coupling and/or connection may facilitate remote execution of program across the network. The networking of some or all of these devices may facilitate parallel processing of a program or method at one or more location without deviating from the scope of the invention. In addition, any of the devices attached to the client through an interface may include at least one storage medium capable of storing methods, programs, applications, code and/or instructions. A central repository may provide program instructions to be executed on different devices. In this implementation, the remote repository may act as a storage medium for program code, instructions, and programs.

The methods and systems described herein may be deployed in part or in whole through network infrastructures. The network infrastructure may include elements such as computing devices, servers, routers, hubs, firewalls, clients, personal computers, communication devices, routing devices and other active and passive devices, modules and/or components as known in the art. The computing and/or non-computing device(s) associated with the network infrastructure may include, apart from other components, a storage medium such as flash memory, buffer, stack, RAM, ROM and the like. The processes, methods, program codes, instructions described herein and elsewhere may be executed by one or more of the network infrastructural elements.

The methods, program codes, and instructions described herein and elsewhere may be implemented on a cellular network having multiple cells. The cellular network may either be frequency division multiple access (FDMA) network or code division multiple access (CDMA) network. The cellular network may include mobile devices, cell sites, base stations, repeaters, antennas, towers, and the like. The cell network may be a GSM, GPRS, 3G, EVDO, mesh, or other networks types.

The methods, programs codes, and instructions described herein and elsewhere may be implemented on or through mobile devices. The mobile devices may include navigation devices, cell phones, mobile phones, mobile personal digital assistants, laptops, palmtops, netbooks, pagers, electronic books readers, music players and the like. These devices may include, apart from other components, a storage medium such as a flash memory, buffer, RAM, ROM and one or more computing devices. The computing devices associated with mobile devices may be enabled to execute program codes, methods, and instructions stored thereon. Alternatively, the mobile devices may be configured to execute instructions in collaboration with other devices. The mobile devices may communicate with base stations interfaced with servers and configured to execute program codes. The mobile devices may communicate on a peer to peer network, mesh network, or other communications network. The program code may be stored on the storage medium associated with the server and executed by a computing device embedded within the server. The base station may include a computing device and a storage medium. The storage device may store program codes and instructions executed by the computing devices associated with the base station.

The computer software, program codes, and/or instructions may be stored and/or accessed on machine readable media that may include: computer components, devices, and recording media that retain digital data used for computing for some interval of time; semiconductor storage known as random access memory (RAM); mass storage typically for more permanent storage, such as optical discs, forms of magnetic storage like hard disks, tapes, drums, cards and other types; processor registers, cache memory, volatile memory, non-volatile memory; optical storage such as CD, DVD; removable media such as flash memory (e.g. USB sticks or keys), floppy disks, magnetic tape, paper tape, punch cards, standalone RAM disks, Zip drives, removable mass storage, off-line, and the like; other computer memory such as dynamic memory, static memory, read/write storage, mutable storage, read only, random access, sequential access, location addressable, file addressable, content addressable, network attached storage, storage area network, bar codes, magnetic ink, and the like.

The methods and systems described herein may transform physical and/or or intangible items from one state to another. The methods and systems described herein may also transform data representing physical and/or intangible items from one state to another.

The elements described and depicted herein, including in flow charts and block diagrams throughout the figures, imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, or any combination of these, and all such implementations may be within the scope of the present disclosure. Examples of such machines may include, but may not be limited to, personal digital assistants, laptops, personal computers, mobile phones, other handheld computing devices, medical equipment, wired or wireless communication devices, transducers, chips, calculators, satellites, tablet PCs, electronic books, gadgets, electronic devices, devices having artificial intelligence, computing devices, networking equipment, servers, routers and the like. Furthermore, the elements depicted in the flow chart and block diagrams or any other logical component may be implemented on a machine capable of executing program instructions. Thus, while the foregoing drawings and descriptions set forth functional aspects of the disclosed systems, no particular arrangement of software for implementing these functional aspects should be inferred from these descriptions unless explicitly stated or otherwise clear from the context. Similarly, it will be appreciated that the various steps identified and described above may be varied, and that the order of steps may be adapted to particular applications of the techniques disclosed herein. All such variations and modifications are intended to fall within the scope of this disclosure. As such, the depiction and/or description of an order for various steps should not be understood to require a particular order of execution for those steps, unless required by a particular application, or explicitly stated or otherwise clear from the context.

The methods and/or processes described above, and steps thereof, may be realized in hardware, software or any combination of hardware and software suitable for a particular application. The hardware may include a general purpose computer and/or dedicated computing device or specific computing device or particular aspect or component of a specific computing device. The processes may be realized in one or more microprocessors, microcontrollers, embedded microcontrollers, programmable digital signal processors or other programmable device, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as a computer executable code capable of being executed on a machine readable medium.

The computer executable code may be created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software, or any other machine capable of executing program instructions.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, the means for performing the steps associated with the processes described above may include any of the hardware and/or software described above. All such permutations and combinations are intended to fall within the scope of the present disclosure.

While the invention has been disclosed in connection with the preferred embodiments shown and described in detail, various modifications and improvements thereon will become readily apparent to those skilled in the art. Accordingly, the spirit and scope of the present invention is not to be limited by the foregoing examples, but is to be understood in the broadest sense allowable by law.

All documents referenced herein are hereby incorporated by reference.

What is claimed is:

1. A support system, comprising:

a support frame, comprising a substantially horizontal bottom surface defining a length and a width of the support frame; and at least one modular leg assembly mounted to and supporting the support frame, each of the at least one leg assembly comprising;

a first leg member having a body portion with a top end having a top surface and an opposite bottom end having a bottom surface, the top end having a side-to-side width greater than a side-to-side width of the bottom end, the first leg member further having a tapered outer surface extending between the top and bottom surfaces, the body portion of the first leg member having a first top-to-bottom length defined between the top surface and bottom surface; and a second leg member having a body portion with a top end having a top surface and an opposite bottom end having a bottom surface, the top end having a side-to-side width greater than a side-to-side width of the bottom end, the second leg member further having a tapered outer surface extending between the top and bottom surfaces, the body portion having a second top-to-bottom length defined between the top surface and bottom surface, the second top-to-bottom length being different than the first top-to-bottom length;

wherein the first and second leg members are connected individually or in combination to the support frame such that at least three leg heights are selectably provided, such that each of the leg heights extending from the bottom surface of the support frame to a bottom surface of a leg member is substantially less than the length of the support frame; and wherein the side-to-side width of the top end of each second leg member is approximately equal to the side-to-side width of the bottom end of each first leg member such that when the top end of one of the second leg members is connected to the bottom end of one of the first leg members, the top surface of the one of the second leg members is disposed against the bottom surface of the one of the first leg members and the combined leg members have a generally continuously tapered outer surface.

2. The support system of claim 1, wherein the first and second leg members each have a connecting element extending from the top surface thereof for connecting the leg member to another leg member or to the support frame.

3. The support system of claim 2, wherein the body of each of the leg members is formed substantially from wood and the connecting elements are formed of metal.

4. The support system of claim 2, wherein:

the first leg member has a receiving opening defined in the bottom surface for receiving the connecting element of the second leg member; and the second leg member does not have a receiving opening defined in the bottom surface.

5. The support system of claim 2, wherein the connecting elements are threaded elements.

6. The support system of claim 1, wherein the top-to-bottom length of the first leg member is less than the top-to-bottom length of the second leg member.

7. The support system of claim 1, wherein the outer surfaces of the first and second leg members are circular in side-to-side cross section.

8. The support system of claim 1, wherein the support frame includes a base frame and an articulating frame supported by the base frame, the leg members being connectable to the base frame.

9. The support system of claim 1, wherein the support frame is a mattress support frame.

10. The support system of claim 1, wherein the at least one modular leg assembly comprises a plurality of modular leg assemblies.

11. A bed foundation, comprising:

a mattress support frame having a base frame and an articulating frame supported on the base frame, the base frame comprising a substantially horizontal bottom surface defining a length and a width of the base frame; and a plurality of modular leg assemblies, each of the at least one leg assembly comprising;

a first leg member having a body portion with a top end having a top surface and an opposite bottom end having a bottom surface, the top end having a side-to-side width greater than a side-to-side width of the bottom end, the first leg member further having a tapered outer surface extending between the top and bottom surfaces, the body portion of the first leg member having a first top-to-bottom length defined between the top surface and bottom surface; and a second leg member having a body portion with a top end having a top surface and an opposite bottom end having a bottom surface, the top end having a side-to-side width greater than a side-to-side width of the bottom end, the second leg member further having a tapered outer surface extending between the top and bottom surfaces, the body portion having a second top-to-bottom length defined between the top surface and bottom surface, the second top-to-bottom length being different than the first top-to-bottom length;

wherein a plurality of the first leg members are each connected to the base frame to provide a first leg length for the bed foundation, a plurality of the second leg members are each connected to the base frame to provide a second leg length for the bed foundation, and a plurality of threaded together first and second leg members are connected to the base frame to provide a third leg length greater than the first or second leg length, such that each of the leg lengths extending from the bottom surface of the base frame to a bottom surface of a leg member is substantially less than the length of the base frame; and wherein the side-to-side width of the top end of each of the second leg members is approximately equal to the side-to-side width of the bottom end of each of the first leg members such that when the top end of one of the second leg members is connected to the bottom end of one of the first leg members, the top surface of the one of the second leg members is disposed against the bottom surface of the one of the first leg members and the combined leg members have a generally continuously tapered outer surface.

12. A modular leg kit for a bed foundation having a base frame comprising a substantially horizontal bottom surface defining a length and a width of the base frame, the modular leg kit comprising;

a plurality of first leg members each a body portion with a top end having a top surface and an opposite bottom end having a bottom surface, the top end having a side-to-side width greater than a side-to-side width of the bottom end, the first leg member further having a tapered outer surface extending between the top and bottom surfaces, the body portion of the first leg member having a first top-to-bottom length defined between the top surface and bottom surface; and a plurality of second leg members each having a body portion with a top end having a top surface and an opposite bottom end having a bottom surface, the top end having a side-to-side width greater than a side-to-side width of the bottom end, the second leg member further having a tapered outer surface extending between the top and bottom surfaces, the body portion having a second top-to-bottom length defined between the top surface and bottom surface, the second top-to-bottom length being different than the first top-to-bottom length;

wherein a plurality of the first leg members are each connected to the base frame to provide a first leg length for the adjustable bed foundation, a plurality of the second leg members are each connected to the base frame to provide a second leg length for the adjustable bed foundation, and a plurality of connected together first and second leg members are connected to the base frame to provide a third leg length greater than the first or second leg length, such that each of the leg lengths extending from the bottom surface of the base frame to a bottom surface of a leg member is substantially less than the length of the base frame; and wherein the side-to-side width of the top end of each of the second leg members is approximately equal to the side-to-side width of the bottom end of each of the first leg members such that when the top end of one of the second leg members is connected to the bottom end of one of the first leg members, the top surface of the one of the second leg members is disposed against the bottom surface of the one of the first leg members and the combined leg members have a generally continuously tapered outer surface.

13. The modular leg kit of claim 12, wherein each of the first and second leg members have a connecting element extending therefrom for connecting the leg member to another leg member or to the base frame.

14. The modular leg kit of claim 13, wherein the body of each of the leg members is formed substantially from wood and the connecting elements are formed of metal.

15. The modular leg kit of claim 13, wherein:

each of the first leg members has a receiving opening defined in the bottom surface for receiving the connecting element of one of the second leg members; and each of the second leg members does not have a receiving opening defined in the bottom surface.

16. The modular leg kit of claim 13, wherein the connecting elements are threaded elements.

17. The modular leg kit of claim 12, wherein the top-to-bottom length of each of the the first leg members is less than the top-to-bottom length of each of the second leg members.

18. The modular leg kit of claim 12, wherein the outer surfaces of the first and second leg members are circular in side-to-side cross section.

* * * * *